US011622209B2

(12) United States Patent
Zhang et al.

(10) Patent No.: US 11,622,209 B2
(45) **Date of Patent: *Apr. 4, 2023**

(54) SYSTEMS AND METHODS FOR SUPPRESSING SOUND LEAKAGE

(71) Applicant: SHENZHEN SHOKZ CO., LTD., Guangdong (CN)

(72) Inventors: Lei Zhang, Shenzhen (CN); Junjiang Fu, Shenzhen (CN); Bingyan Yan, Shenzhen (CN); Fengyun Liao, Shenzhen (CN); Xin Qi, Shenzhen (CN)

(73) Assignee: SHENZHEN SHOKZ CO., LTD., Shenzhen (CN)

( * ) Notice: Subject to any disclaimer, the term of this patent is extended or adjusted under 35 U.S.C. 154(b) by 99 days.

This patent is subject to a terminal disclaimer.

(21) Appl. No.: 17/218,326

(22) Filed: Mar. 31, 2021

(65) Prior Publication Data

US 2021/0219066 A1 Jul. 15, 2021

Related U.S. Application Data

(63) Continuation-in-part of application No. 17/141,264, filed on Jan. 5, 2021, now Pat. No. 11,445,281, and a (Continued)

(30) Foreign Application Priority Data

Jan. 6, 2014 (CN) ..... 201410005804.0
Apr. 30, 2019 (CN) ..... 201910364346.2

(Continued)

(51) Int. Cl.
*H04R 25/00* (2006.01)
*H04R 1/28* (2006.01)

(Continued)

(52) U.S. Cl.
CPC ..... *H04R 25/505* (2013.01); *G10K 9/13* (2013.01); *G10K 9/22* (2013.01); *G10K 11/175* (2013.01);

(Continued)

(58) Field of Classification Search
CPC .... H04R 25/505; H04R 1/2811; H04R 9/066; H04R 2460/13; H04R 17/00;

(Continued)

(56) References Cited

U.S. PATENT DOCUMENTS 2,327,320 A 8/1943 Shapiro
4,987,597 A 1/1991 Haertl (Continued)

FOREIGN PATENT DOCUMENTS

CN 201426267 Y 3/2010
CN 201616895 U 10/2010

(Continued)

OTHER PUBLICATIONS

Notice of Preliminary Rejection in Korean Application No. 10-2022-7010046 dated Jun. 20, 2022, 15 pages.

(Continued)

*Primary Examiner* — Matthew A Eason
(74) *Attorney, Agent, or Firm* — Metis IP LLC

(57) ABSTRACT

A speaker comprises a housing, a transducer residing inside the housing, and at least one sound guiding hole located on the housing. The transducer generates vibrations. The vibrations produce a sound wave inside the housing and cause a leaked sound wave spreading outside the housing from a portion of the housing. The at least one sound guiding hole guides the sound wave inside the housing through the at least one sound guiding hole to an outside of the housing. The guided sound wave interferes with the leaked sound wave in a target region. The interference at a specific frequency (Continued)

relates to a distance between the at least one sound guiding hole and the portion of the housing.

20 Claims, 25 Drawing Sheets

Related U.S. Application Data continuation-in-part of application No. 17/074,762, filed on Oct. 20, 2020, now Pat. No. 11,197,106, which is a continuation-in-part of application No. 16/813,915, filed on Mar. 10, 2020, now Pat. No. 10,848,878, which is a continuation of application No. PCT/CN2019/130880, filed on Dec. 31, 2019, which is a continuation of application No. 16/419,049, filed on May 22, 2019, now Pat. No. 10,616,696, which is a continuation of application No. 16/180,020, filed on Nov. 5, 2018, now Pat. No. 10,334,372, which is a continuation of application No. 15/650,909, filed on Jul. 16, 2017, now Pat. No. 10,149,071, which is a continuation of application No. 15/109,831, filed as application No. PCT/CN2014/094065 on Dec. 17, 2014, now Pat. No. 9,729,978.

(30) Foreign Application Priority Data

Sep. 19, 2019 (CN) ..... 201910888067.6
Sep. 19, 2019 (CN) ..... 201910888762.2

(51) Int. Cl.

| | |
|---|---|
| ***H04R 9/06*** | (2006.01) |
| ***G10K 9/13*** | (2006.01) |
| ***G10K 9/22*** | (2006.01) |
| ***G10K 11/178*** | (2006.01) |
| ***G10K 11/26*** | (2006.01) |
| ***G10K 11/175*** | (2006.01) |
| *H04R 17/00* | (2006.01) |

(52) U.S. Cl.
CPC ..... *G10K 11/178* (2013.01); *G10K 11/26* (2013.01); *H04R 1/2811* (2013.01); *H04R 9/066* (2013.01); *G10K 2210/3216* (2013.01); *H04R 1/2876* (2013.01); *H04R 17/00* (2013.01); *H04R 2460/13* (2013.01)

(58) Field of Classification Search
CPC ..... H04R 1/2876; G10K 9/13; G10K 9/22; G10K 11/26; G10K 11/175; G10K 11/178; G10K 2210/3216
See application file for complete search history.

(56) References Cited

U.S. PATENT DOCUMENTS

| | | | | |
|---|---|---|---|---|
| 5,430,803 | A | 7/1995 | Kimura et al. | |
| 5,692,059 | A | 11/1997 | Kruger | |
| 5,757,935 | A | 5/1998 | Kang et al. | |
| 5,790,684 | A | 8/1998 | Niino et al. | |
| 6,850,138 | B1 | 2/2005 | Sakai | |
| 8,141,678 | B2 | 3/2012 | Ikeyama et al. | |
| 9,226,075 | B2 | 12/2015 | Lee | |
| 9,729,978 | B2 | 8/2017 | Qi et al. | |
| 10,149,071 | B2 | 12/2018 | Qi et al. | |
| 10,334,372 | B2 | 6/2019 | Qi et al. | |
| 10,616,696 | B2 | 4/2020 | Qi et al. | |
| 10,897,677 | B2 | 1/2021 | Walraevens et al. | |
| 11,197,106 | B2 | 12/2021 | Qi et al. | |
| 2003/0048913 | A1 | 3/2003 | Lee et al. | |
| 2006/0098829 | A1 | 5/2006 | Kobayashi | |
| 2007/0041595 | A1 | 2/2007 | Carazo et al. | |
| 2009/0095613 | A1 | 4/2009 | Lin | |
| 2009/0141920 | A1 | 6/2009 | Suyama | |
| 2009/0190781 | A1 | 7/2009 | Fukuda | |
| 2009/0208031 | A1 | 8/2009 | Abolfathi | |
| 2009/0285417 | A1 | 11/2009 | Shin et al. | |
| 2009/0290730 | A1 | 11/2009 | Fukuda et al. | |
| 2010/0054492 | A1 | 3/2010 | Eaton et al. | |
| 2010/0246864 | A1 | 9/2010 | Hildebrandt et al. | |
| 2010/0310106 | A1 | 12/2010 | Blanchard et al. | |
| 2010/0322454 | A1 | 12/2010 | Ambrose et al. | |
| 2011/0150262 | A1 | 6/2011 | Nakama et al. | |
| 2012/0020501 | A1* | 1/2012 | Lee | H04R 1/1016 381/151 |
| 2012/0070022 | A1 | 3/2012 | Saiki | |
| 2013/0051585 | A1 | 2/2013 | Karkkainen et al. | |
| 2013/0266170 | A1 | 10/2013 | Yamagishi | |
| 2013/0329919 | A1 | 12/2013 | He | |
| 2014/0009008 | A1 | 1/2014 | Li et al. | |
| 2014/0064533 | A1 | 3/2014 | Kasic, II | |
| 2014/0185822 | A1 | 7/2014 | Kunimoto et al. | |
| 2014/0185837 | A1 | 7/2014 | Kunimoto et al. | |
| 2014/0274229 | A1 | 9/2014 | Fukuda | |
| 2014/0355777 | A1 | 12/2014 | Nabata et al. | |
| 2015/0030189 | A1 | 1/2015 | Nabata et al. | |
| 2015/0256656 | A1* | 9/2015 | Horii | H04M 1/0202 455/575.1 |
| 2015/0264473 | A1 | 9/2015 | Fukuda | |
| 2015/0326967 | A1 | 11/2015 | Otani | |
| 2016/0037243 | A1 | 2/2016 | Lippert et al. | |
| 2016/0205458 | A1 | 7/2016 | Huang et al. | |
| 2016/0329041 | A1 | 11/2016 | Qi et al. | |
| 2018/0182370 | A1 | 6/2018 | Hyde et al. | |
| 2019/0052954 | A1 | 2/2019 | Rusconi Clerici Beltrami et al. | |
| 2020/0367008 | A1 | 11/2020 | Walsh et al. | |
| 2021/0099027 | A1 | 4/2021 | Larsson et al. | |
| 2021/0219059 | A1 | 7/2021 | Qi et al. | |
| 2021/0219067 | A1* | 7/2021 | Zhang | G10K 11/175 |
| 2021/0243518 | A1 | 8/2021 | Zhang et al. | |

FOREIGN PATENT DOCUMENTS

| | | | |
|---|---|---|---|
| CN | 201690580 | U | 12/2010 |
| CN | 102014328 | A | 4/2011 |
| CN | 102421043 | A | 4/2012 |
| CN | 202435600 | U | 9/2012 |
| CN | 103167390 | A | 6/2013 |
| CN | 103347235 | A | 10/2013 |
| CN | 204206450 | U | 3/2015 |
| CN | 204810512 | U | 11/2015 |
| CN | 107231585 | A | 10/2017 |
| CN | 206575566 | U | 10/2017 |
| CN | 207939700 | U | 10/2018 |
| EP | 2011367 | B1 | 12/2014 |
| JP | 2006332715 | A | 12/2006 |
| JP | 2007251358 | A | 9/2007 |
| KR | 20050030183 | A | 3/2005 |
| KR | 20090082999 | A | 8/2009 |
| WO | 2004095878 | A2 | 11/2004 |

OTHER PUBLICATIONS

International Search Report in PCT/CN2014/094065 dated Mar. 17, 2015, 5 pages.
Written Opinion in PCT/CN2014/094065 dated Mar. 17, 2015, 10 pages.
First Office Action in Chinese Application No. 201410005804.0 dated Dec. 7, 2015, 9 pages.
Notice of Reasons for Refusal in Japanese Application No. 2016545828 dated Jun. 20, 2017, 10 pages.
The Extended European Search Report in European Application No. 14877111.6 dated Mar. 17, 2017, 6 pages.
First Examination Report in Indian Application No. 201617026062 dated Nov. 13, 2020, 6 pages.

(56) References Cited

OTHER PUBLICATIONS

International Search Report in PCT/CN2019/130880 dated Apr. 1, 2020, 6 pages.

* cited by examiner

2200

SYSTEMS AND METHODS FOR SUPPRESSING SOUND LEAKAGE

CROSS-REFERENCE TO RELATED APPLICATIONS

The present application is a continuation-in-part of U.S. patent application Ser. No. 17/074,762 filed on Oct. 20, 2020, which is a continuation-in-part of U.S. patent application Ser. No. 16/813,915 (now U.S. Pat. No. 10,848,878) filed on Mar. 10, 2020, which is a continuation of U.S. patent application Ser. No. 16/419,049 (now U.S. Pat. No. 10,616,696) filed on May 22, 2019, which is a continuation of U.S. patent application Ser. No. 14/180,020 (now U.S. Pat. No. 10,334,372) filed on Nov. 5, 2018, which is a continuation of U.S. patent application Ser. No. 15/650,909 (now U.S. Pat. No. 10,149,071) filed on Jul. 16, 2017, which is a continuation of U.S. patent application Ser. No. 15/109,831 (now U.S. Pat. No. 9,729,978) filed on Jul. 6, 2016, which is a U.S. National Stage entry under 35 U.S.C. § 371 of International Application No. PCT/CN2014/094065, filed on Dec. 17, 2014, designating the United States of America, which claims priority to Chinese Patent Application No. 201410005804.0, filed on Jan. 6, 2014; the present application is also a continuation-in-part of U.S. patent application Ser. No. 17/141,264 filed on Jan. 5, 2021, which is a continuation of International Application No. PCT/CN2019/130880, filed on Dec. 31, 2019, which claims priority of the Chinese Application No. 201910888067.6 filed on Sep. 19, 2019, priority of Chinese Application No. 201910888762.2 filed on Sep. 19, 2019, and priority of the Chinese Application No. 201910364346.2 filed on Apr. 30, 2019. Each of the above-referenced applications is hereby incorporated by reference.

FIELD OF THE INVENTION

This application relates to a bone conduction device, and more specifically, relates to methods and systems for reducing sound leakage by a bone conduction device.

BACKGROUND

A bone conduction speaker, which may be also called a vibration speaker, may push human tissues and bones to stimulate the auditory nerve in cochlea and enable people to hear sound. The bone conduction speaker is also called a bone conduction headphone.

An exemplary structure of a bone conduction speaker based on the principle of the bone conduction speaker is shown in FIGS. 1A and 1B. The bone conduction speaker may include an open housing 110, a vibration board 121, a transducer 122, and a linking component 123. The transducer 122 may transduce electrical signals to mechanical vibrations. The vibration board 121 may be connected to the transducer 122 and vibrate synchronically with the transducer 122. The vibration board 121 may stretch out from the opening of the housing 110 and contact with human skin to pass vibrations to auditory nerves through human tissues and bones, which in turn enables people to hear sound. The linking component 123 may reside between the transducer 122 and the housing 110, configured to fix the vibrating transducer 122 inside the housing 110. To minimize its effect on the vibrations generated by the transducer 122, the linking component 123 may be made of an elastic material.

However, the mechanical vibrations generated by the transducer 122 may not only cause the vibration board 121 to vibrate, but may also cause the housing 110 to vibrate through the linking component 123. Accordingly, the mechanical vibrations generated by the bone conduction speaker may push human tissues through the bone board 121, and at the same time a portion of the vibrating board 121 and the housing 110 that are not in contact with human issues may nevertheless push air. Air sound may thus be generated by the air pushed by the portion of the vibrating board 121 and the housing 110. The air sound may be called "sound leakage." In some cases, sound leakage is harmless. However, sound leakage should be avoided as much as possible if people intend to protect privacy when using the bone conduction speaker or try not to disturb others when listening to music.

Attempting to solve the problem of sound leakage, Korean patent KR10-2009-0082999 discloses a bone conduction speaker of a dual magnetic structure and double-frame. As shown in FIG. 2, the speaker disclosed in the patent includes: a first frame 210 with an open upper portion and a second frame 220 that surrounds the outside of the first frame 210. The second frame 220 is separately placed from the outside of the first frame 210. The first frame 210 includes a movable coil 230 with electric signals, an inner magnetic component 240, an outer magnetic component 250, a magnet field formed between the inner magnetic component 240, and the outer magnetic component 250. The inner magnetic component 240 and the out magnetic component 250 may vibrate by the attraction and repulsion force of the coil 230 placed in the magnet field. A vibration board 260 connected to the moving coil 230 may receive the vibration of the moving coil 230. A vibration unit 270 connected to the vibration board 260 may pass the vibration to a user by contacting with the skin. As described in the patent, the second frame 220 surrounds the first frame 210, in order to use the second frame 220 to prevent the vibration of the first frame 210 from dissipating the vibration to outsides, and thus may reduce sound leakage to some extent.

However, in this design, since the second frame 220 is fixed to the first frame 210, vibrations of the second frame 220 are inevitable. As a result, sealing by the second frame 220 is unsatisfactory. Furthermore, the second frame 220 increases the whole volume and weight of the speaker, which in turn increases the cost, complicates the assembly process, and reduces the speaker's reliability and consistency.

SUMMARY

The embodiments of the present application disclose methods and system of reducing sound leakage of a bone conduction speaker.

In one aspect, the embodiments of the present application disclose a method of reducing sound leakage of a bone conduction speaker, including: providing a bone conduction speaker including a vibration board fitting human skin and passing vibrations, a transducer, and a housing, wherein at least one sound guiding hole is located in at least one portion of the housing; the transducer drives the vibration board to vibrate; the housing vibrates, along with the vibrations of the transducer, and pushes air, forming a leaked sound wave transmitted in the air; the air inside the housing is pushed out of the housing through the at least one sound guiding hole, interferes with the leaked sound wave, and reduces an amplitude of the leaked sound wave.

In some embodiments, one or more sound guiding holes may locate in an upper portion, a central portion, and/or a lower portion of a sidewall and/or the bottom of the housing.

In some embodiments, a damping layer may be applied in the at least one sound guiding hole in order to adjust the phase and amplitude of the guided sound wave through the at least one sound guiding hole.

In some embodiments, sound guiding holes may be configured to generate guided sound waves having a same phase that reduce the leaked sound wave having a same wavelength; sound guiding holes may be configured to generate guided sound waves having different phases that reduce the leaked sound waves having different wavelengths.

In some embodiments, different portions of a same sound guiding hole may be configured to generate guided sound waves having a same phase that reduce the leaked sound wave having same wavelength. In some embodiments, different portions of a same sound guiding hole may be configured to generate guided sound waves having different phases that reduce leaked sound waves having different wavelengths.

In another aspect, the embodiments of the present application disclose a bone conduction speaker, including a housing, a vibration board and a transducer, wherein: the transducer is configured to generate vibrations and is located inside the housing; the vibration board is configured to be in contact with skin and pass vibrations; at least one sound guiding hole may locate in at least one portion on the housing, and preferably, the at least one sound guiding hole may be configured to guide a sound wave inside the housing, resulted from vibrations of the air inside the housing, to the outside of the housing, the guided sound wave interfering with the leaked sound wave and reducing the amplitude thereof.

In some embodiments, the at least one sound guiding hole may locate in the sidewall and/or bottom of the housing.

In some embodiments, preferably, the at least one sound guiding sound hole may locate in the upper portion and/or lower portion of the sidewall of the housing.

In some embodiments, preferably, the sidewall of the housing is cylindrical and there are at least two sound guiding holes located in the sidewall of the housing, which are arranged evenly or unevenly in one or more circles. Alternatively, the housing may have a different shape.

In some embodiments, preferably, the sound guiding holes have different heights along the axial direction of the cylindrical sidewall.

In some embodiments, preferably, there are at least two sound guiding holes located in the bottom of the housing. In some embodiments, the sound guiding holes are distributed evenly or unevenly in one or more circles around the center of the bottom. Alternatively or additionally, one sound guiding hole is located at the center of the bottom of the housing.

In some embodiments, preferably, the sound guiding hole is a perforative hole. In some embodiments, there may be a damping layer at the opening of the sound guiding hole.

In some embodiments, preferably, the guided sound waves through different sound guiding holes and/or different portions of a same sound guiding hole have different phases or a same phase.

In some embodiments, preferably, the damping layer is a tuning paper, a tuning cotton, a nonwoven fabric, a silk, a cotton, a sponge, or a rubber.

In some embodiments, preferably, the shape of a sound guiding hole is circle, ellipse, quadrangle, rectangle, or linear. In some embodiments, the sound guiding holes may have a same shape or different shapes.

In some embodiments, preferably, the transducer includes a magnetic component and a voice coil. Alternatively, the transducer includes piezoelectric ceramic.

The design disclosed in this application utilizes the principles of sound interference, by placing sound guiding holes in the housing, to guide sound wave(s) inside the housing to the outside of the housing, the guided sound wave(s) interfering with the leaked sound wave, which is formed when the housing's vibrations push the air outside the housing. The guided sound wave(s) reduces the amplitude of the leaked sound wave and thus reduces the sound leakage. The design not only reduces sound leakage, but is also easy to implement, doesn't increase the volume or weight of the bone conduction speaker, and barely increase the cost of the product.

The meanings of the mark numbers in the figures are as followed:

110, open housing; 121, vibration board; 122, transducer; 123, linking component; 210, first frame; 220, second frame; 230, moving coil; 240, inner magnetic component; 250, outer magnetic component; 260; vibration board; 270, vibration unit; 10, housing; 11, sidewall; 12, bottom; 21, vibration board; 22, transducer; 23, linking component; 24, elastic component; 30, sound guiding hole.

DETAILED DESCRIPTION

Followings are some further detailed illustrations about this disclosure. The following examples are for illustrative purposes only and should not be interpreted as limitations of the claimed invention. There are a variety of alternative techniques and procedures available to those of ordinary skill in the art, which would similarly permit one to successfully perform the intended invention. In addition, the figures just show the structures relative to this disclosure, not the whole structure.

Figure 3:
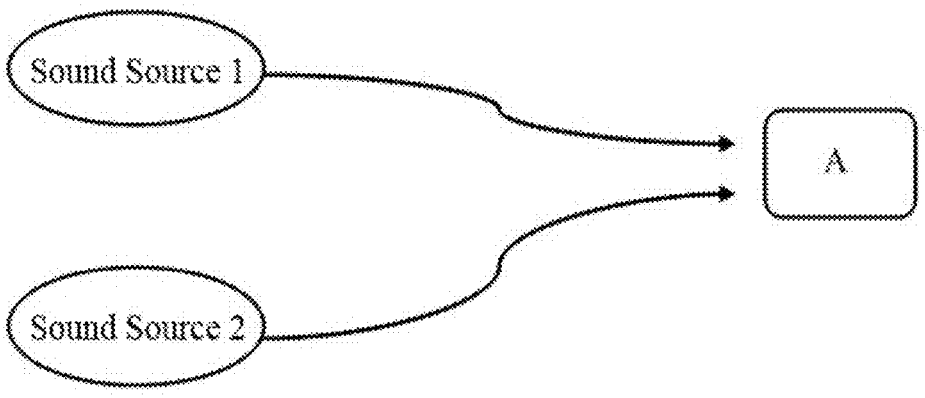
FIG. 3 illustrates the principle of sound interference according to some embodiments of the present disclosure.

To explain the scheme of the embodiments of this disclosure, the design principles of this disclosure will be introduced here. FIG. 3 illustrates the principles of sound interference according to some embodiments of the present disclosure. Two or more sound waves may interfere in the space based on, for example, the frequency and/or amplitude of the waves. Specifically, the amplitudes of the sound waves with the same frequency may be overlaid to generate a strengthened wave or a weakened wave. As shown in FIG. 3, sound source 1 and sound source 2 have the same frequency and locate in different locations in the space. The sound waves generated from these two sound sources may encounter in an arbitrary point A. If the phases of the sound wave 1 and sound wave 2 are the same at point A, the amplitudes of the two sound waves may be added, generating a strengthened sound wave signal at point A; on the other hand, if the phases of the two sound waves are opposite at point A, their amplitudes may be offset, generating a weakened sound wave signal at point A.

This disclosure applies above-noted the principles of sound wave interference to a bone conduction speaker and disclose a bone conduction speaker that can reduce sound leakage.

Embodiment One

Figure 4A:
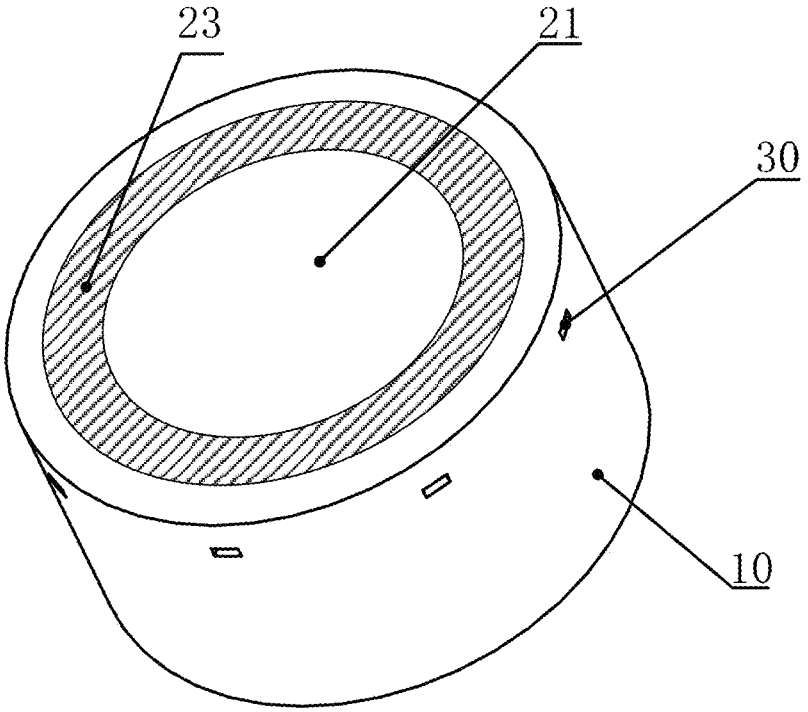
FIGS. 4A and 4B are schematic structures of an exemplary bone conduction speaker according to some embodiments of the present disclosure.
Figure 4B:
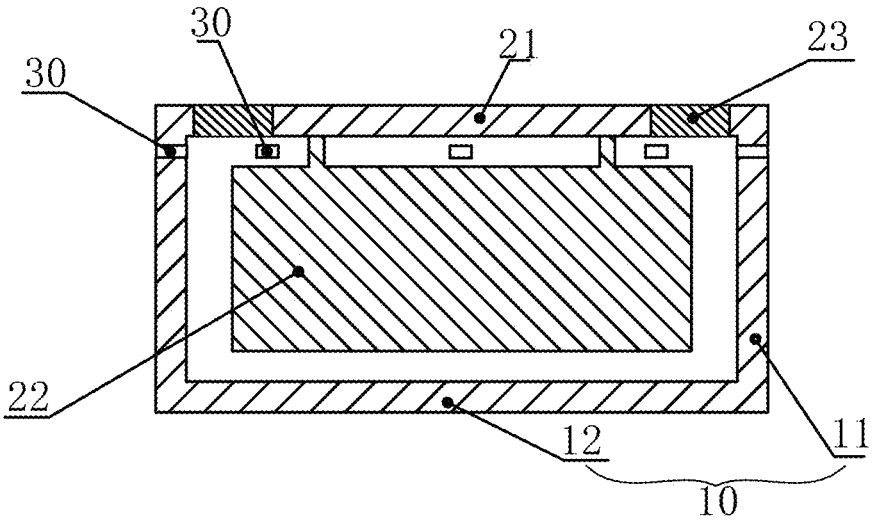

FIGS. 4A and 4B are schematic structures of an exemplary bone conduction speaker. The bone conduction speaker may include a housing 10, a vibration board 21, and a transducer 22. The transducer 22 may be inside the housing 10 and configured to generate vibrations. The housing 10 may have one or more sound guiding holes 30. The sound guiding hole(s) 30 may be configured to guide sound waves inside the housing 10 to the outside of the housing 10. In some embodiments, the guided sound waves may form interference with leaked sound waves generated by the vibrations of the housing 10, so as to reducing the amplitude of the leaked sound. The transducer 22 may be configured to convert an electrical signal to mechanical vibrations. For example, an audio electrical signal may be transmitted into a voice coil that is placed in a magnet, and the electromagnetic interaction may cause the voice coil to vibrate based on the audio electrical signal. As another example, the transducer 22 may include piezoelectric ceramics, shape changes of which may cause vibrations in accordance with electrical signals received.

Furthermore, the vibration board 21 may be connected to the transducer 22 and configured to vibrate along with the transducer 22. The vibration board 21 may stretch out from the opening of the housing 10, and touch the skin of the user and pass vibrations to auditory nerves through human tissues and bones, which in turn enables the user to hear sound. The linking component 23 may reside between the transducer 22 and the housing 10, configured to fix the vibrating transducer 122 inside the housing. The linking component 23 may include one or more separate components, or may be integrated with the transducer 22 or the housing 10. In some embodiments, the linking component 23 is made of an elastic material.

The transducer 22 may drive the vibration board 21 to vibrate. The transducer 22, which resides inside the housing 10, may vibrate. The vibrations of the transducer 22 may drives the air inside the housing 10 to vibrate, producing a sound wave inside the housing 10, which can be referred to as "sound wave inside the housing," Since the vibration board 21 and the transducer 22 are fixed to the housing 10 via the linking component 23, the vibrations may pass to the housing 10, causing the housing 10 to vibrate synchronously. The vibrations of the housing 10 may generate a leaked sound wave, which spreads outwards as sound leakage.

The sound wave inside the housing and the leaked sound wave are like the two sound sources in FIG. 3. In some embodiments, the sidewall 11 of the housing 10 may have one or more sound guiding holes 30 configured to guide the sound wave inside the housing 10 to the outside. The guided sound wave through the sound guiding hole(s) 30 may interfere with the leaked sound wave generated by the vibrations of the housing 10, and the amplitude of the leaked sound wave may be reduced due to the interference, which may result in a reduced sound leakage. Therefore, the design of this embodiment can solve the sound leakage problem to some extent by making an improvement of setting a sound guiding hole on the housing, and not increasing the volume and weight of the bone conduction speaker.

In some embodiments, one sound guiding hole 30 is set on the upper portion of the sidewall 11. As used herein, the upper portion of the sidewall 11 refers to the portion of the sidewall 11 starting from the top of the sidewall (contacting with the vibration board 21) to about the ⅓ height of the sidewall.

Figure 4C:
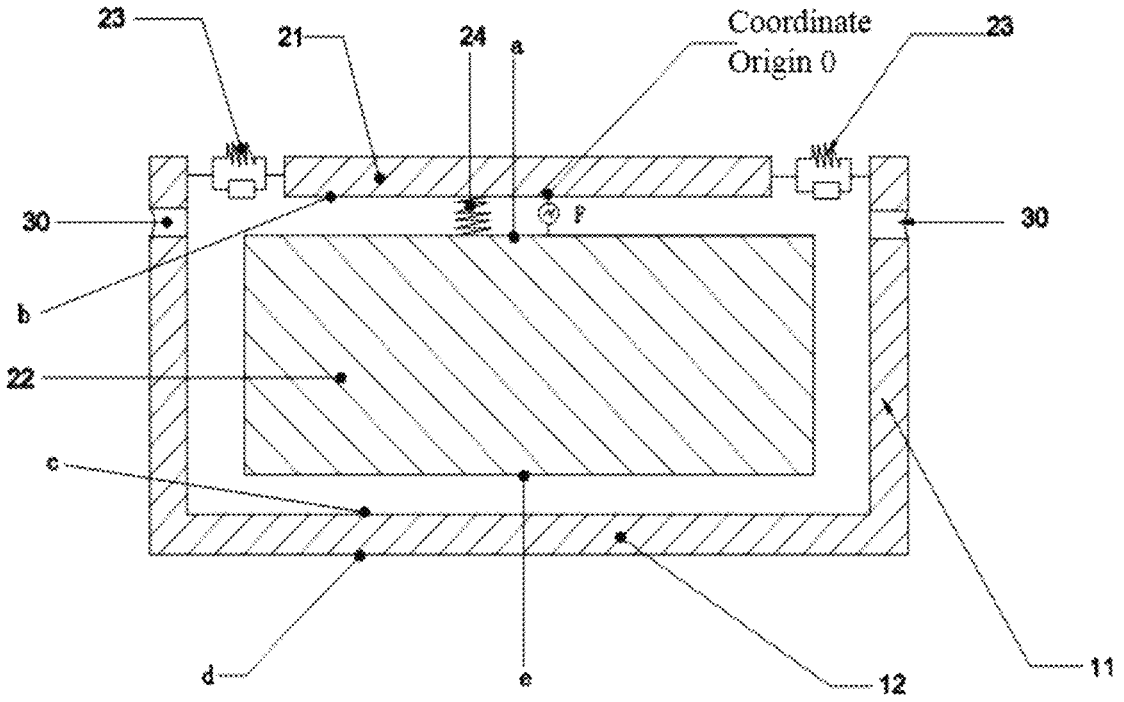
FIG. 4C is a schematic structure of the bone conduction speaker according to some embodiments of the present disclosure.

FIG. 4C is a schematic structure of the bone conduction speaker illustrated in FIGS. 4A-4B. The structure of the bone conduction speaker is further illustrated with mechanics elements illustrated in FIG. 4C. As shown in FIG. 4C, the linking component 23 between the sidewall 11 of the housing 10 and the vibration board 21 may be represented by an elastic element 23 and a damping element in the parallel connection. The linking relationship between the vibration board 21 and the transducer 22 may be represented by an elastic element 24.

Outside the housing 10, the sound leakage reduction is proportional to $$(\iint_{S_{hole}} P ds - \iint_{S_{housing}} P_d ds), \tag{1}$$

wherein $S_{hole}$ is the area of the opening of the sound guiding hole 30, $S_{housing}$ is the area of the housing 10 (e.g., the sidewall 11 and the bottom 12) that is not in contact with human face.

The pressure inside the housing may be expressed as $$P = P_a + P_b + P_c + P_e, \tag{2}$$

wherein $P_a$, $P_b$, $P_c$ and $P_e$ are the sound pressures of an arbitrary point inside the housing 10 generated by side a, side b, side c and side e (as illustrated in FIG. 4C), respectively. As used herein, side a refers to the upper surface of the transducer 22 that is close to the vibration board 21, side b refers to the lower surface of the vibration board 21 that is close to the transducer 22, side c refers to the inner upper surface of the bottom 12 that is close to the transducer 22, and side e refers to the lower surface of the transducer 22 that is close to the bottom 12.

The center of the side b, O point, is set as the origin of the space coordinates, and the side b can be set as the z=0 plane, so $P_a$, $P_b$, $P_c$ and $P_e$ may be expressed as follows:

$$P_a(x, y, z) = -j\omega\rho_0 \iint_{S_a} W_a(x'_a, y'_a) \cdot \frac{e^{jkR(x'_a, y'_a)}}{4\pi R(x'_a, y'_a)} dx'_a dy'_a - P_{aR}, \tag{3}$$

$$P_b(x, y, z) = -j\omega\rho_0 \iint_{S_b} W_b(x', y') \cdot \frac{e^{jkR(x', y')}}{4\pi R(x', y')} dx' dy' - P_{bR}, \tag{4}$$

$$P_c(x, y, z) = -j\omega\rho_0 \iint_{S_c} W_c(x'_c, y'_c) \cdot \frac{e^{jkR(x'_c, y'_c)}}{4\pi R(x'_c, y'_c)} dx'_c dy'_c - P_{cR}, \tag{5}$$

$$P_e(x, y, z) = -j\omega\rho_0 \iint_{S_e} W_e(x'_e, y'_e) \cdot \frac{e^{jkR(x'_e, y'_e)}}{4\pi R(x'_e, y'_e)} dx'_e dy'_e - P_{eR}, \tag{6}$$

wherein $R(x', y') = \sqrt{(x-x')^2 + (y-y')^2 + z^2}$ is the distance between an observation point (x, y, z) and a point on side b (x', y', 0); $S_a$, $S_b$, $S_c$, and $S_e$ are the areas of side a side b, side c and side e, respectively;

$R(x_a', y_a') = \sqrt{(x-x_a')^2 + (y-y_a')^2}$ is the distance between the observation point (x, y, z) and a point on side a ($x_a \propto$, $y_a'$, $z_a$);

$R(x_c', y_c') = \sqrt{(x-x_c')^2 + (y-y_c')^2 + (z-z_a)^2}$ is the distance between the observation point (x, y, z) and a point on side c ($x_c'$, $y_c'$, $z_c'$);

$R(x_e', y_e') = \sqrt{(x-x_e')^2 + (y-y_e')^2 + (z-z_e)^2}$ is the distance between the observation point (x, y, z) and a point on side e ($x_e'$, $y_e'$, $z_e$);

k=ω/u(u is the velocity of sound) is wave number, $\rho_0$ is an air density, ω is an angular frequency of vibration, $P_{aR}$, $P_{bR}$, $P_{cR}$ and $P_{eR}$ are acoustic resistances of air, which respectively are:

$$P_{aR} = A \cdot \frac{z_a \cdot r + j\omega \cdot z_a \cdot r'}{\varphi} + \delta, \tag{7}$$

$$P_{bR} = A \cdot \frac{z_b \cdot r + j\omega \cdot z_b \cdot r'}{\varphi} + \delta, \tag{8}$$

$$P_{cR} = A \cdot \frac{z_c \cdot r + j\omega \cdot z_c \cdot r'}{\varphi} + \delta, \tag{9}$$

$$P_{eR} = A \cdot \frac{z_e \cdot r + j\omega \cdot z_e \cdot r'}{\varphi} + \delta, \tag{10}$$

wherein r is the acoustic resistance per unit length, r' is the sound quality per unit length, $z_a$ is the distance between the observation point and side a, $z_b$ is the distance between the observation point and side h, $z_c$ is the distance between the observation point and side c, $z_e$ is the distance between the observation point and side e.

$W_a(x, y)$, $W_b(x, y)$, $W_c(x, y)$, $W_e(x, y)$ and $W_d(x, y)$ are the sound source power per unit area of side a, side b, side c, side e and side d, respectively, which can be derived from following formulas (11):

$$F_e = F_a = F - k_1 \cos \omega t - \iint_{S_a} W_a(x,y) dxdy - \iint_{S_e} W_e(x,y) dxdy - f$$

$$F_b=-F+k_1\cos\omega t-\iint_{S_b}W_b(x,y)dxdy-\iint_{S_e}W_e(x,y)dxdy-L$$

$$F_c=F_d=F_b-k_2\cos\omega t-\iint_{S_c}W_c(x,y)dxdy-f-\gamma$$

$$F_d=F_b-F-k_2\cos\omega t-\iint_{S_d}W_d(x,y)dxdy \quad (11)$$

wherein F is the driving force generated by the transducer 22, $F_a$, $F_b$, $F_c$, $F_d$, and $F_e$ are the driving forces of side a, side b, side c, side d and side e, respectively. As used herein, side d is the outside surface of the bottom 12. $S_d$ is the region of sided, f is the viscous resistance formed in the small gap of the sidewalls, and $f=\eta\Delta s(dv/dy)$.

L is the equivalent load on human face when the vibration board acts on the human face, $\gamma$ is the energy dissipated on elastic element 24, $k_1$ and $k_2$ are the elastic coefficients of elastic element 23 and elastic element 24 respectively, $\eta$ is the fluid viscosity coefficient, dv/dy is the velocity gradient of fluid, $\Delta s$ is the cross-section area of a subject (board), A is the amplitude, $\varphi$ is the region of the sound field, and $\delta$ is a high order minimum (which is generated by the incompletely symmetrical shape of the housing).

The sound pressure of an arbitrary point outside the housing, generated by the vibration of the housing 10 is expressed as:

$$P_d=-j\omega\rho_0\int\int W_d(x_d',y_d')\cdot\frac{e^{jkR(x_d',y_d')}}{4\pi R(x_d',y_d')}dx_d'dy_d', \quad (12)$$

wherein $R(x_d', y_d')=\sqrt{(x-x_d')^2+(y-y_d')^2+(z-z_d)^2}$ is the distance between the observation point (x, y, z) and a point on side d ($x_d'$, $y_d'$, $z_d$).

$P_a$, $P_b$, $P_c$, and $P_e$ are functions of the position, when we set a hole on an arbitrary position in the housing, if the area of the hole is $S_{hole}$, the sound pressure of the hole is $\iint_{S_{hole}}$ Pds.

In the meanwhile, because the vibration board 21 fits human tissues tightly, the power it gives out is absorbed all by human tissues, so the only side that can push air outside the housing to vibrate is side d, thus forming sound leakage. As described elsewhere, the sound leakage is resulted from the vibrations of the housing 10. For illustrative purposes, the sound pressure generated by the housing 10 may be expressed as $\iint_{S_{showing}}P_d ds$.

The leaked sound wave and the guided sound wave interference may result in a weakened sound wave, i.e., to make $\iint_{S_{hole}}$Pds and $\iint_{S_{housing}}P_d ds$ have the same value but opposite directions, and the sound leakage may be reduced. In some embodiments, $\iint_{S_{hole}}$Pds may be adjusted to reduce the sound leakage. Since Pds corresponds to information of phases and amplitudes of one or more holes, which further relates to dimensions of the housing of the bone conduction speaker, the vibration frequency of the transducer, the position, shape, quantity and/or size of the sound guiding holes and whether there is damping inside the holes. Thus, the position, shape, and quantity of sound guiding holes, and/or damping materials may be adjusted to reduce sound leakage.

According to the formulas above, a person having ordinary skill in the art would understand that the effectiveness of reducing sound leakage is related to the dimensions of the housing of the bone conduction speaker, the vibration frequency of the transducer, the position, shape, quantity and size of the sound guiding hole(s) and whether there is damping inside the sound guiding hole(s). Accordingly, various configurations, depending on specific needs, may be obtained by choosing specific position where the sound guiding hole(s) is located, the shape and/or quantity of the sound guiding hole(s) as well as the damping material.

Figure 5:
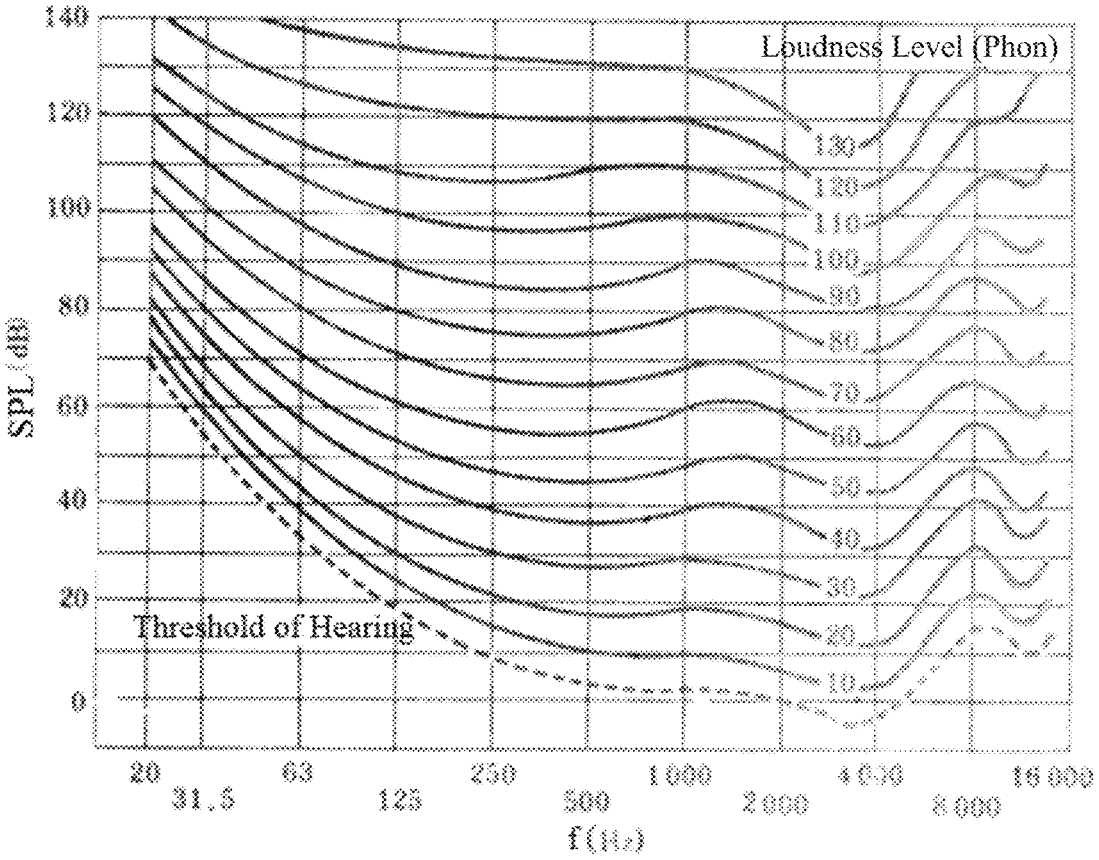
FIG. 5 is a diagram illustrating the equal-loudness contour curves according to some embodiments of the present disclosure.

FIG. 5 is a diagram illustrating the equal-loudness contour curves according to some embodiments of the present disclose. The horizontal coordinate is frequency, while the vertical coordinate is sound pressure level (SPL). As used herein, the SPL refers to the change of atmospheric pressure after being disturbed, i.e., a surplus pressure of the atmospheric pressure, which is equivalent to an atmospheric pressure added to a pressure change caused by the disturbance. As a result, the sound pressure may reflect the amplitude of a sound wave. In FIG. 5, on each curve, sound pressure levels corresponding to different frequencies are different, while the loudness levels felt by human ears are the same. For example, each curve is labeled with a number representing the loudness level of said curve. According to the loudness level curves, when volume (sound pressure amplitude) is lower, human ears are not sensitive to sounds of high or low frequencies when volume is higher, human ears are more sensitive to sounds of high or low frequencies. Bone conduction speakers may generate sound relating to different frequency ranges, such as 1.000 Hz~4000 Hz, or 1000 Hz~4000 Hz, or 1000 Hz~3500 Hz; or 1000 Hz~3000 Hz, or 1500 Hz~30001 Hz. The sound leakage within the above-mentioned frequency ranges may be the sound leakage aimed to be reduced with a priority.

Figure 4D:
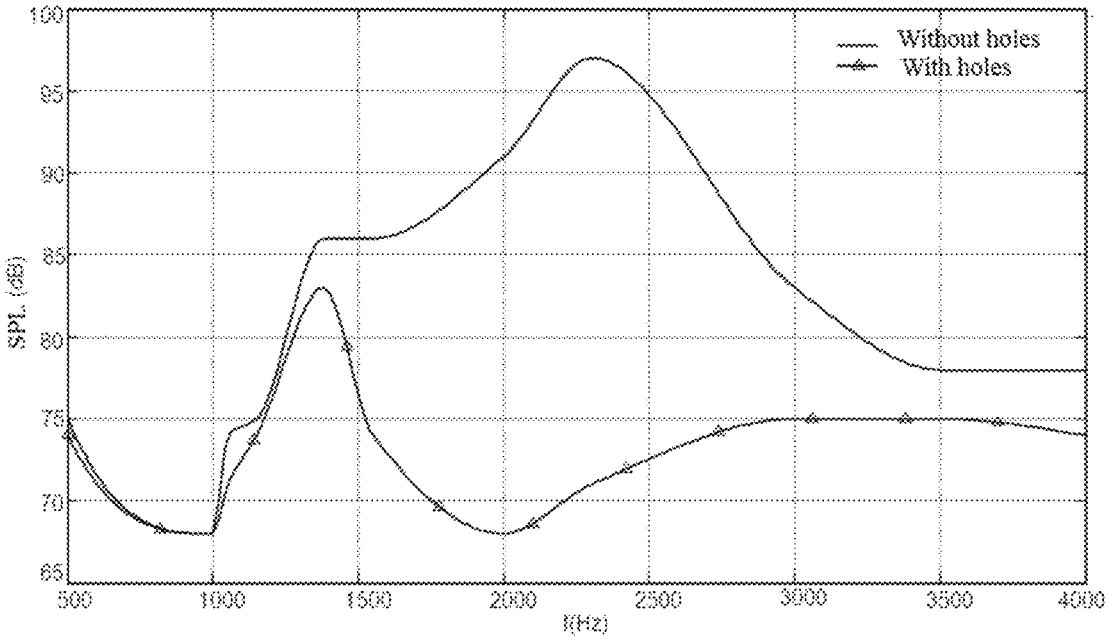
FIG. 4D is a diagram illustrating reduced sound leakage of the bone conduction speaker according to some embodiments of the present disclosure.

FIG. 4D is a diagram illustrating the effect of reduced sound leakage according to some embodiments of the present disclosure, wherein the test results and calculation results are close in the above range. The bone conduction speaker being tested includes a cylindrical housing, which includes a sidewall and a bottom, as described in FIGS. 4A and 4B. The cylindrical housing is in a cylinder shape having a radius of 22 mm, the sidewall height of 14 mm, and a plurality of sound guiding holes being set on the upper portion of the sidewall of the housing. The openings of the sound guiding holes are rectangle. The sound guiding holes are arranged evenly on the sidewall. The target region where the sound leakage is to be reduced is 50 cm away from the outside of the bottom of the housing. The distance of the leaked sound wave spreading to the target region and the distance of the sound wave spreading from the surface of the transducer 20 through the sound guiding holes 30 to the target region have a difference of about 180 degrees in phase. As shown, the leaked sound wave is reduced in the target region dramatically or even be eliminated.

According to the embodiments in this disclosure, the effectiveness of reducing sound leakage after setting sound guiding holes is very obvious. As shown in FIG. 4D, the bone conduction speaker having sound guiding holes greatly reduce the sound leakage compared to the bone conduction speaker without sound guiding holes.

In the tested frequency range, after setting sound guiding holes, the sound leakage is reduced by about 10 dB on average. Specifically, in the frequency range of 1500 Hz~3000 Hz, the sound leakage is reduced by over 1.0 dB. In the frequency range of 2000 Hz~2500 Hz, the sound leakage is reduced by over 20 dB compared to the scheme without sound guiding holes.

A person having ordinary skill in the art can understand from the above-mentioned formulas that when the dimensions of the bone conduction speaker, target regions to reduce sound leakage and frequencies of sound waves differ, the position, shape and quantity of sound guiding holes also need to adjust accordingly.

For example, in a cylinder housing, according to different needs, a plurality of sound guiding holes may be on the sidewall and/or the bottom of the housing. Preferably, the sound guiding hole may be set on the upper portion and/or lower portion of the sidewall of the housing. The quantity of the sound guiding holes set on the sidewall of the housing is no less than two. Preferably, the sound guiding holes may be arranged evenly or unevenly in one or more circles with respect to the center of the bottom. In some embodiments, the sound guiding holes may be arranged in at least one circle. In some embodiments, one sound guiding hole may be set on the bottom of the housing. In some embodiments, the sound guiding hole may be set at the center of the bottom of the housing.

The quantity of the sound guiding holes can be one or more. Preferably, multiple sound. guiding holes may be set symmetrically on the housing. In some embodiments, there are 6-8 circularly arranged sound guiding holes.

The openings (and cross sections) of sound guiding holes may be circle, ellipse, rectangle, or slit. Slit generally means slit along with straight lines, curve lines, or arc lines. Different sound guiding holes in one bone conduction speaker may have same or different shapes.

A person having ordinary skill in the art can understand that, the sidewall of the housing may not be cylindrical, the sound guiding holes can be arranged asymmetrically as needed. Various configurations may be obtained by setting different combinations of the shape, quantity, and position of the sound guiding. Some other embodiments along with the figures are described as follows.

In some embodiments, the leaked sound wave may be generated by a portion of the housing 10. The portion of the housing may be the sidewall 11 of the housing 10 and/or the bottom 12 of the housing 10. Merely by way of example, the leaked sound wave may be generated by the bottom 12 of the housing 10. The guided sound wave output through the sound guiding hole(s) 30 may interfere with the leaked sound wave generated by the portion of the housing 10. The interference may enhance or reduce a sound pressure level of the guided sound wave and/or leaked sound wave in the target region.

In some embodiments, the portion of the housing 10 that generates the leaked sound wave may be regarded as a first sound source (e.g., the sound source 1 illustrated in FIG. 3), and the sound guiding hole(s) 30 or a part thereof may be regarded as a second sound source (e.g., the sound source 2 illustrated in FIG. 3). Merely for illustration purposes, if the size of the sound guiding hole on the housing 10 is small, the sound guiding hole may be approximately regarded as a point sound source. In some embodiments, any number or count of sound guiding holes provided on the housing 10 for outputting sound may be approximated as a single point sound source. Similarly, for simplicity, the portion of the housing 10 that generates the leaked sound wave may also be approximately regarded as a point sound source. In some embodiments, both the first sound source and the second sound source may approximately be regarded as point sound sources (also referred to as two-point sound sources).

Figure 4E:
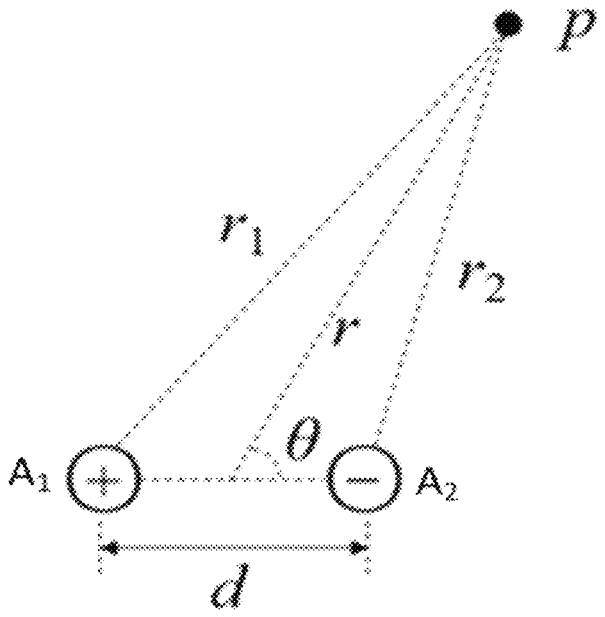
FIG. 4F, is a schematic diagram illustrating exemplary two-point sound sources according to some embodiments of the present disclosure.

FIG. 4E is a schematic diagram illustrating exemplary two-point sound sources according to some embodiments of the present disclosure. The sound field pressure p generated by a single point sound source may satisfy Equation (13):

$$p = \frac{j\omega\rho_0}{4\pi r} Q_0 \exp j(\omega t - kr), \tag{13}$$

where $\omega$ denotes an angular frequency, $\rho_0$ denotes an air density, r denotes a distance between a target point and the sound source, $Q_0$ denotes a volume velocity of the sound source, and k denotes a wave number. It may be concluded that the magnitude of the sound field pressure of the sound field of the point sound source is inversely proportional to the distance to the point sound source.

It should be noted that, the sound guiding hole(s) for outputting sound as a point sound source may only serve as an explanation of the principle and effect of the present disclosure, and the shape and/or size of the sound guiding hole(s) may not be limited in practical applications. In some embodiments, if the area of the sound guiding hole is large, the sound guiding hole may also be equivalent to a planar sound source. Similarly, if an area of the portion of the housing 10 that generates the leaked sound wave is large (e.g., the portion of the housing 10 is a vibration surface or a sound radiation surface), the portion of the housing 10 may also be equivalent to a planar sound source. For those skilled in the art, without creative activities, it may be known that sounds generated by structures such as sound guiding holes, vibration surfaces, and sound radiation surfaces may be equivalent to point sound sources at the spatial scale discussed in the present disclosure, and may have consistent sound propagation characteristics and the same mathematical description method. Further, for those skilled in the art, without creative activities, it may be known that the acoustic effect achieved by the two-point sound sources may also be implemented by alternative acoustic structures. According to actual situations, the alternative acoustic structures may be modified and/or combined discretionarily, and the same acoustic output effect may be achieved.

The two-point sound sources may be formed such that the guided sound wave output from the sound guiding hole(s) may interfere with the leaked sound wave generated by the portion of the housing 10. The interference may reduce a sound pressure level of the leaked sound wave in the surrounding environment (e.g., the target region). For convenience, the sound waves output from an acoustic output device (e.g., the bone conduction speaker) to the surrounding environment may be referred to as far-field leakage since it may be heard by others in the environment. The sound waves output from the acoustic output device to the ears of the user may also be referred to as near-field sound since a distance between the bone conduction speaker and the user may be relatively short. In some embodiments, the sound waves output from the two-point sound sources may have a same frequency or frequency range (e.g., 800 Hz, 1000 Hz, 1500 Hz, 3000 Hz, etc.). In some embodiments, the sound waves output from the two-point sound sources may have a certain phase difference. In some embodiments, the sound guiding hole includes a damping layer. The damping layer may be, for example, a tuning paper, a tuning cotton, a nonwoven fabric, a silk, a cotton, a sponge, or a rubber. The damping layer may be configured to adjust the phase of the guided sound wave in the target region. The acoustic output device described herein may include a bone conduction speaker or an air conduction speaker. For example, a portion of the housing (e.g., the bottom of the housing) of the bone conduction speaker may be treated as one of the two-point sound sources, and at least one sound guiding holes of the bone conduction speaker may be treated as the other one of the two-point sound sources. As another example, one sound guiding hole of an air conduction speaker may be treated as one of the two-point sound sources, and another sound guiding hole of the air conduction speaker may be treated as the other one of the two-point sound sources. It should be noted that, although the construction of two-point sound sources may be different in bone conduction speaker and air conduction speaker, the principles of the interference between the various constructed two-point sound sources are the same. Thus, the equivalence of the two-point sound sources in a bone conduction speaker disclosed elsewhere in the present disclosure is also applicable for an air conduction speaker.

In some embodiments, when the position and phase difference of the two-point sound sources meet certain conditions, the acoustic output device may output different sound effects in the near field (for example, the position of the user's ear) and the far field. For example, if the phases of the point sound sources corresponding to the portion of the housing 10 and the sound guiding hole(s) are opposite, that is, an absolute value of the phase difference between the two-point sound sources is 180 degrees, the far-field leakage may be reduced according to the principle of reversed phase cancellation.

In some embodiments, the interference between the guided sound wave and the leaked sound wave at a specific frequency may relate to a distance between the sound guiding hole(s) and the portion of the housing 10. For example, if the sound guiding hole(s) are set at the upper portion of the sidewall of the housing 10 (as illustrated in FIG. 4A), the distance between the sound guiding hole(s) and the portion of the housing 10 may be large. Correspondingly, the frequencies of sound waves generated by such two-point sound sources may be in a mid-low frequency range (e.g., 1500-2000 Hz, 1500-2500 Hz, etc.). Referring to FIG. 4D, the interference may reduce the sound pressure level of the leaked sound wave in the mid-low frequency range (i.e., the sound leakage is low).

Merely by way of example, the low frequency range may refer to frequencies in a range below a first frequency threshold. The high frequency range may refer to frequencies in a range exceed a second frequency threshold. The first frequency threshold may be lower than the second frequency threshold. The mid-low frequency range may refer to frequencies in a range between the first frequency threshold and the second frequency threshold. For example, the first frequency threshold may be 1000 Hz, and the second frequency threshold may be 3000 Hz. The low frequency range may refer to frequencies in a range below 1000 Hz, the high frequency range may refer to frequencies in a range above 3000 Hz, and the mid-low frequency range may refer to frequencies in a range of 1000-2000 Hz, 1500-2500 Hz, etc. In some embodiments, a middle frequency range, a mid-high frequency range may also be determined between the first frequency threshold and the second frequency threshold. In some embodiments, the mid-low frequency range and the low frequency range may partially overlap. The mid-high frequency range and the high frequency range may partially overlap. For example, the mid-high frequency range may refer to frequencies in a range above 3000 Hz, and the mid-low frequency range may refer to frequencies in a range of 2800-3500 Hz. It should be noted that the low frequency range, the mid-low frequency range, the middle frequency range, the mid-high frequency range, and/or the high frequency range may be set flexibly according to different situations, and are not limited herein.

In some embodiments, the frequencies of the guided sound wave and the leaked sound wave may be set in a low frequency range (e.g., below 800 Hz, below 1200 Hz, etc.). In some embodiments, the amplitudes of the sound waves generated by the two-point sound sources may be set to be different in the low frequency range. For example, the amplitude of the guided sound wave may be smaller than the amplitude of the leaked sound wave. In this case, the interference may not reduce sound pressure of the near-field sound in the low-frequency range. The sound pressure of the near-field sound may be improved in the low-frequency range. The volume of the sound heard by the user may be improved.

In some embodiments, the amplitude of the guided sound wave may be adjusted by setting an acoustic resistance structure in the sound guiding hole(s) 30. The material of the acoustic resistance structure disposed in the sound guiding hole 30 may include, but not limited to, plastics (e.g., high-molecular polyethylene, blown nylon, engineering plastics, etc.), cotton, nylon, fiber (e.g., glass fiber, carbon fiber, boron fiber, graphite fiber, graphene fiber, silicon carbide fiber, or aramid fiber), other single or composite materials, other organic and/or inorganic materials, etc. The thickness of the acoustic resistance structure may be 0.005 mm, 0.01 mm, 0.02 mm, 0.5 mm, 1 mm, 2 mm, etc. The structure of the acoustic resistance structure may be in a shape adapted to the shape of the sound guiding hole. For example, the acoustic resistance structure may have a shape of a cylinder, a sphere, a cubic, etc. In some embodiments, the materials, thickness, and structures of the acoustic resistance structure may be modified and/or combined to obtain a desirable acoustic resistance structure. In some embodiments, the acoustic resistance structure may be implemented by the damping layer.

In some embodiments, the amplitude of the guided sound wave output from the sound guiding hole may be relatively low (e.g., zero or almost zero). The difference between the guided sound wave and the leaked sound wave may be maximized, thus achieving a relatively large sound pressure in the near field. In this case, the sound leakage of the acoustic output device having sound guiding holes may be almost the same as the sound leakage of the acoustic output device without sound guiding holes in the low frequency range (e.g., as shown in FIG. 4D).

Embodiment Two

Figure 6:
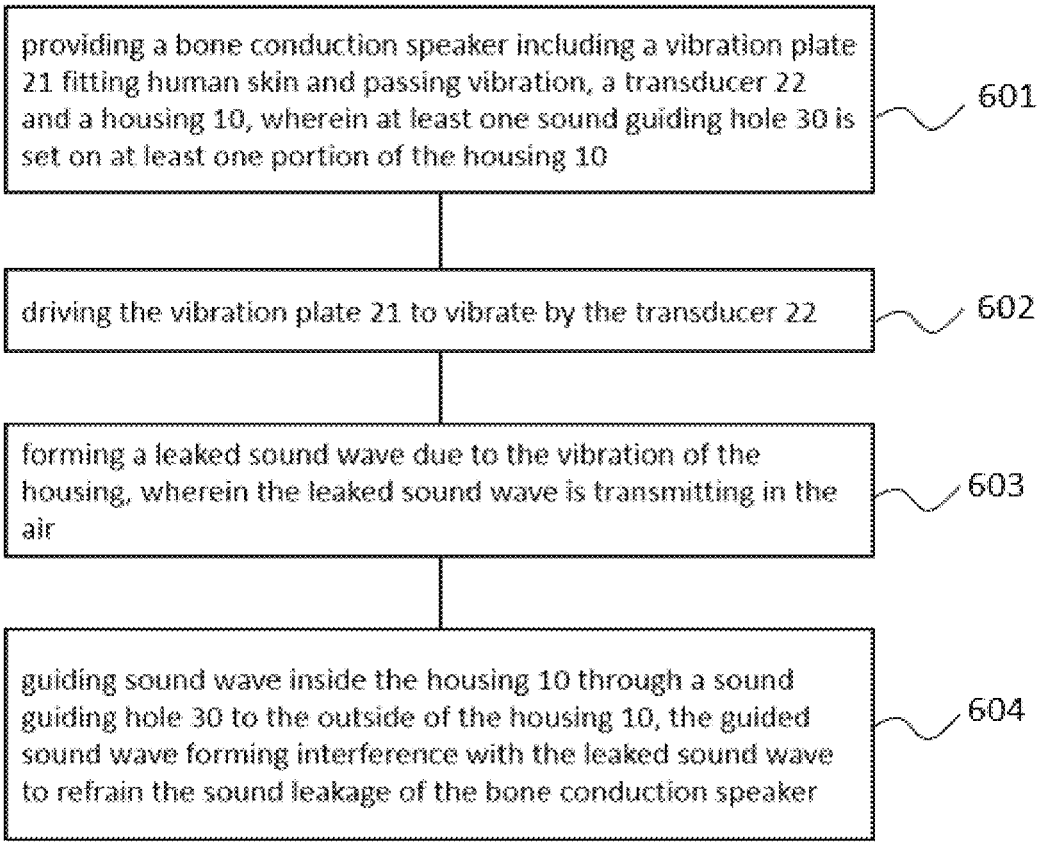
FIG. 6 is a flow chart of an exemplary method of reducing sound leakage of a bone conduction speaker according to some embodiments of the present disclosure.

FIG. 6 is a flowchart of an exemplary method of reducing sound leakage of a bone conduction speaker according to some embodiments of the present disclosure. At 601, a bone conduction speaker including a vibration plate 21 touching human skin and passing vibrations, a transducer 22, and a housing 10 is provided. At least one sound guiding hole 30 is arranged on the housing 10. At 602, the vibration plate 21 is driven by the transducer 22, causing the vibration 21 to vibrate. At 603, a leaked sound wave due to the vibrations of the housing is formed, wherein the leaked sound wave transmits in the air. At 604, a guided sound wave passing through the at least one sound guiding hole 30 from the inside to the outside of the housing 10. The guided sound wave interferes with the leaked sound wave, reducing the sound leakage of the bone conduction speaker.

The sound guiding holes 30 are preferably set at different positions of the housing 10.

The effectiveness of reducing sound leakage may be determined by the formulas and method as described above, based on which the positions of sound guiding holes may be determined.

A damping layer is preferably set in a sound guiding hole 30 to adjust the phase and amplitude of the sound wave transmitted through the sound guiding hole 30.

In some embodiments, different sound guiding holes may generate different sound waves having a same phase to reduce the leaked sound wave having the same wavelength. In some embodiments, different sound guiding holes may generate different sound waves having different phases to reduce the leaked sound waves having different wavelengths.

In some embodiments, different portions of a sound guiding hole 30 may be configured to generate sound waves having a same phase to reduce the leaked sound waves with the same wavelength. In some embodiments, different portions of a sound guiding hole 30 may be configured to generate sound waves having different phases to reduce the leaked sound waves with different wavelengths.

Additionally, the sound wave inside the housing may be processed to basically have the same value but opposite phases with the leaked sound wave, so that the sound leakage may be further reduced.

Embodiment Three

Figure 7A:
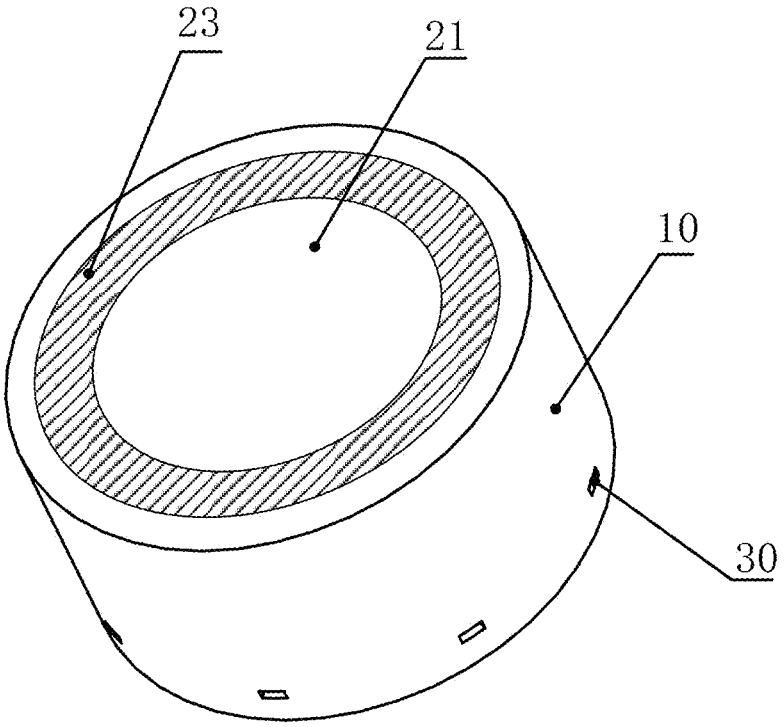
FIGS. 7A and 7B are schematic structures of an exemplary bone conduction speaker according to some embodiments of the present disclosure.
Figure 7B:
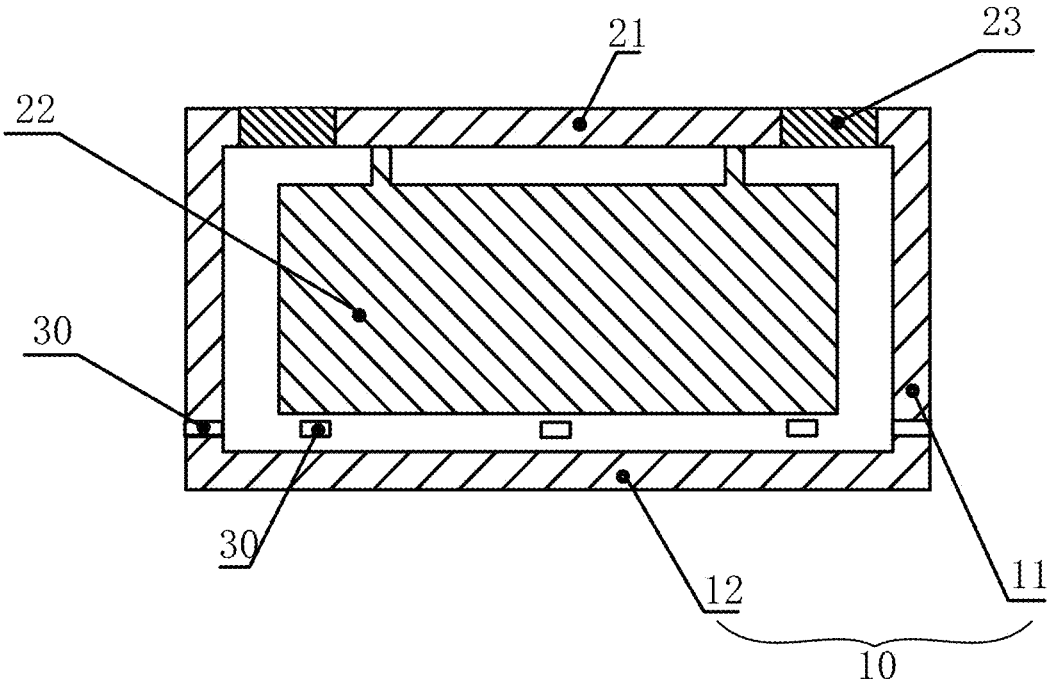

FIGS. 7A and 7B are schematic structures illustrating an exemplary bone conduction speaker according to some embodiments of the present disclosure. The bone conduction speaker may include an open housing 10, a vibration board 21, and a transducer 22. The housing 10 may cylindrical and have a sidewall and a bottom. A plurality of sound guiding holes 30 may be arranged on the lower portion of the sidewall (i.e., from about the ⅔ height of the sidewall to the bottom). The quantity of the sound guiding holes 30 may be 8, the openings of the sound guiding holes 30 may be rectangle. The sound guiding holes 30 may be arranged evenly or evenly in one or more circles on the sidewall of the housing 10.

In the embodiment, the transducer 22 is preferably implemented based on the principle of electromagnetic transduction. The transducer may include components such as magnetizer, voice coil, and etc., and the components may locate inside the housing and may generate synchronous vibrations with a same frequency.

Figure 7C:
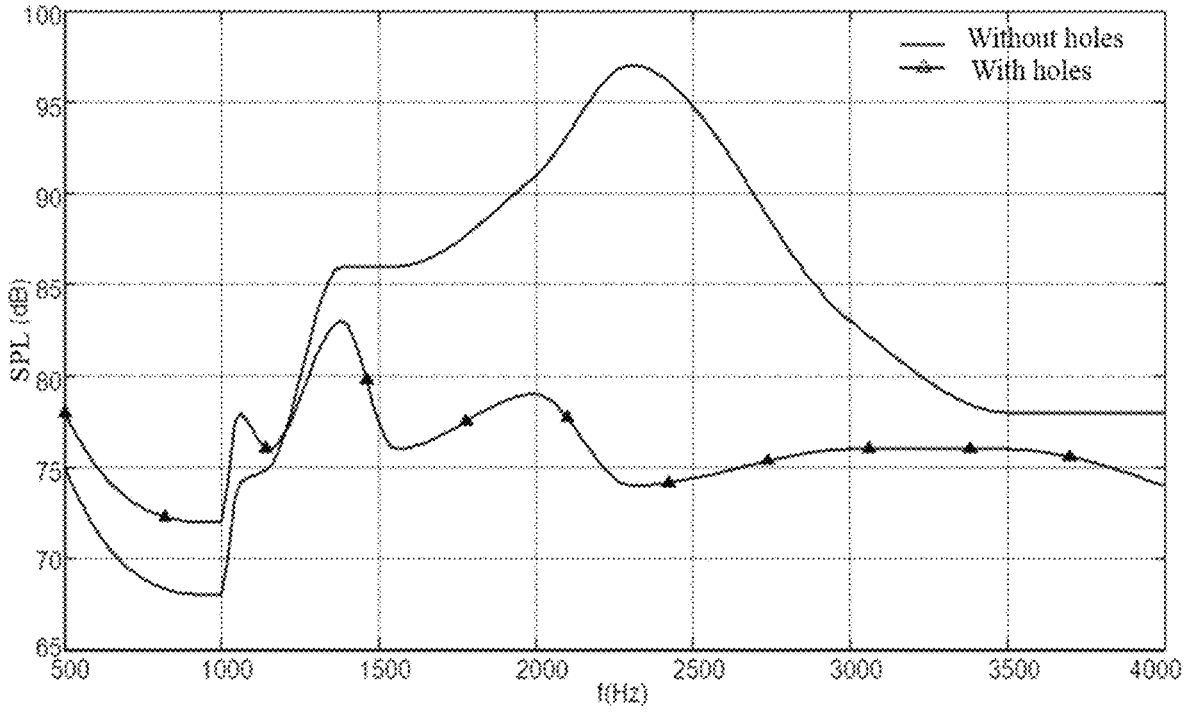
FIG. 7C is a diagram illustrating reduced sound leakage of a bone conduction speaker according to some embodiments of the present disclosure.

FIG. 7C is a diagram illustrating reduced sound leakage according to some embodiments of the present disclosure. In the frequency range of 1400 Hz~4000 Hz, the sound leakage is reduced by more than 5 dB, and in the frequency range of 2250 Hz~2500 Hz, the sound leakage is reduced by more than 20 dB.

In some embodiments, the sound guiding hole(s) at the lower portion of the sidewall of the housing 10 may also be approximately regarded as a point sound source. In some embodiments, the sound guiding hole(s) at the lower portion of the sidewall of the housing 10 and the portion of the housing 10 that generates the leaked sound wave may constitute two-point sound sources. The two-point sound sources may be formed such that the guided sound wave output from the sound guiding hole(s) at the lower portion of the sidewall of the housing 10 may interfere with the leaked sound wave generated by the portion of the housing 10. The interference may reduce a sound pressure level of the leaked sound wave in the surrounding environment (e.g., the target region) at a specific frequency or frequency range.

In some embodiments, the sound waves output from the two-point sound sources may have a same frequency or frequency range (e.g., 1000 Hz, 2500 Hz, 3000 Hz, etc.). In some embodiments, the sound waves output from the first two-point sound sources may have a certain phase difference. In this case, the interference between the sound waves generated by the first two-point sound sources may reduce a sound pressure level of the leaked sound wave in the target region. When the position and phase difference of the first two-point sound sources meet certain conditions, the acoustic output device may output different sound effects in the near field (for example, the position of the user's ear) and the far field. For example, if the phases of the first two-point sound sources are opposite, that is, an absolute value of the phase difference between the first two-point sound sources is 180 degrees, the far-field leakage may be reduced.

In some embodiments, the interference between the guided sound wave and the leaked sound wave may relate to frequencies of the guided sound wave and the leaked sound wave and/or a distance between the sound guiding hole(s) and the portion of the housing 10. For example, if the sound guiding hole(s) are set at the lower portion of the sidewall of the housing 10 (as illustrated in FIG. 7A), the distance between the sound guiding hole(s) and the portion of the housing 10 may be small. Correspondingly, the frequencies of sound waves generated by such two-point sound sources may be in a high frequency range (e.g., above 3000 Hz, above 3500 Hz, etc.). Referring to FIG. 7C, the interference may reduce the sound pressure level of the leaked sound wave in the high frequency range.

Embodiment Four

Figure 8A:
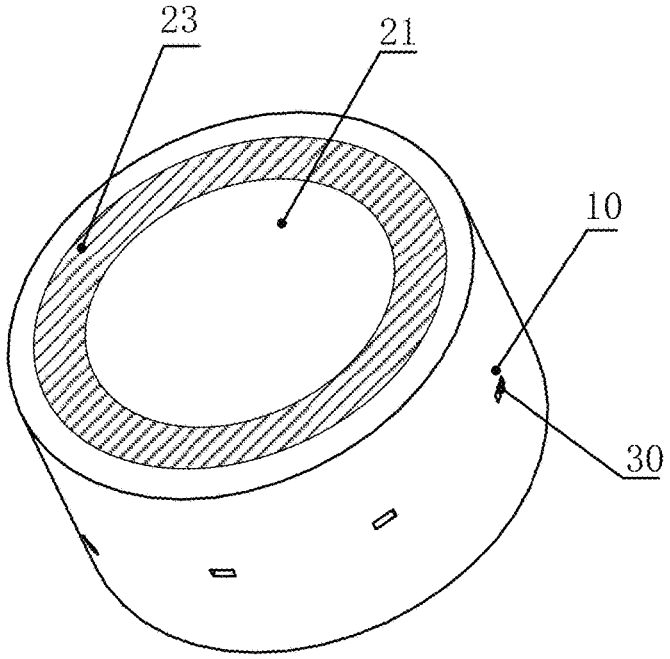
FIGS. 8A and 8B are schematic structure of an exemplary bone conduction speaker according to some embodiments of the present disclosure.
Figure 8B:
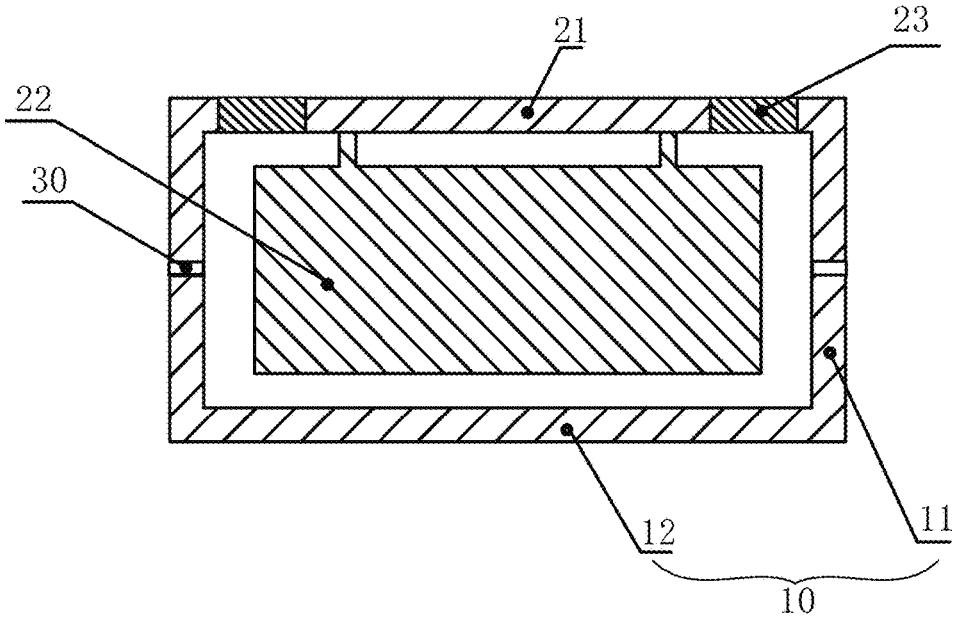

FIGS. 5A and 8B are schematic structures illustrating an exemplary bone conduction speaker according to some embodiments of the present disclosure. The bone conduction speaker may include an open housing 10, a vibration board 21, and a transducer 22. The housing 10 is cylindrical and have a sidewall and a bottom. The sound guiding holes 30 may be arranged on the central portion of the sidewall of the housing (i.e., from about the ⅓ height of the sidewall to the ⅔ height of the sidewall). The quantity of the sound guiding holes 30 may be 8, and the openings (and cross sections) of the sound guiding hole 30 may be rectangle. The sound guiding holes 30 may be arranged evenly or unevenly in one or more circles on the sidewall of the housing 10.

In the embodiment, the transducer 21 may be implemented preferably based on the principle of electromagnetic transduction. The transducer 21 may include components such as magnetizer, voice coil, etc., which may be placed inside the housing and may generate synchronous vibrations with the same frequency.

Figure 8C:
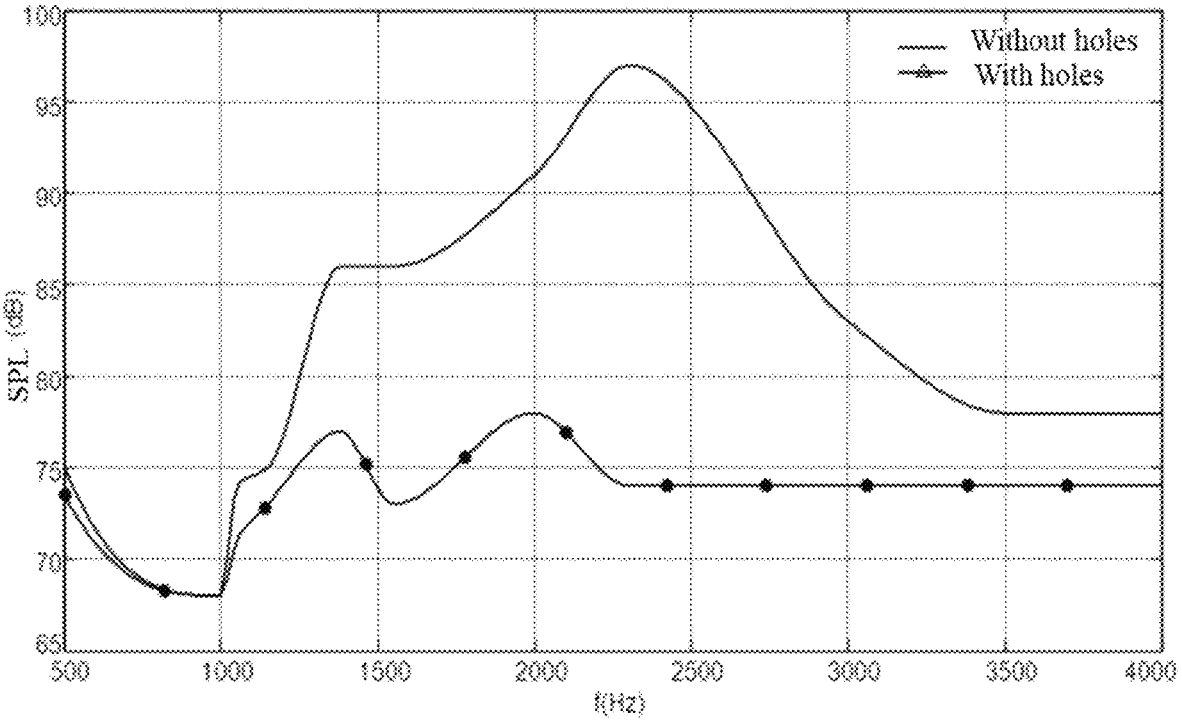
FIG. 8C is a diagram illustrating reduced sound leakage of a bone conduction speaker according to some embodiments of the present disclosure.

FIG. 8C is a diagram illustrating reduced sound leakage. In the frequency range of 1000 Hz~4000 Hz, the effectiveness of reducing sound leakage is great. For example, in the frequency range of 1.400 Hz~2900 Hz, the sound leakage is reduced by more than 10 dB; in the frequency range of 2200 Hz~2500 Hz, the sound leakage is reduced by more than 20 dB.

It's illustrated that the effectiveness of reduced sound leakage can be adjusted by changing the positions of the sound guiding holes, while keeping other parameters relating to the sound guiding holes unchanged.

Embodiment Five

Figure 9A:
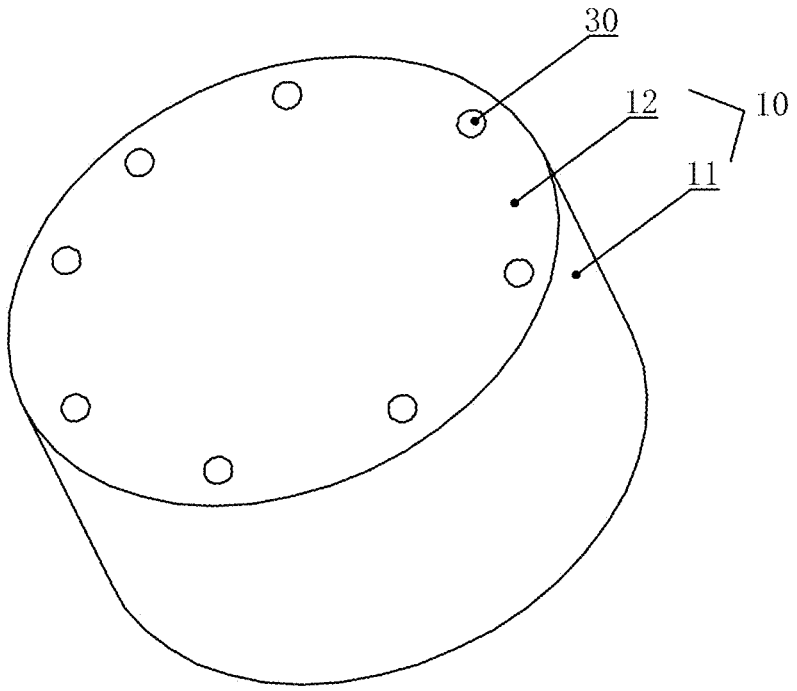
FIGS. 9A and 9B are schematic structures of an exemplary bone conduction speaker according to some embodiments of the present disclosure.
Figure 9B:
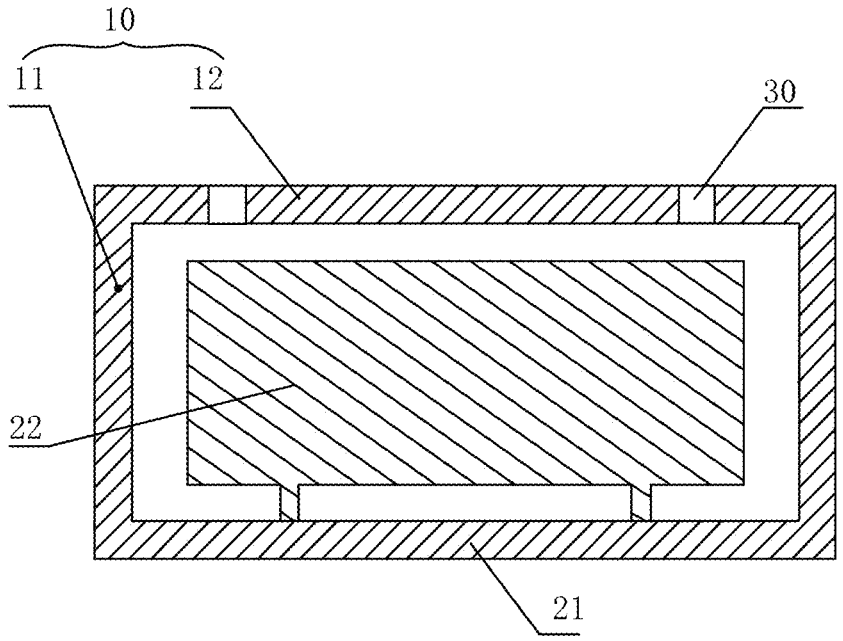

FIGS. 9A and 9B are schematic structures of an exemplary bone conduction speaker according to some embodiments of the present disclosure. The bone conduction speaker may, include an open housing 10, a vibration board 21 and a transducer 22. The housing 10 is cylindrical, with a sidewall and a bottom. One or more perforative sound guiding holes 30 may, be along the circumference of the bottom. In some embodiments, there may be 8 sound guiding holes 30 arranged evenly of unevenly in one or more circles on the bottom of the housing 10. In some embodiments, the shape of one or more of the sound guiding holes 30 may be rectangle.

In the embodiment, the transducer 21 may be implemented preferably based on the principle of electromagnetic transduction. The transducer 21 may include components such as magnetizer, voice coil, etc., which may be placed inside the housing and may generate synchronous vibration with the same frequency.

Figure 9C:
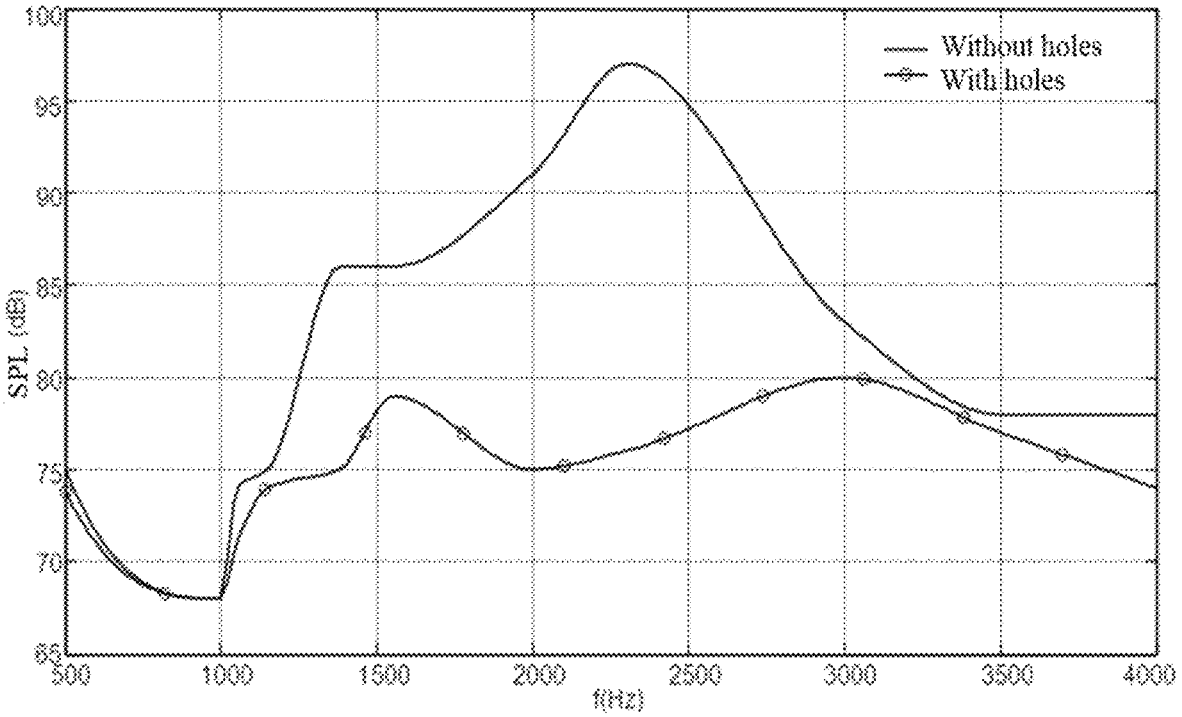
FIG. 9C is a diagram illustrating reduced sound leakage of a bone conduction speaker according to some embodiments of the present disclosure.

FIG. 9C is a diagram illustrating the effect of reduced sound leakage. In the frequency, range of 1000 Hz~3000 Hz, the effectiveness of reducing sound leakage is outstanding. For example, in the frequency range of 1700 Hz~2700 Hz, the sound leakage is reduced by more than 10 dB; in the frequency range of 2200 Hz~2400 Hz, the sound leakage is reduced by more than 20 dB.

Embodiment Six

Figure 10A:
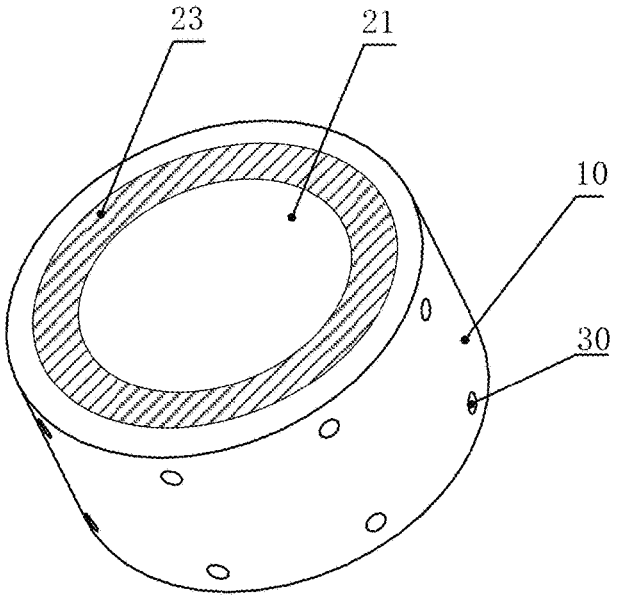
FIGS. 10A and 10B are schematic structures of an exemplary bone conduction speaker according to some embodiments of the present disclosure.
Figure 10B:
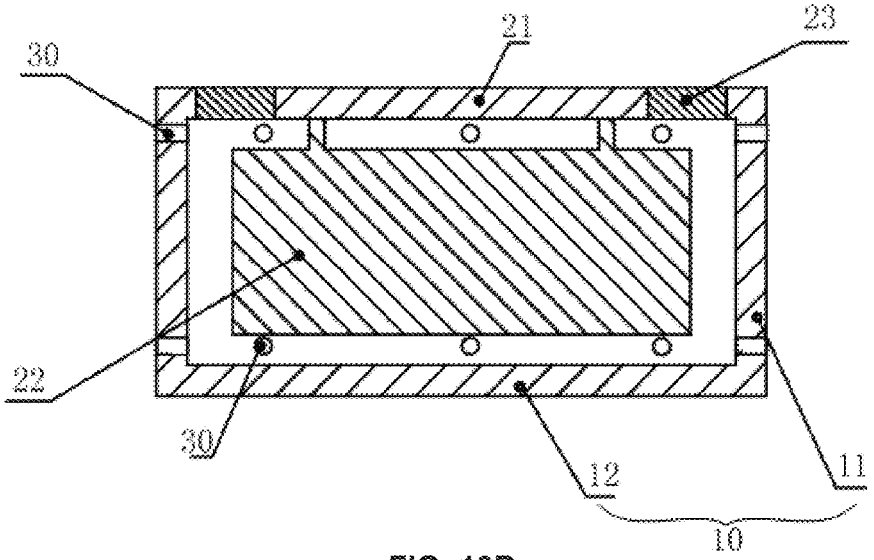

FIGS. 10A and 10B are schematic structures of an exemplary bone conduction speaker according to some embodiments of the present disclosure. The bone conduction speaker may include an open housing 10, a vibration board 21 and a transducer 22. One or more perforative sound guiding holes 30 may be arranged on both upper and lower portions of the sidewall of the housing 10. The sound guiding holes 30 may be arranged evenly or unevenly in one or more circles on the upper and lower portions of the sidewall of the housing 10. In some embodiments, the quantity of sound guiding holes 30 in every circle may be 8, and the upper portion sound guiding holes and the lower portion sound guiding holes may be symmetrical about the central cross section of the housing 10. In some embodiments, the shape of the sound guiding hole 30 may be circle.

The shape of the sound guiding holes on the upper portion and the shape of the sound guiding holes on the lower portion may be different; One or more damping layers may be arranged in the sound guiding holes to reduce leaked sound waves of the same wave length (or frequency), or to reduce leaked sound waves of different wave lengths.

Figure 10C:
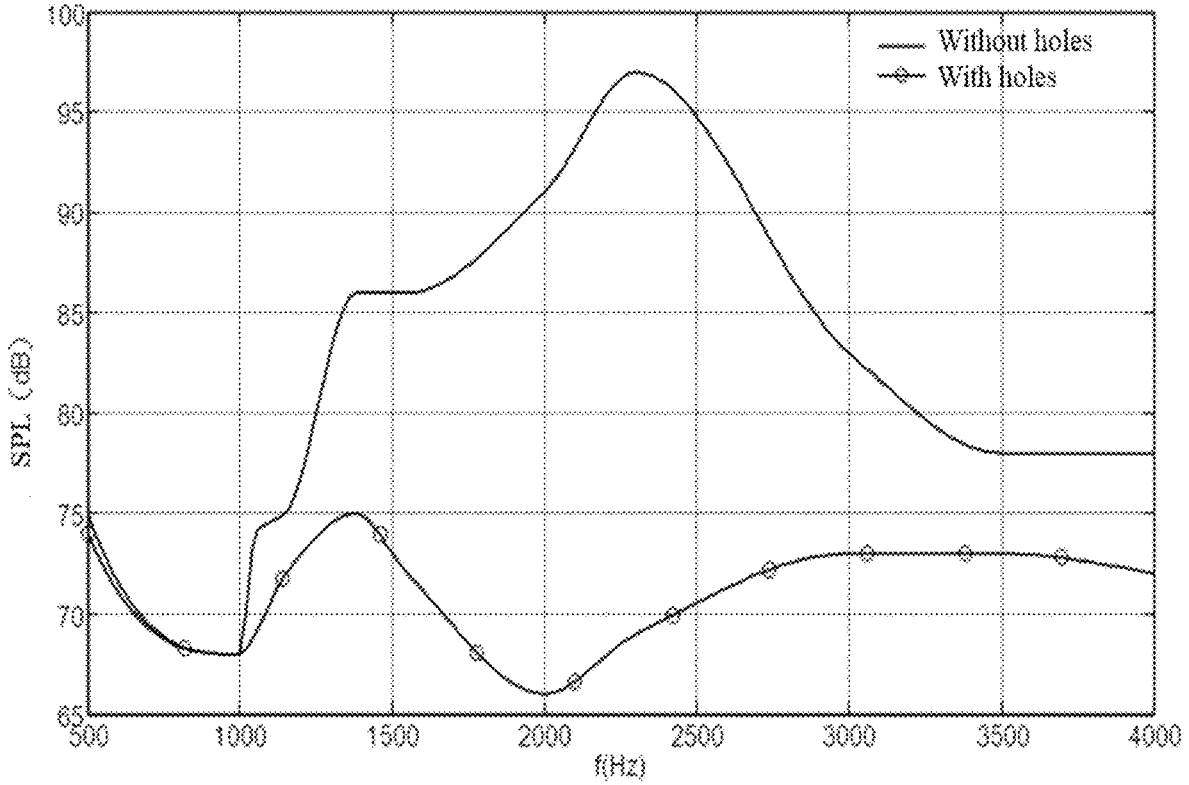
FIG. 10C is a diagram illustrating reduced sound leakage of a bone conduction speaker according to some embodiments of the present disclosure.

FIG. 10C is a diagram illustrating the effect of reducing sound leakage according to some embodiments of the present disclosure. In the frequency range of 1000 Hz~4000 Hz, the effectiveness of reducing sound leakage is outstanding. For example, in the frequency range of 1600 Hz~2700 Hz, the sound leakage is reduced by more than 15 dB; in the frequency range of 2000 Hz~2500 Hz, where the effectiveness of reducing sound leakage is most outstanding, the sound leakage is reduced by more than 20 dB. Compared to embodiment three, this scheme has a relatively balanced effect of reduced sound leakage on various frequency range, and this effect is better than the effect of schemes where the height of the holes are fixed, such as schemes of embodiment three, embodiment four, embodiment five, and so on.

In some embodiments, the sound guiding hole(s) at the upper portion of the sidewall of the housing 10 (also referred to as first hole(s)) may be approximately regarded as a point sound source. In some embodiments, the first hole(s) and the portion of the housing 10 that generates the leaked sound wave may constitute two-point sound sources (also referred to as first two-point sound sources). As for the first two-point sound sources, the guided sound wave generated by the first hole(s) (also referred to as first guided sound wave) may interfere with the leaked sound wave or a portion thereof generated by the portion of the housing 10 in a first region. In some embodiments, the sound waves output from the first two-point sound sources may have a same frequency (e.g., a first frequency). In some embodiments, the sound waves output from the first two-point sound sources may have a certain phase difference. In this case, the interference between the sound waves generated by the first two-point sound sources may reduce a sound pressure level of the leaked sound wave in the target region. When the position and phase difference of the first two-point sound sources meet certain conditions, the acoustic output device may output different sound effects in the near field (for example, the position of the user's ear) and the far field. For example, if the phases of the first two-point sound sources are opposite, that is, an absolute value of the phase difference between the first two-point sound sources is 180 degrees, the far-field leakage may be reduced according to the principle of reversed phase cancellation.

In some embodiments, the sound guiding hole(s) at the lower portion of the sidewall of the housing 10 (also referred to as second hole(s)) may also be approximately regarded as another point sound source. Similarly, the second hole(s) and the portion of the housing 10 that generates the leaked sound wave may also constitute two-point sound sources (also referred to as second two-point sound sources). As for the second two-point sound sources, the guided sound wave generated by the second hole(s) (also referred to as second guided sound wave) may interfere with the leaked sound wave or a portion thereof generated by the portion of the housing 10 in a second region. The second region may be the same as or different from the first region. In some embodiments, the sound waves output from the second two-point sound sources may have a same frequency (e.g., a second frequency).

In some embodiments, the first frequency and the second frequency may be in certain frequency ranges. In some embodiments, the frequency of the guided sound wave output from the sound guiding hole(s) may be adjustable. In some embodiments, the frequency of the first guided sound wave and/or the second guided sound wave may be adjusted by one or more acoustic routes. The acoustic routes may be coupled to the first hole(s) and/or the second hole(s). The first guided sound wave and/or the second guided sound wave may be propagated along the acoustic route having a specific frequency selection characteristic. That is, the first guided sound wave and the second guided sound wave may be transmitted to their corresponding sound guiding holes via different acoustic routes. For example, the first guided sound wave and/or the second guided sound wave may be propagated along an acoustic route with a low-pass characteristic to a corresponding sound guiding hole to output guided sound wave of a low frequency. In this process, the high frequency component of the sound wave may be absorbed or attenuated by the acoustic route with the low-pass characteristic. Similarly, the first guided sound wave and/or the second guided sound wave may be propagated along an acoustic route with a high-pass characteristic to the corresponding sound guiding hole to output guided sound wave of a high frequency. In this process, the low frequency component of the sound wave may be absorbed or attenuated by the acoustic route with the high-pass characteristic.

Figure 10D:
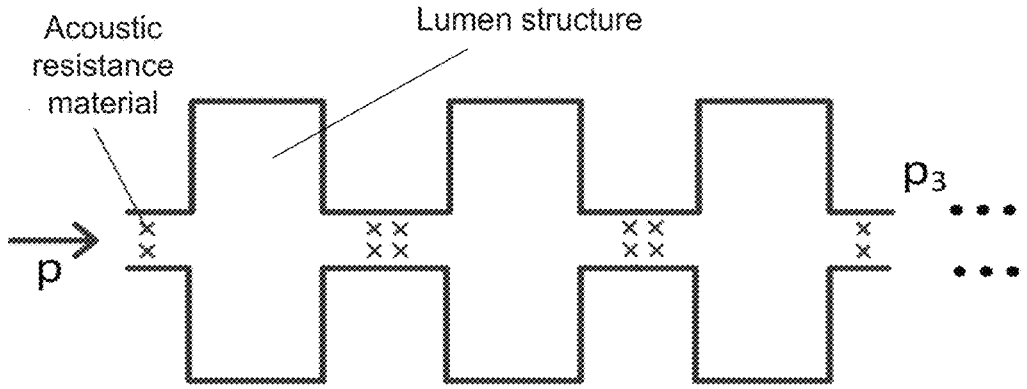
FIG. 10D is a schematic diagram illustrating an acoustic route according to some embodiments of the present disclosure.
Figure 10E:
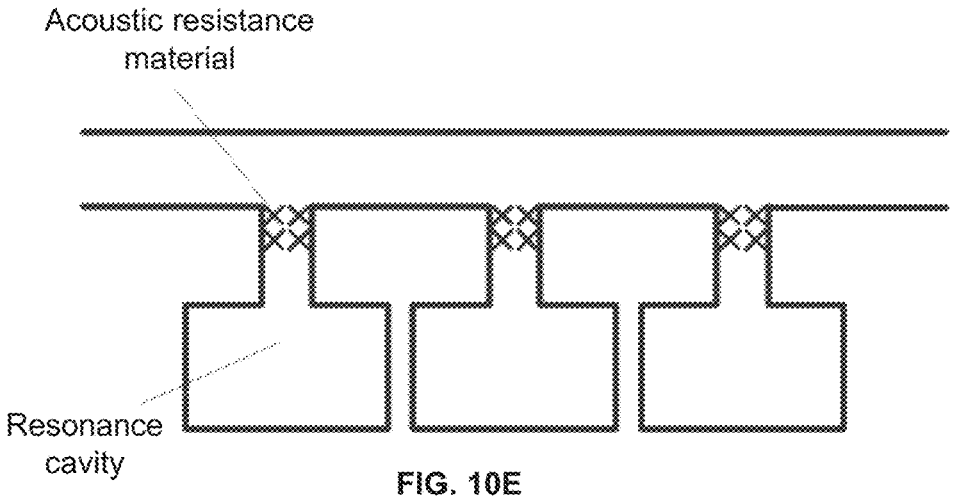
FIG. 10E is a schematic diagram illustrating another acoustic route according to some embodiments of the present disclosure.
Figure 10F:
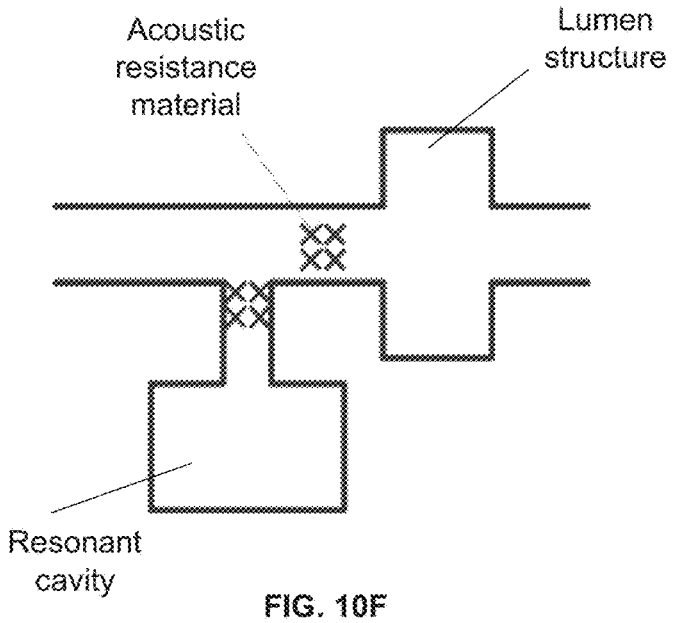
FIG. 10F is a schematic diagram illustrating a further acoustic route according to some embodiments of the present disclosure.

FIG. 10D is a schematic diagram illustrating an acoustic route according to some embodiments of the present disclosure. FIG. 10E is a schematic diagram illustrating another acoustic route according to some embodiments of the present disclosure. FIG. 10F is a schematic diagram illustrating a further acoustic route according to some embodiments of the present disclosure. In some embodiments, structures such as a sound tube, a sound cavity, a sound resistance, etc., may be set in the acoustic route for adjusting frequencies for the sound waves (e.g., by filtering certain frequencies). It should be noted that FIGS. 10D-10F may be provided as examples of the acoustic routes, and not intended be limiting.

As shown in FIG. 10D, the acoustic route may include one or more lumen structures. The one or more lumen structures may be connected in series. An acoustic resistance material may be provided in each of at least one of the one or more lumen structures to adjust acoustic impedance of the entire structure to achieve a desirable sound filtering effect. For example, the acoustic impedance may be in a range of 5MKS Rayleigh to 500 MKS Rayleigh. In some embodiments, a high-pass sound filtering, a low-pass sound filtering, and/or a band-pass filtering effect of the acoustic route may be achieved by adjusting a size of each of at least one of the one or more lumen structures and/or a type of acoustic resistance material in each of at least one of the one or more lumen structures. The acoustic resistance materials may include, but not limited to, plastic, textile, metal, permeable material, woven material, screen material or mesh material, porous material, particulate material, polymer material, or the like, or any combination thereof. By setting the acoustic routes of different acoustic impedances, the acoustic output from the sound guiding holes may be acoustically filtered. In this case, the guided sound waves may have different frequency components.

As shown in FIG. 10E, the acoustic route may include one or more resonance cavities. The one or more resonance cavities may be, for example, Helmholtz cavity. In some embodiments, a high-pass sound filtering, a low-pass sound filtering, and/or a band-pass filtering effect of the acoustic route may be achieved by adjusting a size of each of at least one of the one or more resonance cavities and/or a type of acoustic resistance material in each of at least one of the one or more resonance cavities.

As shown in FIG. 10F, the acoustic route may include a combination of one or more lumen structures and one or more resonance cavities. In some embodiments, a high-pass sound filtering, a low-pass sound filtering, and/or a band-pass filtering effect of the acoustic route may be achieved by adjusting a size of each of at least one of the one or more lumen structures and one or more resonance cavities and/or a type of acoustic resistance material in each of at least one of the one or more lumen structures and one or more resonance cavities. It should be noted that the structures exemplified above may be for illustration purposes, various acoustic structures may also be provided, such as a tuning net, tuning cotton, etc.

In some embodiments, the interference between the leaked sound wave and the guided sound wave may relate to frequencies of the guided sound wave and the leaked sound wave and/or a distance between the sound guiding hole(s) and the portion of the housing 10. In some embodiments, the portion of the housing that generates the leaked sound wave may be the bottom of the housing 10. The first hole(s) may have a larger distance to the portion of the housing 10 than the second hole(s). In some embodiments, the frequency of the first guided sound wave output from the first hole(s) (e.g., the first frequency) and the frequency of second guided sound wave output from second hole(s) (e.g., the second frequency) may be different.

In some embodiments, the first frequency and second frequency may associate with the distance between the at least one sound guiding hole and the portion of the housing 10 that generates the leaked sound wave. In some embodiments, the first frequency may be set in a low frequency range. The second frequency may be set in a high frequency range. The low frequency range and the high frequency range may or may not overlap.

In some embodiments, the frequency of the leaked sound wave generated by the portion of the housing 10 may be in a wide frequency range. The wide frequency range may include, for example, the low frequency range and the high frequency range or a portion of the low frequency range and the high frequency range. For example, the leaked sound wave may include a first frequency in the low frequency range and a second frequency in the high frequency range. In some embodiments, the leaked sound wave of the first frequency and the leaked sound wave of the second frequency may be generated by different portions of the housing 10. For example, the leaked sound wave of the first frequency may be generated by the sidewall of the housing 10, the leaked sound wave of the second frequency may be generated by the bottom of the housing 10. As another example, the leaked sound wave of the first frequency may be generated by the bottom of the housing 10, the leaked sound wave of the second frequency may be generated by the sidewall of the housing 10. In some embodiments, the frequency of the leaked sound wave generated by the portion of the housing 10 may relate to parameters including the mass, the damping, the stiffness, etc., of the different portion of the housing 10, the frequency of the transducer 22, etc.

In some embodiments, the characteristics (amplitude, frequency, and phase) of the first two-point sound sources and the second two-point sound sources may be adjusted via various parameters of the acoustic output device (e.g., electrical parameters of the transducer 22, the mass, stiffness, size, structure, material, etc., of the portion of the housing 10, the position, shape, structure, and/or number (or count) of the sound guiding hole(s) so as to form a sound field with a particular spatial distribution. In some embodiments, a frequency of the first guided sound wave is smaller than a frequency of the second guided sound wave.

A combination of the first two-point sound sources and the second two-point sound sources may improve sound effects both in the near field and the far field.

Referring to FIGS. 4D, 7C, and 10C, by designing different two-point sound sources with different distances, the sound leakage in both the low frequency range and the high frequency range may be properly suppressed. In some embodiments, the closer distance between the second two-point sound sources may be more suitable for suppressing the sound leakage in the far field, and the relative longer distance between the first two-point sound sources may be more suitable for reducing the sound leakage in the near field. In some embodiments, the amplitudes of the sound waves generated by the first two-point sound sources may be set to be different in the low frequency range. For example, the amplitude of the guided sound wave may be smaller than the amplitude of the leaked sound wave. In this case, the sound pressure level of the near-field sound may be improved. The volume of the sound heard by the user may be increased.

Embodiment Seven

Figure 11A:
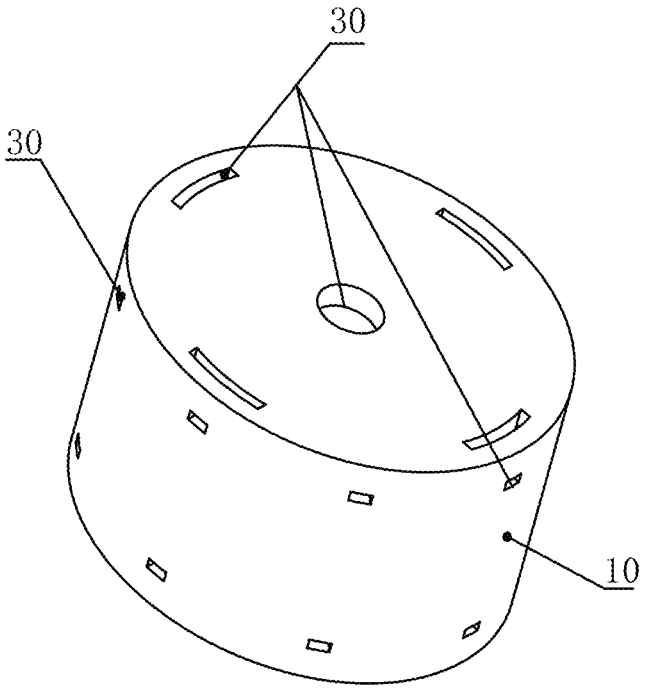
FIGS. 11A and 11B are schematic structures of an exemplary bone conduction speaker according to some embodiments of the present disclosure.
Figure 11B:
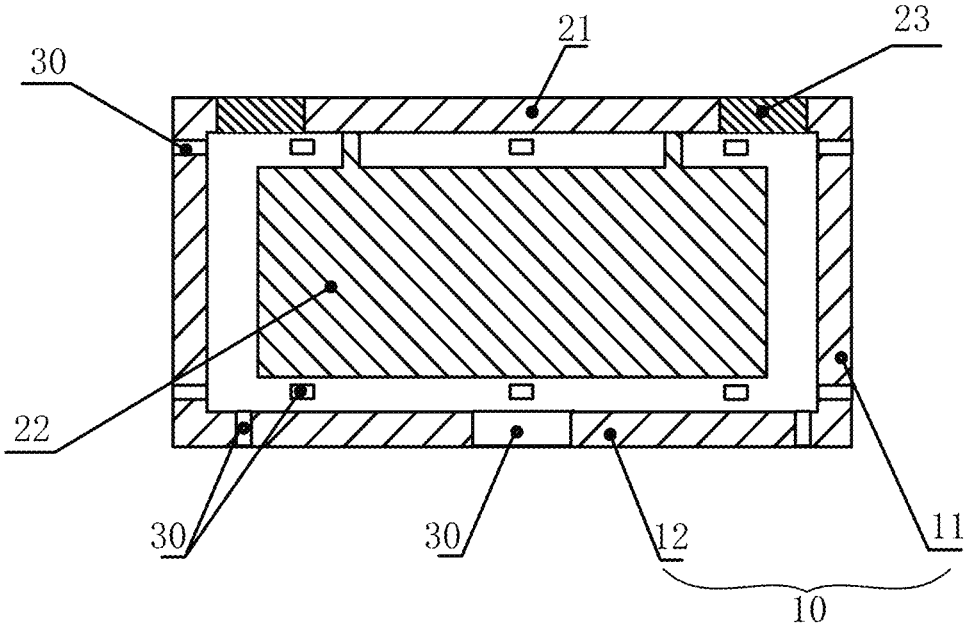

FIGS. 11A and 11B are schematic structures illustrating a bone conduction speaker according to some embodiments of the present disclosure. The bone conduction speaker may include an open housing 10, a vibration board 21 and a transducer 22. One or more perforative sound guiding holes 30 may be set on upper and lower portions of the sidewall of the housing 10 and on the bottom of the housing 10. The sound guiding holes 30 on the sidewall are arranged evenly or unevenly in one or more circles on the upper and lower portions of the sidewall of the housing 10. In some embodiments, the quantity of sound guiding holes 30 in every circle may be 8, and the upper portion sound guiding holes and the lower portion sound guiding holes may be symmetrical about the central cross section of the housing 10. In some embodiments, the shape of the sound guiding hole 30 may be rectangular. There may be four sound guiding holds 30 on the bottom of the housing 10. The four sound guiding holes 30 may be linear-shaped along arcs, and may be arranged evenly or unevenly in one or more circles with respect to the center of the bottom. Furthermore, the sound guiding holes 30 may include a circular perforative hole on the center of the bottom.

Figure 11C:
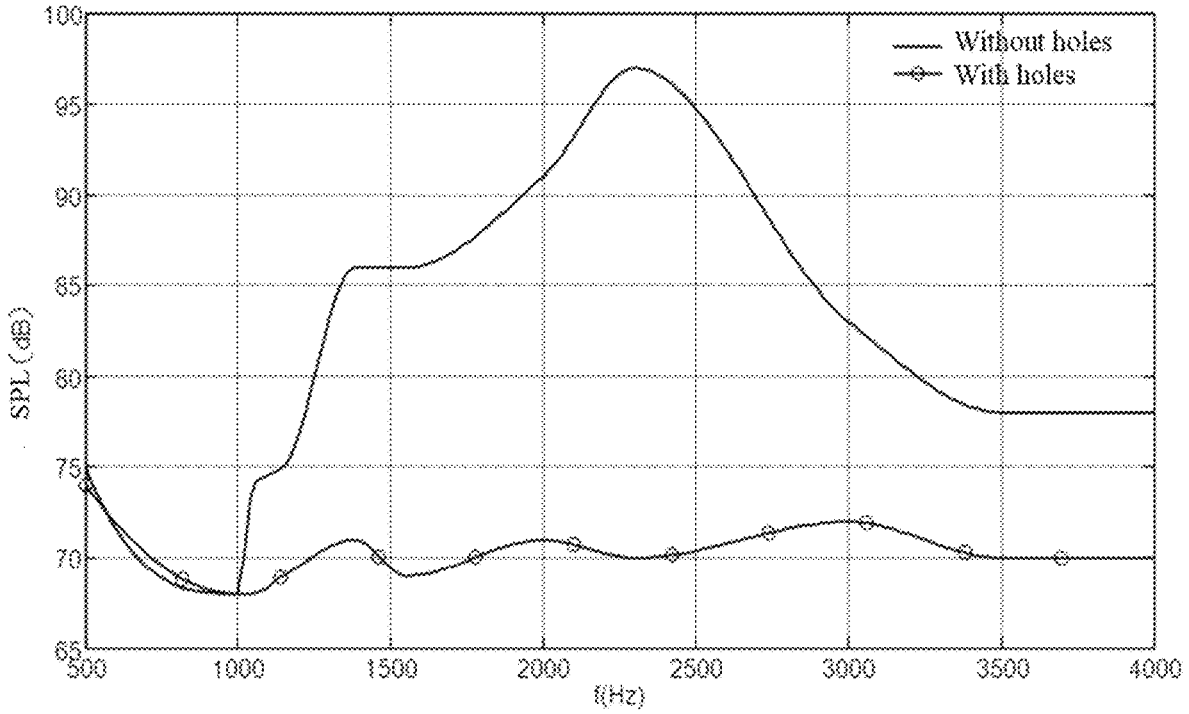
FIG. 11C is a diagram illustrating reduced sound leakage of a bone conduction speaker according to some embodiments of the present disclosure.

FIG. 11C is a diagram illustrating the effect of reducing sound leakage of the embodiment. In the frequency range of 1000 Hz~4000 Hz, the effectiveness of reducing sound leakage is outstanding. For example, in the frequency range of 1300 Hz~3000 Hz, the sound leakage is reduced by more than 10 dB; in the frequency range of 2000 Hz~2700 Hz, the sound leakage is reduced by more than 20 dB. Compared to embodiment three, this scheme has a relatively balanced effect of reduced sound leakage within various frequency range, and this effect is better than the effect of schemes where the height of the holes are fixed, such as schemes of embodiment three, embodiment four, embodiment five, and etc. Compared to embodiment six, in the frequency range of 1000 Hz~1700 Hz and 2500 Hz~4000 Hz, this scheme has a better effect of reduced sound leakage than embodiment six.

Embodiment Eight

Figure 12A:
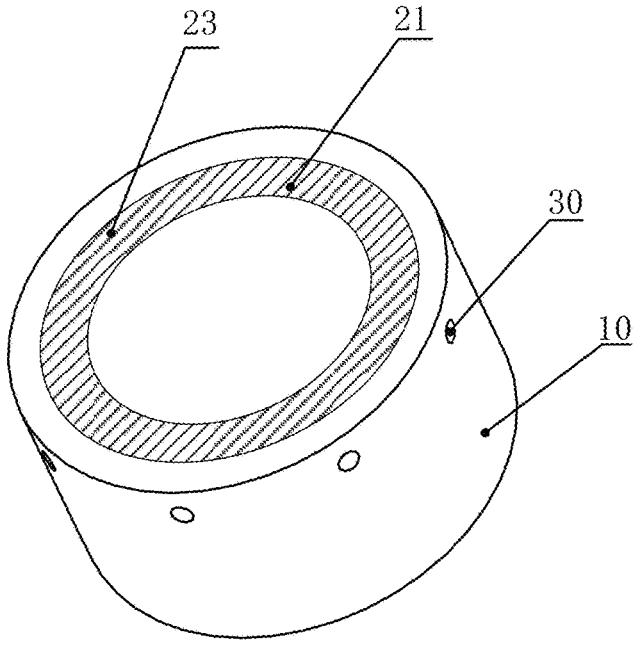
FIGS. 12A and 12B are schematic structures of an exemplary bone conduction speaker according to some embodiments of the present disclosure.
Figure 12B:
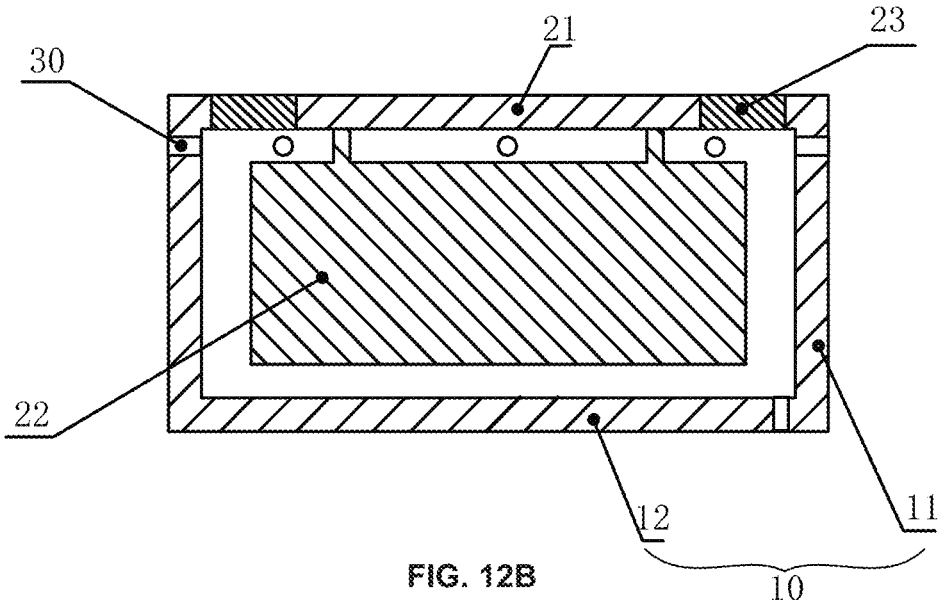

FIGS. 12A and 12B are schematic structures illustrating a bone conduction speaker according to some embodiments of the present disclosure. The bone conduction speaker may include an open housing 10, a vibration board 21 and a transducer 22. A perforative sound guiding hole 30 may be set on the upper portion of the sidewall of the housing 10. One or more sound guiding holes may be arranged evenly or unevenly in one or more circles on the upper portion of the sidewall of the housing 10. There may be 8 sound guiding holes 30, and the shape of the sound guiding holes 30 may be circle.

After comparison of calculation results and test results, the effectiveness of this embodiment is basically the same with that of embodiment one, and this embodiment can effectively reduce sound leakage.

Embodiment Nine

Figure 13A:
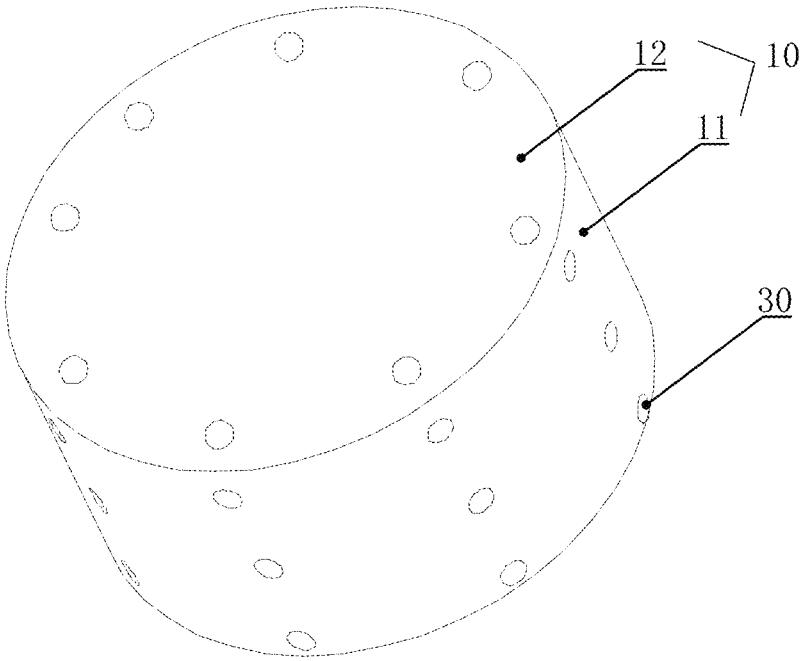
FIGS. 13A and 13B are schematic structures of an exemplary bone conduction speaker according to some embodiments of the present disclosure.
Figure 13B:
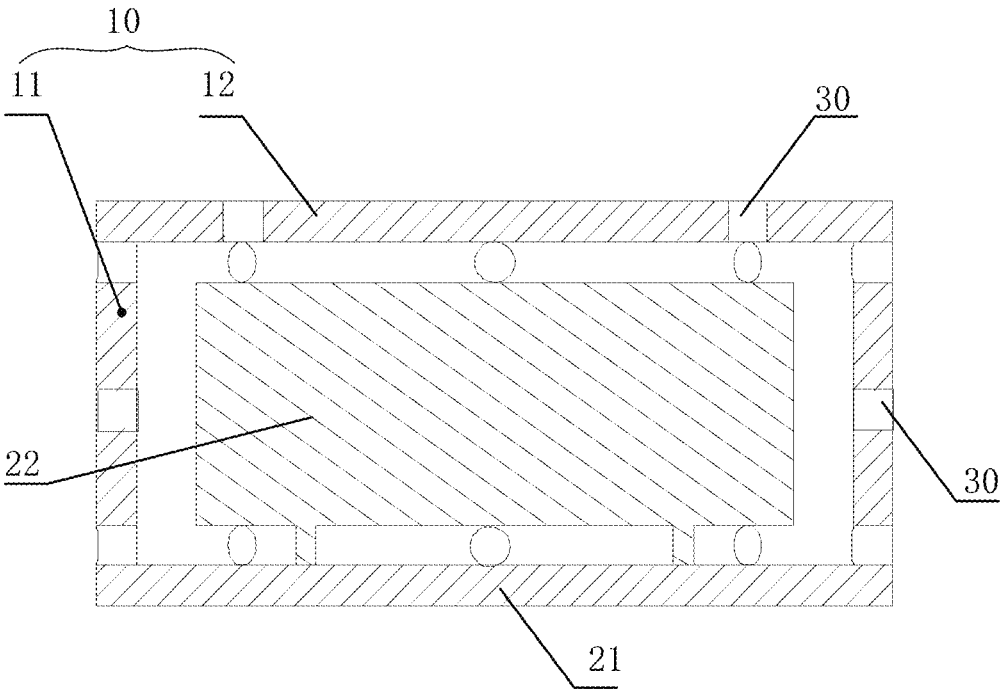

FIGS. 13A and 13B are schematic structures illustrating a bone conduction speaker according to some embodiments of the present disclosure. The bone conduction speaker may include an open housing 10, a vibration board 21 and a transducer 22.

The difference between this embodiment and the above-described embodiment three is that to reduce sound leakage to greater extent, the sound guiding holes 30 may be arranged on the upper, central and lower portions of the sidewall 11. The sound guiding holes 30 are arranged evenly or unevenly in one or more circles. Different circles are formed by the sound guiding holes 30, one of which is set along the circumference of the bottom 12 of the housing 10. The size of the sound guiding holes 30 are the same.

The effect of this scheme may cause a relatively balanced effect of reducing sound leakage in various frequency ranges compared to the schemes where the position of the holes are fixed. The effect of this design on reducing sound leakage is relatively better than that of other designs where the heights of the holes are fixed, such as embodiment three, embodiment four, embodiment five, etc.

Embodiment Ten

The sound guiding holes 30 in the above embodiments may be perforative holes without shields.

In order to adjust the effect of the sound waves guided from the sound guiding holes, a damping layer (not shown in the figures) may locate at the opening of a sound guiding hole 30 to adjust the phase and/or the amplitude of the sound wave.

There are multiple variations of materials and positions of the damping layer. For example, the damping layer may be made of materials which can damp sound waves, such as tuning paper, tuning cotton, nonwoven fabric, silk, cotton, sponge or rubber. The damping layer may be attached on the inner wall of the sound guiding hole 30, or may shield the sound guiding hole 30 from outside.

More preferably, the damping layers corresponding to different sound guiding holes 30 may be arranged to adjust the sound waves from different sound guiding holes to generate a same phase. The adjusted sound waves may be used to reduce leaked sound wave having the same wavelength. Alternatively, different sound guiding holes 30 may be arranged to generate different phases to reduce leaked sound wave having different wavelengths (i.e., leaked sound waves with specific wavelengths).

In some embodiments, different portions of a same sound guiding hole can be configured to generate a same phase to reduce leaked sound waves on the same wavelength (e.g., using a pre-set damping layer with the shape of stairs or steps). In some embodiments, different portions of a same sound guiding hole can be configured to generate different phases to reduce leaked sound waves on different wavelengths.

The above-described embodiments are preferable embodiments with various configurations of the sound guiding hole(s) on the housing of a bone conduction speaker, but a person having ordinary skills in the art can understand that the embodiments don't limit the configurations of the sound guiding hole(s) to those described in this application.

In the past bone conduction speakers, the housing of the bone conduction speakers is closed, so the sound source inside the housing is sealed inside the housing. In the embodiments of the present disclosure, there can be holes in proper positions of the housing, making the sound waves inside the housing and the leaked sound waves having substantially same amplitude and substantially opposite phases in the space, so that the sound waves can interfere with each other and the sound leakage of the bone conduction speaker is reduced. Meanwhile, the volume and weight of the speaker do not increase, the reliability of the product is not comprised, and the cost is barely increased. The designs disclosed herein are easy to implement, reliable, and effective in reducing sound leakage.

In some embodiments, when the user wears a speaker (e.g., a bone conduction speaker) as described elsewhere in the present disclosure, the speaker may be located at least on one side of the user's head, close but not blocking the user's ear. The speaker may be worn on the head of the user (for example, a non-in-ear open headset worn with glasses, a headband, or other structural means), or worn on other body parts of the user (such as the neck/shoulder region of the user), or placed near the ears of user by other means (such as the way the user holds it). The speaker may further include at least two groups of acoustic drivers, including at least one group of high-frequency acoustic drivers and one group of low-frequency acoustic drivers. Each group of acoustic driver may be used to generate a sound with a certain frequency range, and the sound may be transmitted outward through at least two sound guiding holes acoustically coupled with it.

In order to further explain the effect of the setting of the sound guiding holes on the speaker on the acoustic output effect of the speaker, and considering that the sound may be regarded as propagating outwards from the sound guiding holes, the present disclosure may describe the sound guiding holes on the speaker as sound sources for externally outputting sound.

Just for the convenience of description and for the purpose of illustration, when sizes of the sound guiding holes on the speaker are small, each sound guiding hole may be approximately regarded as a point sound source. In some embodiments, any sound guiding holes provided on the speaker for outputting sound may be approximated as a single point sound source on the speaker. The sound field pressure p generated by a single point sound source may satisfy Equation (13) as described in FIG. 4E. Further, for those skilled in the art, without creative activities, it may be known that the acoustic effect achieved by "acoustic driver outputs sound from at least two first sound guiding holes" described in the present disclosure may also achieve the same effect by other acoustic structures, for example, "at least two acoustic drivers each of which outputs sound from at least one acoustic radiation surface". According to actual situations, other acoustic structures may be selected for adjustment and combination, and the same acoustic output effect may also be achieved. The principle of radiating sound outward with structures such as surface sound sources may be similar to that of point sound sources, and may not be repeated here.

As mentioned above, at least two sound guiding holes corresponding to the same acoustic driver may be set on the speaker provided in the specification. In this case, two-point sound sources (also referred to as two point sound sources or a dual-point sound source) may be formed, which may reduce sound transmitted to the surrounding environment. For convenience, the sound output from the speaker to the surrounding environment may be referred to as far-field leakage since it may be heard by others in the environment. The sound output from the speaker to the ears of the user wearing the speaker may also be referred to as near-field sound since a distance between the speaker and the user may be relatively short. In some embodiments, the sound outputs from two sound guiding holes (i.e., the two-point sound sources) have a certain phase difference. When the position and phase difference of the two-point sound sources meet certain conditions, the speaker may output different sound effects in the near-field (for example, the position of the user's ear) and the far-field. For example, if the phases of the point sound sources corresponding to the two sound guiding holes are opposite, that is, an absolute value of the phase difference between the two-point sound sources may be 180 degrees, the far-field leakage may be reduced according to the principle of reversed phase cancellation.

Further refer to FIG. 4E for illustration purposes, a sound pressure p in the sound field generated by two-point sound sources may satisfy the following Equation (14):

$$p = \frac{A_1}{r_1}\exp j(\omega t - kr_1 + \varphi_1) + \frac{A_2}{r_2}\exp j(\omega t - kr_2 + \varphi_2), \tag{14}$$

where, $A_1$ and $A_2$ denote intensities of the two-point sound sources, $\varphi_1$ and $\varphi_2$ denote phases of the two-point sound sources, respectively, d denotes a distance between the two point sound sources, and $r_1$ and $r_2$ may satisfy Equation (15):

$$\begin{cases} r_1 = \sqrt{r^2 + \left(\frac{d}{2}\right)^2 - 2 \times r \times \frac{d}{2} \times \cos\theta} \\ r_2 = \sqrt{r^2 + \left(\frac{d}{2}\right)^2 + 2 \times r \times \frac{d}{2} \times \cos\theta} \end{cases} \tag{15}$$

where, r denotes a distance between any target point and the center of the two-point sound sources in the space, and θ denotes an angle between a line connecting the target point and the center of the two-point sound sources and another line on which the two-point sound sources may be located.

According to Equation (15), the sound pressure p of the target point in the sound field may relate to the intensity of each point sound source, the distance d, the phases of the two-point sound sources, and the distance to the two-point sound sources.

Two-point sound sources with different output effects may be formed through different settings of sound guiding holes. In this case, the volume of near-field sound may be improved, and the leakage of the far-field may be reduced. For example, an acoustic driver may include a vibration diaphragm. When the vibration diaphragm vibrates, sounds may be transmitted from the front and rear sides of the vibration diaphragm, respectively. The front side of the vibration diaphragm in the speaker may be provided with a front chamber for transmitting sound. The front chamber may be coupled with a sound guiding hole acoustically. The sound transmitted from the front side of the vibration diaphragm may be transmitted to the sound guiding hole through the front chamber and further transmitted outwards. The rear side of the vibration diaphragm in the speaker may be provided with a rear chamber for transmitting sound. The rear chamber may be coupled with another sound guiding hole acoustically, and the sound transmitted from the rear side of the vibration diaphragm may be transmitted to the sound guiding hole through the rear chamber and propagate further outwards. It should be noted that, when the vibration diaphragm vibrating, the front side and the rear side of the vibration diaphragm may generate sound with opposite phases, respectively. In some embodiments, the structures of the front chamber and rear chamber may be specially set so that the sound output by the acoustic driver at different sound guiding holes may meet specific conditions. For example, lengths of the front chamber and the rear chamber may be specially designed such that sound with a specific phase relationship (e.g., opposite phases) may be output at the two sound guiding holes. As a result, problems that the speaker has a low volume in the near-field and the sound leaks in the far-field may be effectively resolved.

Figure 14:
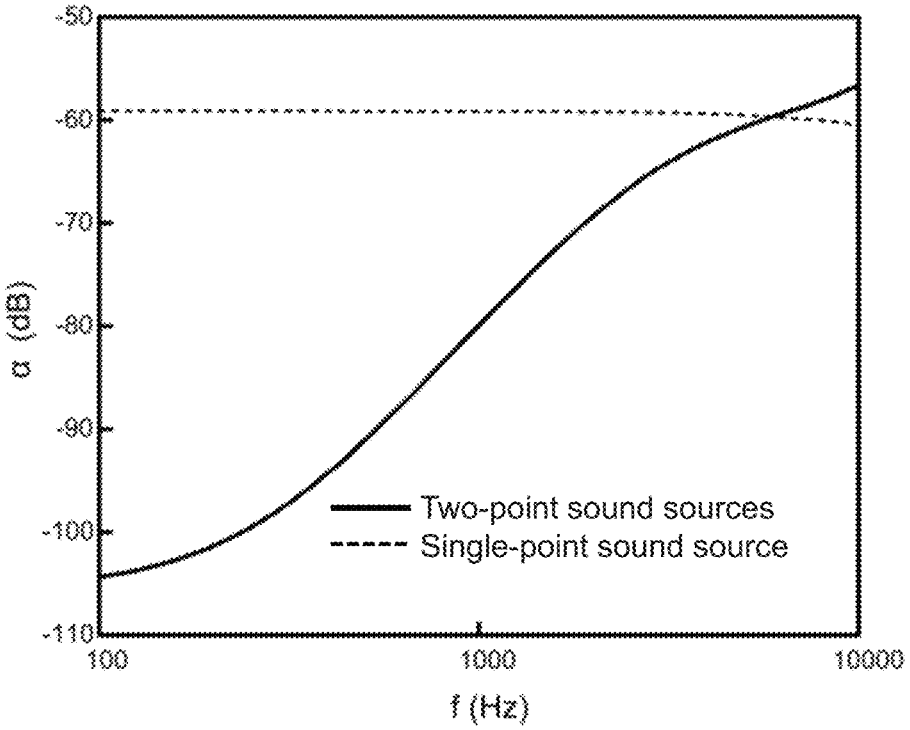
FIG. 14 is a schematic diagram illustrating variations of sound leakage of two-point sound sources and a single point sound source as a function of frequency according to some embodiments of the present disclosure.

FIG. 14 is a schematic diagram illustrating variations of sound leakage of two-point sound sources and a single point sound source as a function of frequency according to some embodiments of the present disclosure.

Under certain conditions, compared to a volume of the far-field leakage of a single point sound source, the volume of the far-field leakage of the two-point sound sources may increase with the frequency. In other words, the leakage reduction capability of the two-point sound sources in the far-field may decrease with the frequency increases. For further description, a curve of far-field leakage with frequency may be described in connection with FIG. 14.

A distance between the two point sound sources in FIG. 14 may be fixed, and the two-point sound sources may have a same amplitude and opposite phases. The dotted line may indicate a variation curve of a volume of the single point sound source at different frequencies. The solid line may indicate a variation curve of a volume of the leaked sound of the two-point sound sources at different frequencies. The abscissa of the diagram may represent the frequency (f) of the sound, and the unit may be Hertz (Hz). The ordinate of the diagram may use a normalization parameter a to evaluate the volume of the leaked sound. The calculation equation of parameter a may be as follows:

$$\alpha = \frac{|P_{far}|^2}{|P_{ear}|^2}, \tag{16}$$

where $P_{far}$ denotes the sound pressure of the speaker in the far-field (i.e., the sound pressure of the far-field sound leakage). $P_{ear}$ denotes the sound pressure around the user's ears (i.e., the sound pressure of the near-field sound). The larger the value of $\alpha$, the larger the far-field leakage relative to the near-field sound heard may be, indicating that the capability of the speaker for reducing the far-field leakage may be worse.

As shown in FIG. 14, when the frequency is below 6000 Hz, the far-field leakage produced by the two-point sound sources may be less than the far-field leakage produced by the single point sound source, and may increase as the frequency increases. When the frequency is close to 10000 Hz (for example, about 8000 Hz or above), the far-field leakage produced by the two-point sound sources may be greater than the far-field leakage produced by the single point sound source. In some embodiments, a frequency corresponding to an intersection of the variation curves of the two-point sound sources and the single point sound source may be determined as an upper limit frequency that the two-point sound sources can reduce the leakage.

For illustrative purposes, when the frequency is relatively small (for example, in a range of 100 Hz to 1000 Hz), the capability of reducing sound leakage (i.e., the value of a may be small) of the two-point sound sources may be relatively strong (below −80 dB). In such a frequency band, an increase of the volume of the heard sound may be determined as an optimization goal. When the frequency is relatively great, (for example, in a range of 1000 Hz to 8000 Hz), the capability of reducing sound leakage of the two-point sound sources may be relatively weak (above −80 dB). In such a frequency band, a decrease of the sound leakage may be determined as the optimization goal.

In connection with FIG. 14, a frequency division point of the frequency may be determined through the variation tendency of the capability of the two-point sound sources in reducing the sound leakage. Parameters of the two-point sound sources may be adjusted according to the frequency division point so as to reduce the sound leakage of the speaker. For example, the frequency corresponding to a of a specific value (e.g., −60 dB, −70 dB, −80 dB, −90 dB, etc.) may be used as the frequency division point. Parameters of the two-point sound sources may be determined by setting the frequency band below the frequency division point to improve the near-field sound, and setting the frequency band above the frequency division point to reduce far-field sound leakage. In some embodiments, a high-frequency band with a high-frequency (for example, sound output from a high-frequency acoustic driver) and a low-frequency band with a low frequency (for example, sound output from a low-frequency acoustic driver) may be determined based on the frequency division point. More details of the frequency division point may be disclosed elsewhere in the present disclosure (such as FIG. 17 and the descriptions thereof).

In some embodiments, the method for measuring and calculating the sound leakage may be adjusted according to the actual conditions. For example, an average value of amplitudes of the sound pressure of a plurality of points on a spherical surface centered by two-point sound sources with a radius of 40 cm may be determined as the value of the sound leakage. As another example, one or more points of the far-field position may be taken as the position for measuring the sound leakage, and the sound volume of the position may be taken as the value of the sound leakage. As another example, a center of two-point sound sources may be used as a center of a circle, and sound pressure amplitudes of two or more points evenly sampled according to a certain spatial angle in the far-field may be averaged, the average value may be taken as the value of the sound leakage. These measurement and calculation methods may be adjusted by those skilled in the art according to actual conditions and may be not intended to be limiting.

According to FIG. 14, it may be concluded that in the high-frequency band (higher frequency band determined according to the frequency division point), the two-point sound sources may have a weak capability to reduce sound leakage, and in the low-frequency band (lower frequency band determined according to the frequency division point), the two-point sound sources may have a strong capability to reduce sound leakage. At a certain sound frequency, the distance between the two point sound sources may be different, and its capability to reduce sound leakage may be different, and the difference between the volume of the heard sound and volume of the leaked sound may also be different. For a better description, the curve of the far-field leakage as a function of the distance between the two point sound sources may be described with reference to FIGS. 15A and 15B.

Figure 15A:
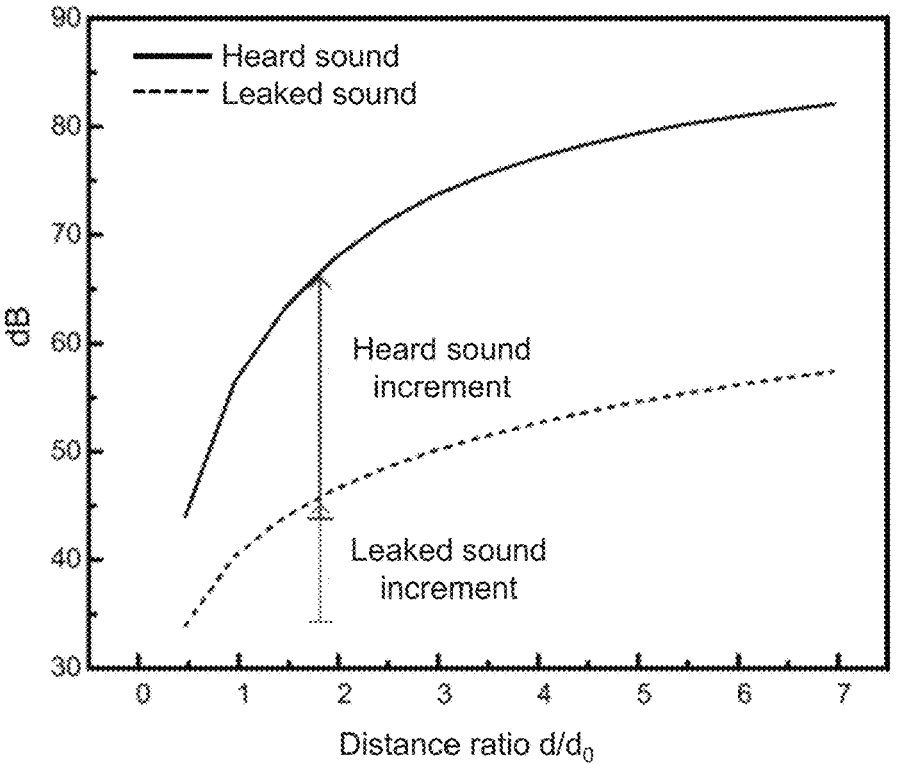
FIG. 15A is an exemplary graph illustrating a volume of the near-field sound and a volume of the far-field leakage as a function of the distance between two point sound sources according to some embodiments of the present disclosure.
Figure 15B:
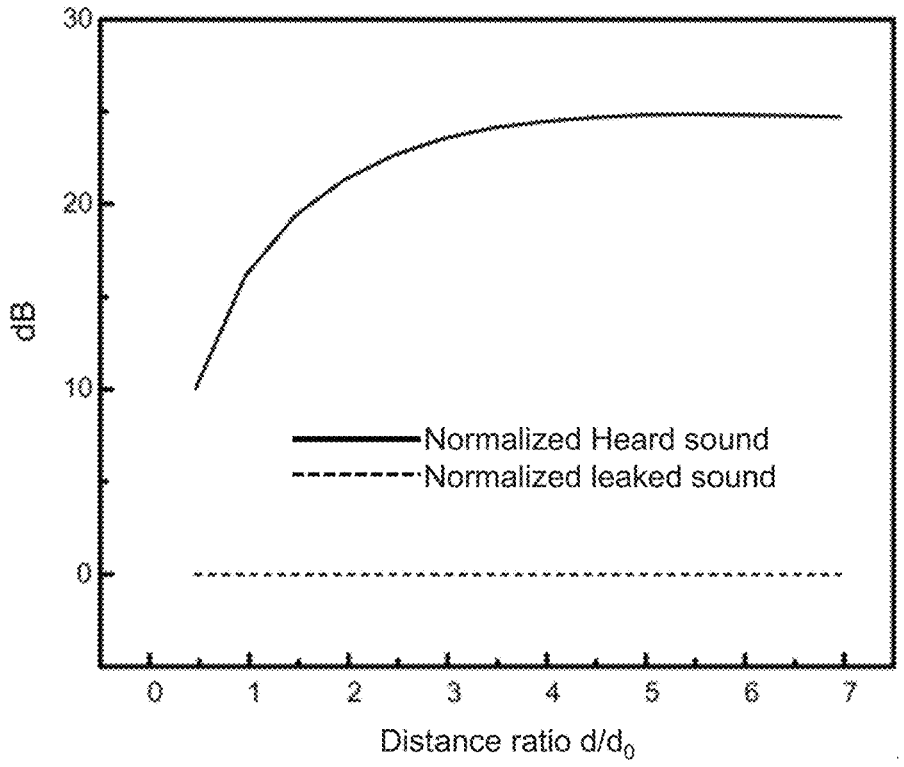
FIG. 15B is another exemplary graph illustrating a volume of the near-field sound and a volume of the far-field leakage as a function of the distance between two point sound sources according to some embodiments of the present disclosure.

FIG. 15A is an exemplary graph illustrating a volume of the near-field sound and a volume of the far-field leakage as a function of the distance between the two point sound sources according to some embodiments of the present disclosure. FIG. 15B is another exemplary graph illustrating a volume of the near-field sound and a volume of the far-field leakage as a function of the distance between the two point sound sources according to some embodiments of the present disclosure.

FIG. 15B is a graph generated by performing a normalization on the graph in FIG. 15A.

In FIG. 15A, a solid line may represent a variation curve of the sound volume of the two-point sound sources as a function of the distance between the two point sound sources, and the dotted line may represent the variation curve of the volume of the leaked sound of the two-point sound sources as a function of the distance between the two point sound sources. The abscissa may represent the distance ratio $d/d_0$ between the distance d of the two-point sound sources and the reference distance $d_0$, the ordinate may represent the sound volume (the unit may be decibel dB). The distance ratio $d/d_0$ may reflect a variation of the distance between the two point sound sources of two-point sound sources. In some embodiments, the reference distance $d_0$ may be selected within a specific range. For example, $d_0$ may be a specific value in the range of 2.5 mm~10 mm, e.g., $d_0$ may be 5 mm. In some embodiments, the reference distance $d_0$ may be determined based on the listening position. For example, the distance between the listening position to the nearest point sound source may be taken as the reference distance $d_0$. It should be known that the reference distance $d_0$ may be flexibly selected from any other suitable values according to the actual conditions, which may be not limited here. Only merely by way of example, in FIG. 15A, $d_0$ may be 5 mm as a reference value for a variation of the distance of the two-point sound sources.

When the sound frequency is constant, the volume of the heard sound and volume of the leaked sound of the two-point sound sources may increase as the distance between the two point sound sources increases. When the distance ratio $d/d_0$ of the two-point sound sources distance d to the reference distance $d_0$ is less than a threshold value, an increase in the volume of the heard sound (i.e., heard sound increment) may be greater than an increase in the volume of the leaked sound (i.e., leaked sound increment) as the distance between two point sound sources increases. That is to say, the increase in the volume of the heard sound may be more significant than the increase in volume of the leaked sound. For example, as shown in FIG. 15A, when the distance ratio $d/d_0$ of the distance d of the two-point sound sources and the reference distance $d_0$ is two, the difference between the volume of the heard sound and the volume of the leaked sound may be about 20 dB. When the distance ratio $d/d_0$ is four, the difference between the volume of the heard sound and the volume of the leaked sound is about 25 dB. In some embodiments, when the distance ratio $d/d_0$ of the distance d of the two-point sound sources to the reference distance $d_0$ reaches a ratio threshold, the ratio of the volume of the heard sound to the volume of the leaked sound of the two-point sound sources may reach a maximum value. At this time, as the distance of the two-point sound sources further increases, the curve of the volume of the heard sound and the curve of the volume of the leaked sound may gradually go parallel, that is, the increase in volume of the heard sound and the increase in volume of the leaked sound may remain the same. For example, as shown in FIG. 15B, when the distance ratio $d/d_0$ of the two-point sound sources is 5, 6, or 7, the difference between the two-point sound sources volume of the heard sound and the volume of the leaked sound may remain the same, both of which may be about 25 dB. That is, the increase in volume of the heard sound may be the same as the increase in volume of the leaked sound. In some embodiments, the ratio threshold of the distance ratio $d/d_0$ of the two-point sound sources may be in the range of 0~7. For example, the ratio threshold of $d/d_0$ may be set in the range of 0.5~4.5. As another example, the ratio threshold of $d/d_0$ may be set in the range of 1~4.

In some embodiments, the ratio threshold value may be determined based on the variation of the difference between the volume of the heard sound and the volume of the leaked sound of the two-point sound sources of FIG. 15A. For example, the ratio corresponding to the maximum difference between the volume of the heard sound and the volume of the leaked sound may be determined as the ratio threshold. As shown in FIG. 15B, when the distance ratio $d/d_0$ is less than the threshold (e.g., four), a curve of normalized heard sound may show an upward trend (the slope of the curve may be larger than zero) as the distance between the two point sound sources increases. That is, the increase in heard sound volume may be greater than the increase in volume of the leaked sound. When the distance ratio $d/d_0$ may is greater than the threshold, the slope of the curve of the normalized heard sound may gradually approach zero as the distance between the two point sound sources increases, and parallel to a curve of normalized leaked sound. That is to say, the increase in volume of the heard sound may be no longer greater than the increase in volume of the leaked sound as the distance between the two point sound sources increases. According to the descriptions above, if the listening position is fixed, the parameters of the two-point sound sources may be adjusted by certain means. It may be possible to achieve the effect that the volume of the near-field sound has a significant increase while the volume of the far-field leakage only increases slightly (i.e., the increase in the volume of the near-field sound may be greater than the volume of the far-field leakage). For example, two or more groups of two-point sound sources (such as a set of high-frequency groups of two-point sound sources and a set of low-frequency groups of two-point sound sources) are set, and the distance of each group of two-point sound sources are adjusted by a certain means, so that the distance of the high-frequency group of two-point sound sources may be less than the distance of the low-frequency group of two-point sound sources. Since the low-frequency group of two-point sound sources has a small sound leakage (the capability to reduce the sound leakage may be strong), the high-frequency group of two-point sound sources has large sound leakage (the capability to reduce the sound leakage may be weak). The volume of the heard sound may be significantly greater than the volume of the leaked sound if a smaller distance between the two point sound sources may be set in the high-frequency band, thereby reducing the sound leakage.

In some embodiments, there may be a certain distance between two sound guiding holes corresponding to each group of acoustic drivers, and the certain distance may affect the volume of the near-field sound transmitted to the wearer's ears and the volume of the far-field leakage transmitted to the environment by the speaker. In some embodiments, when the distance between the sound guiding holes corresponding to the high-frequency acoustic driver is less than the distance between the sound guiding holes corresponding to the low-frequency acoustic driver, the volume of the sound heard by the user may be increased, and the sound leakage may be reduced, thereby preventing the sound from being heard by others near the user of the speaker. According to the above description, the speaker may be effectively used as an open earphone even in a relatively quiet environment.

Figure 16:
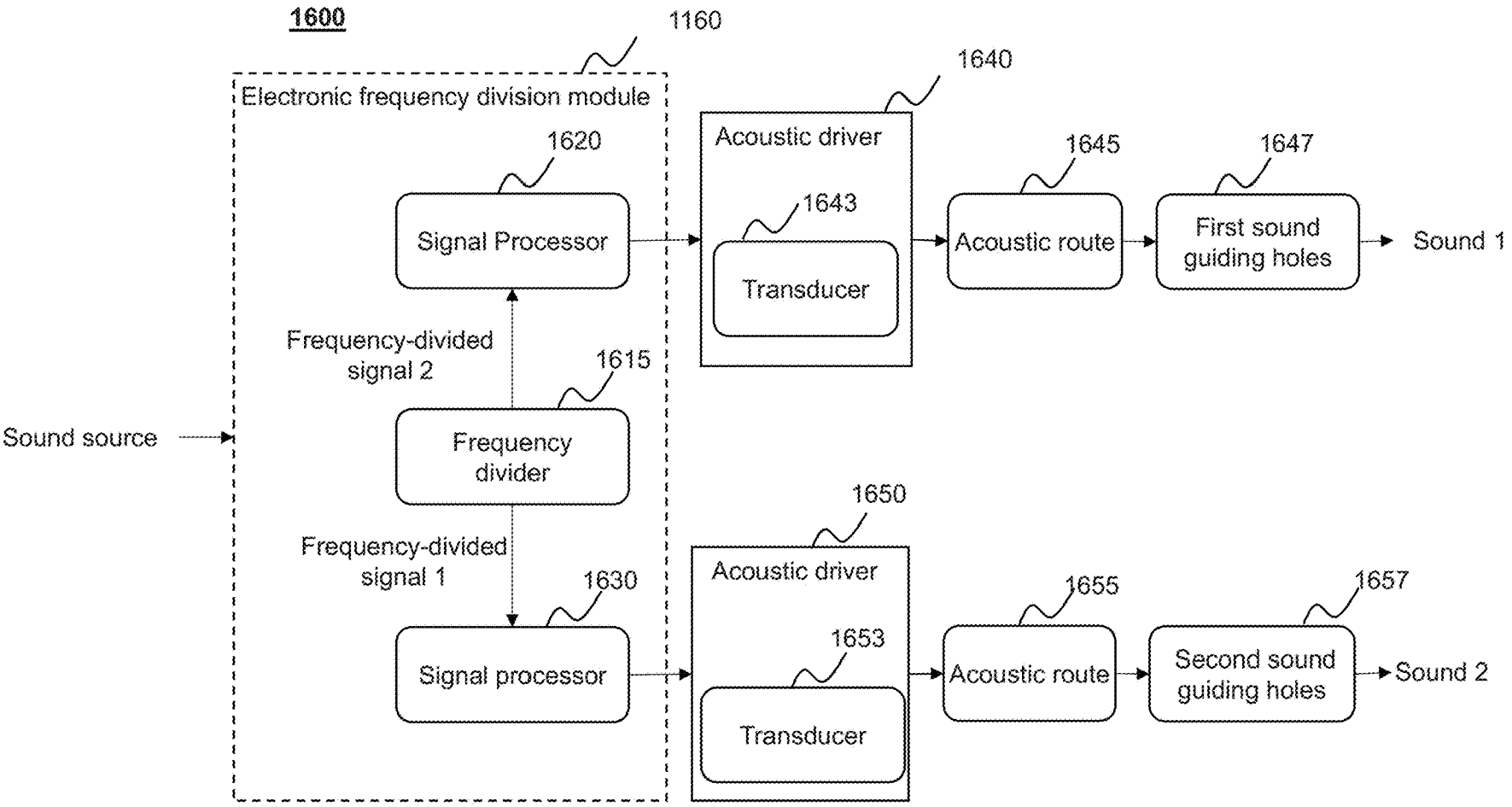
FIG. 16 is a schematic diagram illustrating an exemplary speaker according to some embodiments of the present disclosure.

FIG. 16 is a schematic diagram illustrating an exemplary speaker according to some embodiments of the present disclosure. As shown in FIG. 16, the speaker 1600 may include an electronic frequency division module 1610, at least one acoustic driver (e.g., an acoustic driver 1640, an acoustic driver 1650, etc.) an acoustic route 1645, an acoustic route 1655, at least two first sound guiding holes 1647, and at least two second sound guiding holes 1657. In some embodiments, the speaker 1600 may further include a controller (not shown in the figure). The electronic frequency division module 1610, as part of the controller, may be configured to generate electrical signals that are input into different acoustic drivers. The connection between different components in the speaker 1600 may be wired or wireless. For example, the electronic frequency division module 1610 may send signals to the acoustic driver 1640 and/or the acoustic driver 1650 through a wired transmission or a wireless transmission.

The electronic frequency division module 1610 may divide the frequency of a source signal. The source signal may come from one or more sound source apparatuses (for example, a memory storing audio data) integrated in the speaker 1600. The source signal may also be an audio signal that the speaker 1600 received by a wired or wireless means. In some embodiments, the electronic frequency division module 1610 may decompose the input source signal into two or more frequency-divided signals containing different frequencies. For example, the electronic frequency division module 1610 may decompose the source signal into a first frequency-divided signal (or frequency-divided signal 1) with high-frequency sound and a second frequency-divided signal (or frequency-divided signal 2) with low-frequency sound. For convenience, a frequency-divided signal with high-frequency sound may be referred to as a high-frequency signal, and a frequency-divided signal with low-frequency sound may be directly referred to as a low-frequency signal.

For the purposes of description, the low-frequency signal described in the present disclosure may refer to sound signal with a frequency in a lower first frequency range. The high-frequency signal may refer to sound signal with a frequency in a higher second frequency range. The first frequency range and the second frequency range may or may not include overlapping frequency ranges. The second frequency range includes frequencies higher than the first frequency range. Merely by way of example, the first frequency range may refer to frequencies below the first frequency threshold. The second frequency range may refer to frequencies above the second frequency threshold. The first frequency threshold may be lower than the second frequency threshold, equal to the second frequency threshold, or higher than the second frequency threshold. For example, the first frequency threshold may be lower than the second frequency threshold (for example, the first frequency threshold may be 600 Hz and the second frequency threshold may be 700 Hz). That may mean there is no overlapping between the first frequency range and the second frequency range. As another example, the first frequency threshold may be equal to the second frequency (for example, both the first frequency threshold and the second frequency threshold may be 650 Hz or any other frequency values). As another example, the first frequency threshold may be higher than the second frequency threshold. That may indicate there is an overlapping between the first frequency range and the second frequency range. In this case, the difference value between the first frequency threshold and the second frequency threshold may not exceed a third frequency threshold. The third frequency threshold may be a fixed value, for example, 20 Hz, 50 Hz, 100 Hz, 150 Hz, or 200 Hz. The third frequency threshold may also be a value related to the first frequency threshold and/or the second frequency threshold (for example, 5%, 10%, 15%, etc. of the first frequency threshold). The third frequency threshold may be a value flexibly set by the user according to the actual scene, which is not limited here. It should be noted that the first frequency threshold and the second frequency threshold may be flexibly set according to different situations, and are not limited herein.

In some embodiments, the electronic frequency division module 1610 may include a frequency divider 1615, a signal processor 1620, and a signal processor 1630. The frequency divider 1615 may be used to decompose the source signal into two or more frequency-divided signals containing different frequency components. For example, a frequency-divided signal 1 with a high-frequency sound component and a frequency-divided signal 2 with a low-frequency sound component. In some embodiments, the frequency divider 1615 may be an electronic device that may implement the signal decomposition function, including but not limited to one of a passive filter, an active filter, an analog filter, a digital filter, or any combination thereof. In some embodiments, the signal processor 1620 or 1630 may include one or more signal processing components. For example, the signal processor may include, but not limited to, an amplifier, an amplitude modulator, a phase modulator, a delayer, or a dynamic gain controller, or the like, or any combination thereof. Merely by way of example, the processing of the sound signal by the signal processor 1620 and/or the signal processor 1630 may include adjusting the amplitude corresponding to some frequencies in the sound signal. Specifically, in a case where the first frequency range and the second frequency range overlap, the signal processors 1620 and 1630 may adjust the intensity of the sound signal corresponding to the frequency in the overlapping frequency range (for example, reduce the amplitude of the signal corresponding to the frequency in the overlapping frequency range). This is to avoid excessive volume in the overlapping frequency range in the subsequent output sound caused by the superposition of multiple sound signals.

After the processing operations are performed by the signal processor 1620 or 1630, the frequency-divided signals may be transmitted to the acoustic drivers 1640 and 1650, respectively. In some embodiments, the sound signal transmitted into the acoustic driver 1640 may be a sound signal including a lower frequency range (e.g., the first frequency range). Therefore, the acoustic driver 1640 may also be referred to as a low-frequency acoustic driver. The sound signal transmitted into the acoustic driver 1650 may be a sound signal including a higher frequency range (e.g., the second frequency range). Therefore, the acoustic driver 1650 may also be referred to as a high-frequency acoustic driver. The acoustic driver 1640 and the acoustic driver 1650 may convert sound signals into a low-frequency sound and a high-frequency sound, respectively, then propagate the converted signals outwards.

In some embodiments, the acoustic driver 1640 may be acoustically coupled to at least two first sound guiding holes (such as two first sound guiding holes 1647) (for example, connected to the two first sound guiding holes 1647 via two acoustic routes, respectively). Then the acoustic driver 1640 may propagate sound through the at least two first sound guiding holes. The acoustic driver 1650 may be acoustically coupled to at least two second sound guiding holes (such as two second sound guiding holes 1657) (For example, connected to the two second sound guiding holes 1657 via two acoustic routes, respectively). Then the acoustic driver 1650 may propagate sound through the at least two second sound guiding holes. In some embodiments, in order to reduce the far-field leakage of the speaker 1600, the acoustic driver 1640 may be used to generate low-frequency sounds with equal (or approximately equal) amplitude and opposite (or approximately opposite) phases at the at least two first sound guiding holes, respectively. The acoustic driver 1650 may be used to generate high-frequency sounds with equal (or approximately equal) amplitude and opposite (or approximately opposite) phases at the at least two second sound guiding holes, respectively. In this way, the far-field leakage of low-frequency sounds (or high-frequency sounds) may be reduced according to the principle of acoustic interference cancellation. According to the FIG. 14, FIG. 15A and FIG. 15B, further considering that the wavelength of the low-frequency sound is longer than that of the high-frequency sound, and in order to reduce the interference cancellation of the sound in the near-field (for example, the position of the user's ear), the distance between the first sound guiding holes and the distance between the second sound guiding holes may be set to be different values. For example, assuming that there is a first distance between the two first sound guiding holes and a second distance between the two second sound guiding holes, the first distance may be longer than the second distance. In some embodiments, the first distance and the second distance may be arbitrary values. Merely by way of example, the first distance may not be longer than 40 mm. For example, in the range of 20 mm-40 mm. The second distance may not be longer than 7 trim, for example, in the range of 3 mm-7 mm. More details of the first distance and second distance may be disclosed elsewhere in the present disclosure (such as FIG. 17 and the descriptions thereof).

As shown in FIG. 16, the acoustic driver 1640 may include a transducer 1643. The transducer 1643 may transmit sound to the first sound guiding holes 1647 through the acoustic route 1645. The acoustic driver 1650 may include a transducer 1653. The transducer 1653 may transmit sound to the second sound guiding holes 1657 through the acoustic route 1655. In some embodiments, the transducer may include, but not limited to, a transducer of a gas-conducting speaker, a transducer of a bone-conducting speaker, a hydroacoustic transducer, an ultrasonic transducer, or the like, or any combination thereof. In some embodiments, the transducer may be of a moving coil type, a moving iron type, a piezoelectric type, an electrostatic type, or a magneto strictive type, or the like, or any combination thereof.

In some embodiments, the acoustic drivers (such as the low-frequency acoustic driver 1640, the high-frequency acoustic driver 1650) may include transducers with different properties or numbers. For example, each of the low-frequency acoustic driver 1640 and the high-frequency acoustic driver 1650 may include a transducer having different frequency response characteristics (such as a low-frequency speaker unit and a high-frequency speaker unit). As another example, the low-frequency acoustic driver 1640 may include two transducers (such as two of the low-frequency speaker units), and the high-frequency acoustic driver 1650 may include two transducers 1653 (such as two of the high-frequency speaker units).

In some alternative embodiments, the speaker 1600 may generate sound with different frequency ranges by other means, for example, transducer frequency division, acoustic route frequency division, or the like. When the speaker 1600 uses a transducer or an acoustic route to divide the sound, the electronic frequency division module 1610 (the part inside the dotted frame) may be omitted. The sound source signal may be input to the acoustic driver 1640 and the acoustic driver 1650, respectively.

In some embodiments, the speaker 1600 may use a transducer to achieve signal frequency division. The acoustic driver 1640 and the acoustic driver 1650 may convert the input sound source signal into a low-frequency signal and a high-frequency signal, respectively. Specifically, through the transducer 1643 (such as a low-frequency speaker), the low-frequency acoustic driver 1640 may convert the source signal into the low-frequency sound with a low-frequency component. The low-frequency sound may be transmitted to the at least two first sound guiding holes 1647 along at least two different acoustic routes. Then the low-frequency sound may be propagated outwards through the first sound guiding holes 1647. Through the transducer 1653 (such as a high-frequency speaker), the high-frequency acoustic driver 1650 may convert the source signal into the high-frequency sound with high-frequency components. The high-frequency sound may be transmitted to the at least two second sound guiding holes 1657 along at least two different acoustic routes. Then the high-frequency sound may be propagated outwards through the second sound guiding holes 1657.

In some alternative embodiments, an acoustic route (e.g., the acoustic route 1645 and the acoustic route 1655) connecting a transducer and sound guiding holes may affect the nature of the transmitted sound. For example, an acoustic route may attenuate or change the phase of the transmitted sound to some extent. In some embodiments, an acoustic route may include a sound tube, a sound cavity, a resonance cavity, a sound hole, a sound slit, or a tuning network, or the like, or any combination thereof. In some embodiments, the acoustic route may also include an acoustic resistance material, which may have a specific acoustic impedance. For example, the acoustic impedance may be in the range of 5MKS Rayleigh to 500MKS Rayleigh. The acoustic resistance materials may include, but not limited to, plastic, textile, metal, permeable material, woven material, screen material or mesh material, porous material, particulate material, polymer material, or the like, or any combination thereof. By setting the acoustic routes of different acoustic impedances, the acoustic output of the transducer may be acoustically filtered. In this case, the sounds output through different acoustic routes has different frequency components. More descriptions regarding the acoustic routes may be found elsewhere in the present disclosure (e.g., FIGS. 10D-10F and the descriptions thereof).

In some alternative embodiments, the speaker 1600 may utilize acoustic routes to achieve signal frequency division. Specifically, the source signal may be input into a specific acoustic driver and converted into sound containing high and low-frequency components. The sound signal may be propagated along acoustic routes having different frequency selection characteristics. For example, the sound signal may be propagated along the acoustic route with a low-pass characteristic to the corresponding sound guiding hole to generate low-frequency sound. In this process, the high-frequency sound may be absorbed or attenuated by the acoustic route with a low-pass characteristic. Similarly, the sound signal may be propagated along the acoustic route with a high-pass characteristic to the corresponding sound guiding hole to generate high-frequency sound. In this process, the low-frequency sound may be absorbed or attenuated by the acoustic route with the high-pass characteristic.

In some embodiments, the controller in the speaker 1600 may cause the low-frequency acoustic driver 1640 to output sound in the first frequency range (i.e., low-frequency sound), and cause the high-frequency acoustic driver 1650 to output sound in the second frequency range (i.e., high-frequency sound). In some embodiments, the speaker 1600 may also include a supporting structure, e.g., a portion of a housing of the speaker. The supporting structure may be used to carry the acoustic driver (such as the high-frequency acoustic driver 1650, the low-frequency acoustic driver 1640), so that the acoustic driver may be positioned away from the user's ear. In some embodiments, the sound guiding holes acoustically coupled with the high-frequency acoustic driver 1650 may be located closer to an expected position of the user's ear (for example, the ear canal entrance), while the sound guiding hole acoustically coupled with the low-frequency acoustic driver 1640 may be located further away from the expected position. In some embodiments, the supporting structure may be used to package the acoustic driver. The supporting structure of the packaged acoustic driver may be a casing made of various materials such as plastic, metal, and tape. The casing may encapsulate the acoustic driver and form a front chamber and a rear chamber corresponding to the acoustic driver. The front chamber may be acoustically coupled to one of the at least two sound guiding holes. The rear chamber may be acoustically coupled to the other of the at least two sound guiding holes. For example, the front chamber of the low-frequency acoustic driver 1640 may be acoustically coupled to one of the at least two first sound guiding holes 1647. The rear chamber of the low-frequency acoustic driver 1640 may be acoustically coupled to the other of the at least two first sound guiding holes 1647. The front chamber of the high-frequency acoustic driver 16:50 may be acoustically coupled to one of the at least two second sound guiding holes 16:57. The rear chamber of the high-frequency acoustic driver 1650 may be acoustically coupled to the other of the at least two second sound guiding holes 16:57. In some embodiments, the sound guiding holes (such as the first sound guiding holes 1647 and the second sound guiding holes 1657) may be disposed on the casing.

In some embodiments, the at least one acoustic driver (e.g., the acoustic driver 1640, the acoustic driver 1650, etc.) may further be configured to generate vibrations by a transducer of the at least one acoustic driver. The vibrations may produce a sound wave inside the housing of the speaker 1600 and cause a leaked sound wave spreading outside the housing from a portion of the housing. The sound wave inside the housing may be guided to the outside of the housing through at least one sound guiding hole. The guided sound wave and the leaked sound wave may have substantially same amplitude and substantially opposite phases in the space, so that the guided sound wave and the leaked sound wave can interfere with each other and the sound leakage of the speaker 1600 is reduced. More descriptions of which may be found elsewhere in the present disclosure, for example, FIGS. 4A, 4B and 4C and relevant descriptions thereof.

The above description of the speaker 1600 may be merely by way of example. Those skilled in the art may make adjustments and changes to the structure, quantity, etc. of the acoustic driver, which is not limiting in the present disclosure. In some embodiments, the speaker 1600 may include any number of the acoustic driver structures. For example, the speaker 1600 may include two groups of the high-frequency acoustic drivers 150 and two groups of the low-frequency acoustic drivers 1640, or one group of the high-frequency acoustic drivers 1650 and two groups of the low-frequency acoustic drivers 1640, and these high-frequency/low-frequency drivers may be used to generate sound in a specific frequency range. As another example, the acoustic driver 1640 and/or the acoustic driver 1650 may include an additional signal processor. The signal processor may have the same or different structural components as the signal processor 1620 or 1630.

It should be noted that the speaker and its modules are shown in FIG. 16 may be implemented in various ways. For example, in some embodiments, the system and the modules may be implemented by hardware, software, or a combination of both. The hardware may be implemented by a dedicated logic. The software may be stored in the storage which may be executed by a suitable instruction execution system, for example, a microprocessor or dedicated design hardware. It will be appreciated by those skilled in the art that the above methods and systems may be implemented by computer-executable instructions and/or embedded in the control codes of a processor. For example, the control codes may be provided by a medium such as a disk, a CD or a DVD-ROM, a programmable memory device, such as a read-only memory (e.g., firmware), or a data carrier such as an optical or electric signal carrier. The system and the modules in the present disclosure may be implemented not only by a hardware circuit in a programmable hardware device in an ultra-large scale integrated circuit, a gate array chip, a semiconductor such a logic chip or a transistor, a field programmable gate array, or a programmable logic device. The system and the modules in the present disclosure may also be implemented by software to be performed by various processors, and further also by a combination of hardware and software (e.g., firmware).

It should be noted that the above description of the speaker 1600 and its components is only for the convenience of description, and not intended to limit the scope of the present disclosure. It may be understood that, for those skilled in the art, after understanding the principle of the apparatus, it is possible to combine each unit or form a substructure to connect with other units arbitrarily without departing from this principle. For example, the electronic frequency division module 1610 may be omitted, and the frequency division of the source signal may be implemented by the internal structure of the low-frequency acoustic driver 1640 and/or the high-frequency acoustic driver 1650. As another example, the signal processor 1620 or 1630 may be a part independent of the electronic frequency division module 1610. Those modifications may fall within the scope of the present disclosure.

Figure 17:
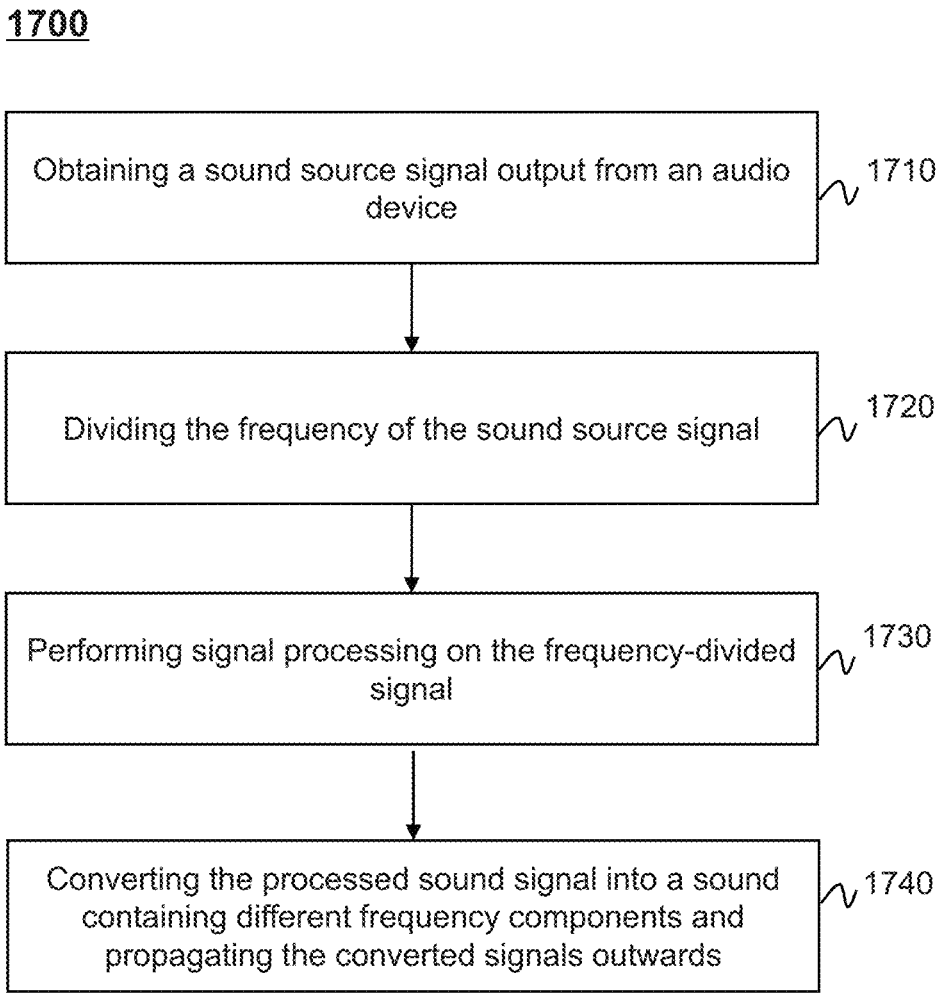
FIG. 17 is a flowchart illustrating an exemplary process for acoustic output according to some embodiments of the present disclosure.

FIG. 17 is a flowchart illustrating an exemplary process for acoustic output according to some embodiments of the present disclosure. In some embodiments, process 1700 may be executed by the speaker (e.g., the speaker 1600) disclosed in the present disclosure. The process 1700 may be implemented as a set of instructions (e.g., an application program) stored in a storage device (e.g., ROM or RAM). A processing device (e.g., CPU and/or engine) in the speaker may execute the set of instructions. When the processing device executes the instruction, it may cause one or more components in the speaker to execute the process 1700. The operations of the illustrated process presented below are intended to be illustrative. In some embodiments, the process 1700 may be accomplished with one or more additional operations not described and/or without one or more of the operations discussed in the present disclosure. In addition, the order in which the operations of the process as illustrated in FIG. 17 and described below is not intended to be limiting. For the purpose of illustration, the following takes the speaker 1600 as an example to describe the implementation of the process 1700.

In 1710, the speaker 1600 may obtain a sound source signal output from an audio device.

In some embodiments, the speaker 1600 may be connected to the audio device via a wired (for example, connected through a data cable) or wireless (for example, connected through a Bluetooth connection) connection, and receives the sound source signal. The audio device may include mobile devices, such as computers, mobile phones, wearable devices, or other carriers that may process or store the sound source data.

In 1720, the speaker 1600 may divide the frequency of the sound source signal.

The sound source signal may be decomposed into two or more sound signals containing different frequency components after the frequency division processing. For example, the sound source signal may be decomposed into a low-frequency signal with a low-frequency sound component and a high-frequency signal with a high-frequency sound component. In some embodiments, the low-frequency signal may refer to a sound signal with a frequency in a lower first frequency range, and the high-frequency signal may refer to a sound signal having a frequency in a higher second frequency range. In some embodiments, the first frequency range may include frequencies below 650 Hz, and the second frequency range may include frequencies above 1000 Hz. In some embodiments, the first frequency range may refer to frequencies below the first frequency threshold, and the second frequency range may refer to frequencies above the second frequency threshold. In some embodiments, the first frequency threshold may be lower than, equal to, or higher than the second frequency threshold. For example, the first frequency threshold may be 700 Hz, and the second frequency range is 800 Hz. More details of the high-frequency and low-frequency signals may be disclosed elsewhere in the present disclosure (such as FIG. 16 and the descriptions thereof).

In some embodiments, speaker 1600 may divide the sound source signal through the electronic frequency division module 1610. For example, the sound source signal may be decomposed into one or more groups of high-frequency signals and one or more groups of low frequency signals by the electronic frequency division module 1610.

In some embodiments, the speaker 1600 may divide the sound source signal based on one or more frequency division points. The frequency division point may refer to a signal frequency distinguishing the first frequency range and the second frequency range. For example, when there is an overlapping frequency between the first frequency range and the second frequency range, the frequency division point may be a feature point within the overlapping frequency range (for example, a low-frequency boundary point, a high-frequency boundary point, a center frequency point, etc of the overlapping frequency range). In some embodiments, the frequency division point may be determined according to a relationship between the frequency and the sound leakage of the speaker (for example, the curves shown in FIG. 14, FIGS. 15A and 15B). For example, considering that the acoustic leakage of the speaker changes with the frequency, the frequency point corresponding to the volume of the leaked sound satisfying a certain condition may be selected as the frequency division point, for example, 1000 Hz shown in FIG. 14. For more details about the change of the sound leakage volume with frequency, please refer to FIG. 14 and the descriptions thereof, which will not be repeated here. In some alternative embodiments, the user may specify a specific frequency as the frequency division point directly. For example, considering that the frequency range of sounds that the human ear may hear is 20 Hz 20 kHz, the user may select a frequency point in this range as the frequency division point. For example, the frequency division point may be 600 Hz, 800 Hz, 1000 Hz, 1200 Hz, or the like. In some embodiments, the frequency division point may be determined based on the performance of the acoustic driver. For example, considering that a low-frequency acoustic driver and a high-frequency acoustic driver have different frequency response curves, the frequency division point may be selected within a frequency range. The frequency range is above ½ of the higher limit frequency of the low-frequency acoustic driver and below two times the lower limit frequency of the high-frequency acoustic driver. More preferably, the frequency division point may be selected in a frequency range above ⅓ of the higher limit frequency of the low-frequency acoustic driver and below 1.5 times the lower limit frequency of the high-frequency acoustic driver.

In 1730, the speaker 1600 may perform signal processing on the frequency-divided signal.

In some embodiments, the speaker 1600 may further process the frequency-divided signals (such as high-frequency signals and low-frequency signals) to meet the requirements of the subsequent output of sound. For example, the speaker 1600 may further process the frequency-divided signal through a signal processor (such as the signal processor 1620, the signal processor 1630, or the like). The signal processor may include one or more signal processing components. For example, the signal processor may include, but not limited to, an amplifier, an amplitude modulator, a phase modulator, a delayer, a dynamic gain controller (DRC), or the like, or any combination thereof. Merely by way of example, the processing of the frequency-divided signal by the signal processor may include adjusting the amplitude corresponding to some frequencies in the frequency-divided signal. Specifically, in the case where the first frequency range and the second frequency range overlap, the signal processor may adjust the intensity (amplitude) of the sound signal corresponding to the frequency in the overlapping frequency range to avoid excessive volume in the overlapping frequency range in the subsequent output sound caused by the superposition of multiple sound signals.

In 1740, the speaker 1600 may convert the processed sound signal into a sound containing different frequency components, then propagate the converted signals outwards.

In some embodiments, the speaker 1600 may output sound through the acoustic driver 1640 and/or the acoustic driver 1650. In some embodiments, the acoustic driver 1640 (such as the transducer 1643) may output a low-frequency sound only containing low-frequency sound components, and the acoustic driver 1650 (such as the transducer 1653) may output a high-frequency sound only containing high-frequency sound components.

In some embodiments, the acoustic driver 1640 may propagate low-frequency sound through at least two first sound guiding holes 1647, and the acoustic driver 1650 may propagate high-frequency sound through at least two second sound guiding holes 1657. The sound guiding hole may be a small hole formed on the speaker with a specific opening and allowing sound to pass. The shape of the sound guiding hole may include, but not limited to, one of a circle shape, an oval shape, a square shape, a trapezoid shape, a rounded quadrangle shape, a triangle shape, an irregular shape, or any combination thereof. In addition, the number (or count) of sound guiding holes connected to the acoustic driver 1640 or 1650 may not be limited to two, which may be an arbitrary value instead, for example, three, four, six, or the like. In some embodiments, the acoustic route between the same acoustic driver and its corresponding different sound guiding hole may be designed according to different situations. For example, by setting the shape and/or size of the first sound guiding hole (or the second sound guiding hole), or by setting a lumen structure or acoustically damping material with a certain damping in the acoustic route, the acoustic route between the same acoustic driver and its corresponding different sound guiding hole may be configured to have approximately same equivalent acoustic impedance. In this case, as the same acoustic driver outputs two groups of sounds with the same amplitude and opposite phases, these two groups of sound may still have the same amplitude and opposite phase when they reach the corresponding sound guiding hole through different acoustic routes.

In combination with the structure of the speaker described in FIG. 16, the acoustic driver 1640 may propagate two groups of low-frequency sound signals with opposite phases through the first sound guiding holes of the front chamber and the rear chamber. The acoustic driver 1650 may output two groups of high-frequency sound signals with opposite phases through the second sound guiding hole of the front chamber and the rear chamber, respectively. Based on this, the acoustic drivers 1640 and 1650 constitute a low-frequency group of two-point sound sources and a high-frequency group of two-point sound sources, respectively. In this way, based on the principle of acoustic interference cancellation, the low-frequency group of two-point sound sources (or high-frequency group of two-point sound sources) far-field leakage may be reduced.

Further considering that the wavelength of the low-frequency sound is longer than that of the high-frequency sound, and in order to reduce the interference cancellation of the sound in the near-field (for example, the position of the user's ear), the distance between the first sound guiding holes and the distance between the second sound guiding holes may be set to be different values. In some embodiments, as the first distance between the two first sound guiding holes corresponding to the low-frequency acoustic driver 1640 becomes larger, the increase of the near-field listening volume of the speaker is greater than the increase of the far-field sound leakage, which may enhance near-field sound and suppress lower far-field leakage in the low-frequency range. In addition, the second distance between the two second sound guiding holes corresponding to the high-frequency acoustic driver 1650 is reduced. Although it may affect the near-field volume in the high-frequency range to some extent, it may significantly reduce the far-field leakage in the high-frequency range. Therefore, by properly designing the distance between the high-frequency group of two-point sound sources (i.e., the two second sound guiding holes) and the distance between the low-frequency group of two-point sound sources (i.e., the two first sound guiding holes), which may make the two-point sound sources more powerful than the single point sound source (corresponding to a single sound guiding hole) in reducing leakage. For comparison of the leakage intensity of single point sound source and double-point sound source, please refer to FIG. 14 and the descriptions thereof.

For the purpose of illustration, there is a first distance of the two first sound guiding holes and a second distance of the two second sound guiding holes, and the first distance may be longer than the second distance. In some embodiments, the first distance and the second distance may be arbitrary values. Merely by way of example, the first distance may not be shorter than 8 mm, the second distance may not be longer than 12 mm, and the first distance may be longer than the second distance. Preferably, the first distance may not be shorter than 10 mm, the second distance may not be longer than 12 mm, and the first distance may be greater than the second distance. More preferably, the first distance may not be shorter than 12 mm, and the second distance may not be longer than 10 mm. More preferably, the first distance may not be shorter than 15 mm, and the second distance may not be longer than 8 mm. More preferably, the first distance may not be shorter than 20 mm, and the second distance may not be longer than 8 mm. More preferably, the first distance may not be shorter than 30 mm, and the second distance may not be longer than 7 mm. Further preferably, the first distance may be in a range of 20 mm-40 mm, and the second distance may be in a range of 3 mm-7 mm. As another example, the first distance may be at least twice the second distance. Preferably, the first distance may be at least three times the second distance. Preferably, the first distance may be at least 5 times the second distance.

In some alternative embodiments, other feasible methods may be used to adjust the parameters of the two-point sound sources to improve the speaker and reduce the far-field sound leakage capability, which is not limited by the present disclosure. For example, the amplitude of each point of the two-point sound sources may be adjusted (that is, the amplitude of the sound at each sound guiding hole) so that the amplitude of each point of the two-point sound sources is not exactly same. As another example, the phase difference between two-point sound sources of may be adjusted. Preferably, in order to achieve a better leakage reduction effect, the phase difference between the two-point sound sources may be 180 degrees (that is, the sounds output at the two sound guiding holes have opposite phases). In some other embodiments, the sounds output by the two-point sound sources may have other amplitude or phase relationships. In some embodiments, more groups of different frequency components may also be output through multiple groups of two-point sound sources.

It should be noted that the description of the process 1700 is for example and illustration only, and does not limit the scope of application of the present disclosure. For those skilled in the art, various modifications and changes may be made to the process 1700 under the guidance of the present disclosure. However, these amendments and changes are still within the scope of the present disclosure. For example, the frequency-divided signal processing in operation 1730 may be omitted, and the frequency-divided signal may be directly output to the external environment through a sound guiding hole. As another example, operation 1730 may be performed before operation 1720, that is, first perform signal processing on the sound source signal, and then perform frequency division. In some embodiments, the speaker 1600 may utilize a transducer in the acoustic driver to achieve signal frequency division (e.g., transducer 1643 and/or 1653). For example, the speaker 1600 may be provided with a low-frequency speaker unit and a high-frequency speaker unit having different frequency response characteristics. The low-frequency speaker unit may directly convert the sound source signal into a sound only containing low-frequency components, and the high-frequency speaker unit may directly convert the sound source signal into a sound only containing high-frequency components. In some embodiments, the speaker 1600 may utilize acoustic routes to achieve signal frequency division (e.g., acoustic mute 1645 and/or 1655). For example, the speaker 1600 may set the frequency selection characteristics of the acoustic route (e.g., the acoustic route 1645 may pass low-frequency sound but block high-frequency sound, the acoustic route 1655 may pass high-frequency sound but block low-frequency sound). The sound generated by the acoustic driver passed the acoustic route with low-pass characteristics may become a low-frequency sound. The sound generated by the acoustic driver passed the acoustic route with high-pass characteristics may become high-frequency sound. In some embodiments, the frequency division processing of the sound source signal may be implemented by the combination of the two or more ways. Optionally, the frequency division processing of the sound source signal may also be implemented through other feasible ways, which is not limiting in the present disclosure.

Figure 18A:
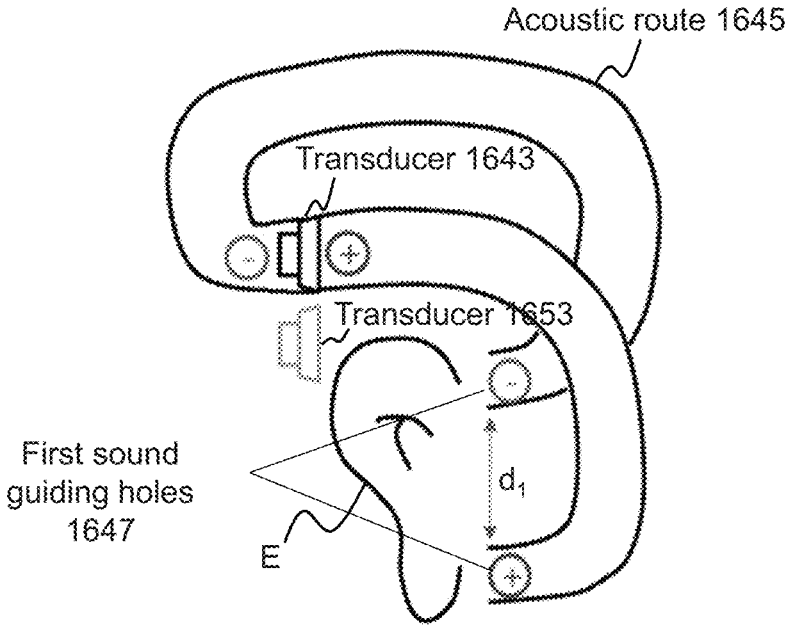
FIG. 18A is a schematic diagram illustrating an exemplary speaker according to some embodiments of the present disclosure.
Figure 18B:
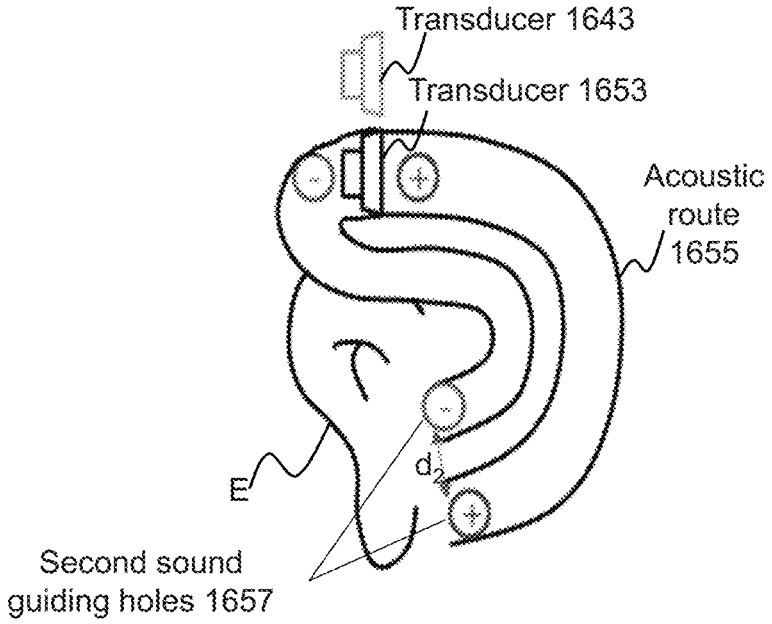
FIG. 18B is a schematic diagram illustrating an exemplary speaker according to some embodiments of the present disclosure.

FIG. 18A is a schematic diagram illustrating an exemplary speaker according to some embodiments of the present disclosure. FIG. 18B is a schematic diagram illustrating an exemplary speaker according to some embodiments of the present disclosure.

FIGS. 18A and 18B illustrate simplified representations of an acoustic driver in the speaker. For the purpose of illustration, the outward propagating sound formed by the same transducer coupled with different sound guiding holes may be described as an example. In FIG. 18A and FIG. 18B, each transducer may have a front side and a rear side, and corresponding front chamber (i.e., the first acoustic route) and rear chamber (i.e., the second acoustic route) structures may exist on the front or rear side of the transducer, respectively. In some embodiments, these structures may have the same or approximately the same equivalent acoustic impedance, such that the transducers may be loaded symmetrically. The symmetrical load of the transducer may form sound sources satisfy an amplitude and phase relationship at different sound guiding holes (such as the "two-point sound sources" having the same amplitude and opposite phases as described above), such that a specific sound field may be formed in high-frequency and/or low-frequency (for example, the near-field sound may be enhanced and the far-field leakage may be suppressed).

As shown in FIGS. 18A and 18B, the acoustic driver (for example, the acoustic driver 1640 or 1650) may include transducers, and acoustic routes and sound guiding holes connected to the transducer. In order to describe the actual application scenarios of the acoustic driver more clearly, a position of the user's ear E may also be shown in FIGS. 18A and 18B for the explanation. FIG. 18A illustrates an application scenario of the acoustic driver 1640. The acoustic driver 1640 may include a transducer 1643, and the transducer 1643 may be coupled with two first sound guiding holes 1647 through an acoustic route 1645. FIG. 18B illustrates an application scenario of the acoustic driver 1650. The acoustic driver 1650 may include a transducer 1653, and the transducer 1653 may be coupled with two second sound guiding holes 1657 through an acoustic route 1655.

The transducer 1643 or 1653 may vibrate under the driving of an electric signal, and the vibration may generate sound with equal amplitudes and opposite phases (180 degrees inversion). The type of transducer may include, but not limited to, one of an air conduction speaker, a bone conduction speaker, a hydroacoustic transducer, an ultrasonic transducer, or the like, or any combination thereof. The transducer may be of a moving coil type, a moving iron type, a piezoelectric type, an electrostatic type, a magneto strictive type, or the like, or any combination thereof. In some embodiments, the transducer 1643 or 1653 may include a vibration diaphragm, which may vibrate when driven by an electrical signal, and the front and rear sides of the vibration diaphragm may simultaneously output a normal-phase sound and a reverse-phase sound. In FIGS. 18A and 18B, "+" and "—" may be used to exemplify sounds with different phases, wherein "+" may represent a normal-phase sound, and "—" may represent a reverse-phase sound.

In some embodiments, the transducer may be encapsulated by a casing on a supporting structure, and the interior of the casing may be provided with sound channels connected to the front and rear sides of the transducer, respectively, thereby forming an acoustic route. For example, the front cavity of the transducer 1643 may be coupled to one of the two first sound guiding holes 1647 through a first acoustic route (i.e., the first half of the acoustic route 1645), and the rear cavity of the transducer 1643 may acoustically be coupled to the other sound guiding hole of the two first sound guiding holes 1647 through a second acoustic route (i.e., the second half of the acoustic route 1645). Normal-phase sound and reverse-phase sound that output from the transducer 1643 may be output from the two first sound guiding holes 1647, respectively. As another example, the front cavity of the transducer 1653 may be coupled to one of the two sound guiding holes 1657 through a third acoustic route (i.e., the first half of the acoustic route 1655), and the rear cavity of the transducer 1653 may be coupled to another sound guiding hole of the two second sound guiding holes 1657 through a fourth acoustic route (i.e., the second half of the acoustic route 1655). The normal-phase sound and the reverse-phase sound output from the transducer 1653 may be output from the two second sound guiding holes 1657, respectively.

In some embodiments, acoustic routes may affect the nature of the transmitted sound. For example, an acoustic route may attenuate or change the phase of the transmitted sound to some extent. In some embodiments, the acoustic route may be composed of one of a sound tube, a sound cavity, a resonance cavity, a sound hole, a sound slit, a tuning network, or the like, or any combination of. In some embodiments, the acoustic route may also include an acoustic resistance material, which may have a specific acoustic impedance. For example, the acoustic impedance may be in the range of 5MKS Rayleigh to 500MKS Rayleigh. In some embodiments, the acoustic resistance material may include, but not limited to, one of plastics, textiles, metals, permeable materials, woven materials, screen materials, and mesh materials, or the like, or any combination of. In some embodiments, in order to prevent the sound transmitted by the acoustic driver's front chamber and rear chamber from being disturbed (or the same change caused by disturbance), the front chamber and rear chamber corresponding to the acoustic driver may be set to have approximately the same equivalent acoustic impedance. For example, the same acoustic resistance material, the sound guiding holes with the same size or shape, etc., may be used.

The distance between the two first sound guiding holes 1647 of the low-frequency acoustic driver may be expressed as $d_1$ (i.e., the first distance). The distance between the two second sound guiding holes 1657 of the high-frequency acoustic driver may be expressed as $d_2$ (i.e., the second distance). By setting the distance between the sound guiding holes corresponding to the low-frequency acoustic driver and the high-frequency acoustic driver, a higher sound volume output in the low-frequency band and a stronger ability to reduce the sound leakage in the high-frequency band may be achieved. For example, the distance between the two first sound guiding holes 1647 is greater than the distance between the two second sound guiding holes 1657 (i.e., $d_1>d_2$).

In some embodiments, the transducer 1643 and the transducer 1653 may be housed together in a housing of the speaker 1600, and be placed in isolation in a structure of the casing.

In some embodiments, the speaker 1600 may include multiple sets of high-frequency acoustic drivers and low-frequency acoustic drivers. For example, the speaker 1600 may include a group of high-frequency acoustic drivers and a group of low-frequency acoustic drivers for simultaneously outputting sound to the left and/or right ears. As another example, the speaker may include two groups of high-frequency acoustic drivers and two groups of low-frequency acoustic drivers, wherein one group of high-frequency acoustic drivers and one group of low-frequency acoustic drivers may be used to output sound to a user's left ear, and the other set of high-frequency acoustic drivers and low-frequency acoustic drivers may be used to output sound to a user's right ear.

In some embodiments, the high-frequency acoustic driver and the low-frequency acoustic driver may be configured to have different powers. In some embodiments, the low-frequency acoustic driver may be configured to have a first power, the high-frequency acoustic driver may be configured to have a second power, and the first power may be greater than the second power. In some embodiments, the first power and the second power may be arbitrary values. It should be noted that the above description of the components of the speaker 1600 is for convenience of description only, and cannot limit the present disclosure to be within the scope of the illustrated embodiment. It may be understood that, for those skilled in the art, after understanding the principle of the apparatus, it is possible to combine each unit or form a substructure to connect with other units arbitrarily without departing from this principle. For example, the supporting structure of the speaker 1600 may be band-shaped, which is convenient for users to wear on the head.

Figure 19A:
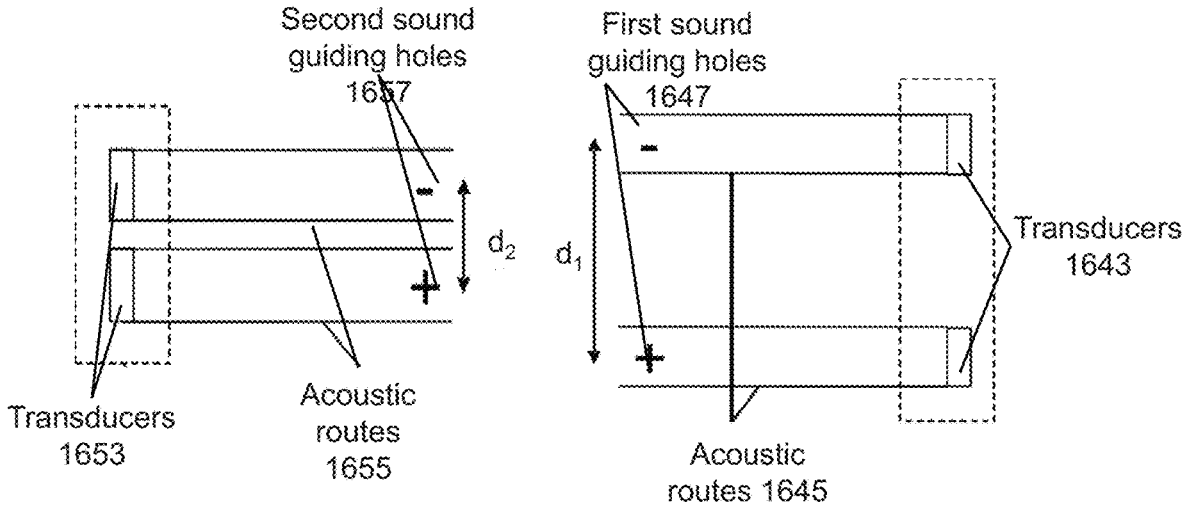
FIG. 19A is a schematic diagram illustrating a process for sound output according to some embodiments of the present disclosure.
Figure 19B:
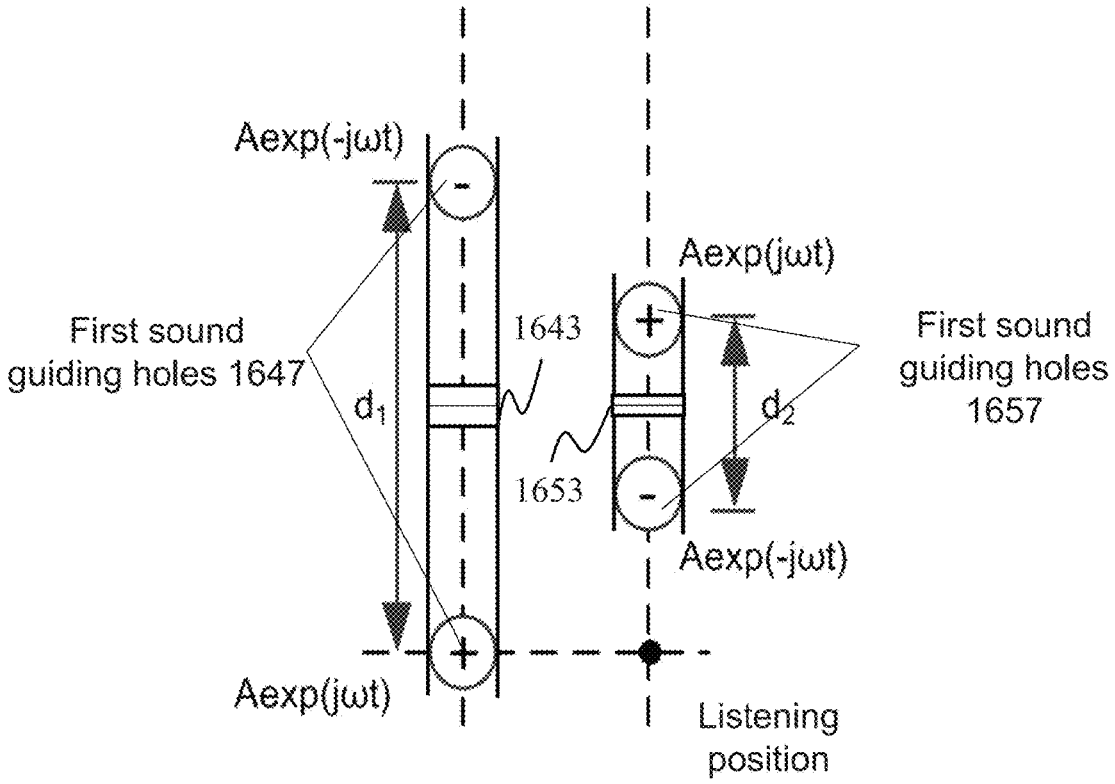
FIG. 19B is a schematic diagram illustrating another process for sound output according to some embodiments of the present disclosure.

FIG. 19A is a schematic diagram illustrating a process for sound output according to some embodiments of the present disclosure. FIG. 19B is a schematic diagram illustrating another process for sound output according to some embodiments of the present disclosure.

In some embodiments, a speaker (e.g., the speaker 1600) may generate sounds in the same frequency range through two or more transducers, and the sounds may propagate outwards through different sound guiding holes. In some embodiments, different transducers may be controlled by the same or different controllers, respectively, and may produce sounds that satisfy, certain phase and amplitude conditions (for example, sounds with the same amplitude but opposite phases, sounds with different amplitudes and opposite phases, etc.). For example, the controller may make the electrical signals input to the two low-frequency transducers of the acoustic driver have the same amplitude and opposite phases. In this way, when a sound is formed, the two low-frequency transducers may output low-frequency sounds with the same amplitude but opposite phases.

Specifically, the two transducers in the acoustic driver (such as the low-frequency acoustic driver 1640 and the high-frequency acoustic driver 1650) may be arranged side by side in a speaker, one of which may be used to output normal-phase sound, and the other may be used to output reverse-phase sound. As shown in FIG. 19A, the acoustic driver 1640 on the right may include two transducers 1643, two acoustic routes 1645, and two first sound guiding holes 1647. The acoustic driver 1650 on the left may include two transducers 1653, two acoustic routes 1655, and two second sound guiding holes 1657. Driven by electrical signals with opposite phases, the two transducers 1643 may generate a set of low-frequency sounds with opposite phases (180 degrees inversion). One of the two transducers 1643 may output normal-phase sound (such as the transducer located below), and the other may output reverse-sound (such as the transducer located above). The two sets of low-frequency sounds with opposite phases may be transmitted to the two first sound guiding holes 1647 along the two acoustic routes 1645, respectively, and propagate outwards through the two first sound guiding holes 1647. Similarly, driven by electrical signals with opposite phases, the two transducers 1653 may generate a set of high-frequency sounds with opposite phases (180 degrees inversion). One of the two transducers may output normal-phase high-frequency sound (such as the transducer located below), and the other may output a reverse-phase high-frequency sound (such as the transducer located above). The high-frequency sound with opposite phases may be transmitted to the two second sound guiding holes 1657 along the two acoustic routes 1655, respectively, and propagate outwards through the two second sound guiding holes 1657.

In some embodiments, the two transducers in the acoustic driver (for example, the low-frequency acoustic driver 1640 and the high-frequency acoustic driver 1650) may be arranged relatively close to each other along the same straight line, and one of them may be used to output a normal-phase sound and the other may be used to output a reverse-sound. As shown in FIG. 19B, the left side may be the acoustic driver 1640, and the right side may be the acoustic driver 1650. The two transducers 1643 of the acoustic driver 1640 may generate a set of low-frequency sounds of equal amplitude and opposite phases under the control of the controller, respectively. One of the transducers may output normal low-frequency sound, and transmit the normal low-frequency sound along a first acoustic route to a first sound guiding hole. The other transducer may output reverse-phase low-frequency sound, and transmit the reverse-phase low-frequency sound along the second acoustic route to another first sound guiding hole. The two transducers 1653 of the acoustic driver 1650 may generate high-frequency sound of equal amplitude and opposite phases under the control of the controller, respectively. One of the transducers may output normal-phase high-frequency sound, and transmit the normal-phase high-frequency sound along a third acoustic route to a second sound guiding hole. The other transducer may output reverse-phase high-frequency sound, and transmit the reverse-phase high-frequency sound along the fourth acoustic route to another second sound guiding hole.

In some embodiments, the transducer 1643 and/or the transducer 1653 may be of various suitable types. For example, the transducer 1643 and the transducer 1653 may be dynamic coil speakers, which may have the characteristics of a high sensitivity in low-frequency, a large dive depth of low-frequency, and a small distortion. As another example, the transducer 1643 and the transducer 1653 may be moving iron speakers, which may have the characteristics of a small size, a high sensitivity, and a large high-frequency range. As another example, the transducers 1643 and 1653 may be air-conducted speakers, or bone-conducted speakers. As another example, the transducer 1643 and the transducer 1653 may be balanced armature speakers. In some embodiments, the transducer 1643 and the transducer 1653 may be different types of transducers. For example, the transducer 1643 may be a moving iron speaker, and the transducer 1653 may be a moving coil speaker. As another example, the transducer 1043 may be a moving coil speaker, and the transducer 1053 may be a moving iron speaker.

Figure 1A:
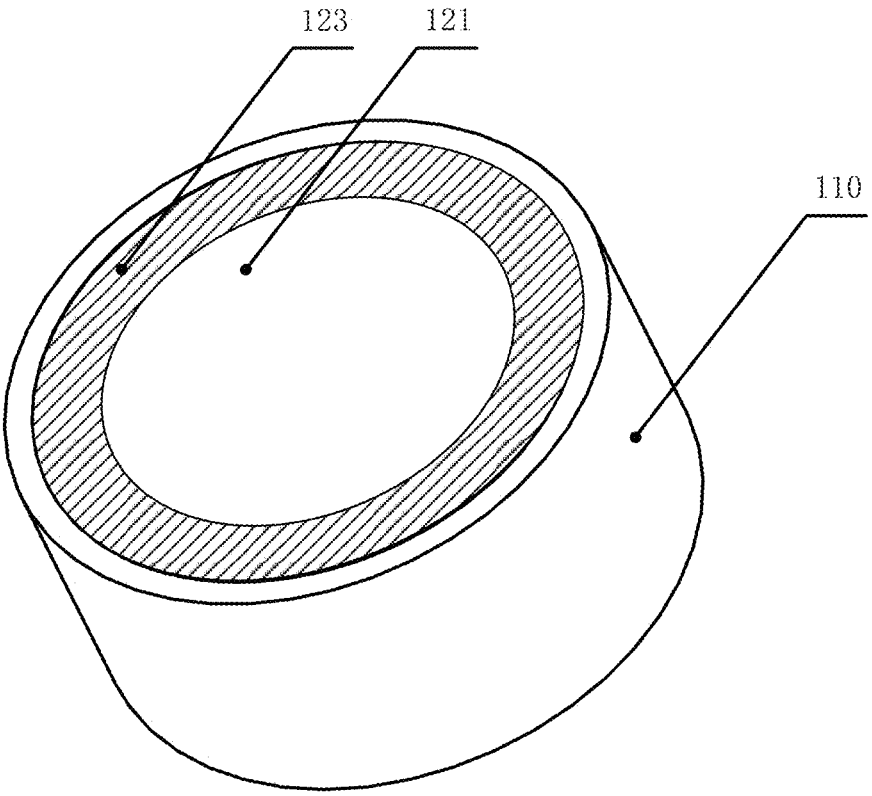
FIGS. 1A and 1B are schematic structures illustrating a bone conduction speaker of prior art.
Figure 1B:
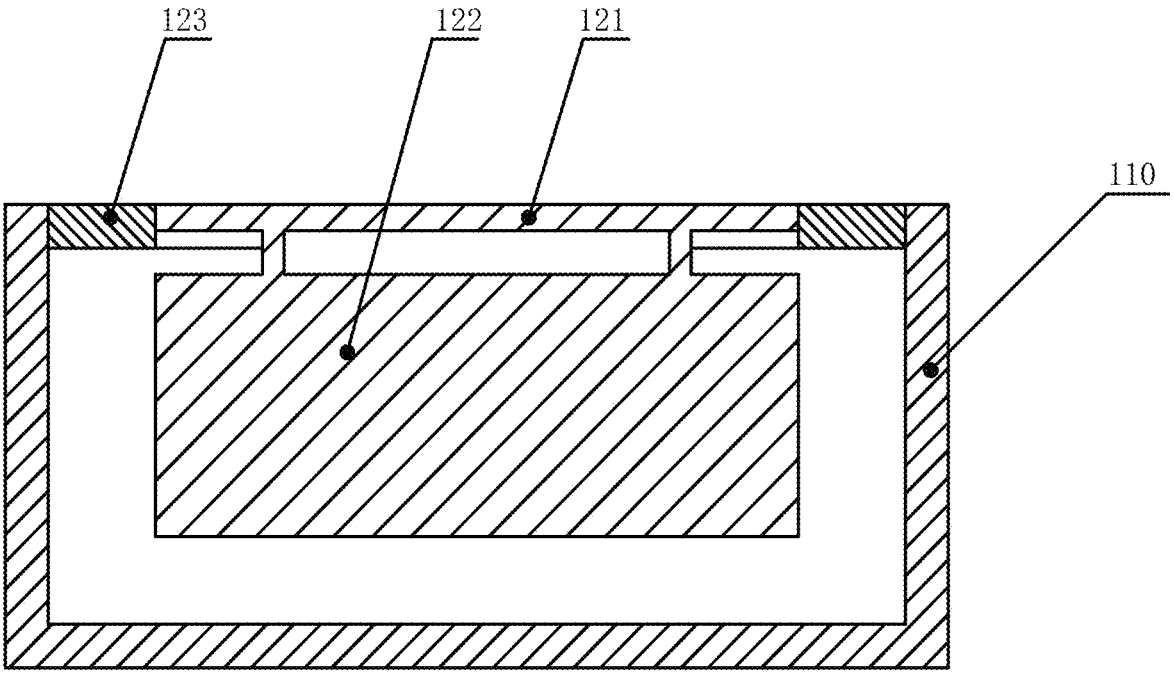
Figure 2:
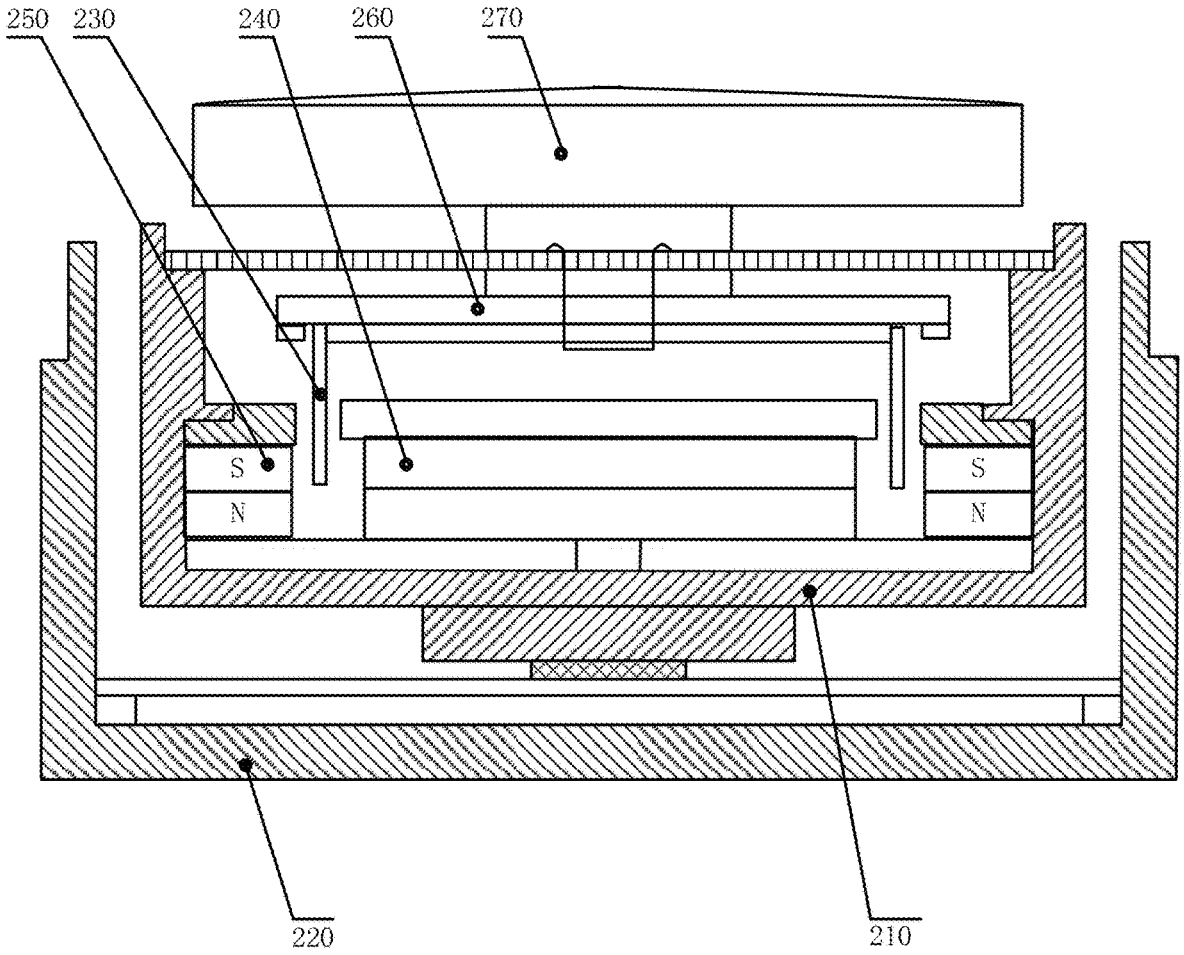
FIG. 2 is a schematic structure illustrating another bone conduction speaker of prior art.

In FIGS. 1.9A and 19B, the distance between the two point sound sources of the acoustic driver 1640 may be $d_1$, and the distance between the two point sound sources of the acoustic driver 1650 may be $d_2$, and d, may be greater than $d_2$. As shown in FIG. 19B, the listening position (that is, the position of the ear canal when the user wears a speaker) may be located on a line of a set of two-point sound sources. In some alternative embodiments, the listening position may be any suitable position. For example, the listening position may be located on a circle centered on the center point of the two-point sound sources. As another example, the listening position may be on the same side of two sets two-point sound sources connection, or in the middle of the two sets two-point sound sources connection.

It may be understood that the simplified structure of the speaker shown in FIGS. 19A and 19B may be merely by way of example, which may be not a limitation for the present disclosure. In some embodiments, the speaker shown in FIG. 19A and/or the speaker shown in FIG. 19B may include a supporting structure, a controller, a signal processor, or the like, or any combination thereof.

Figure 20A:
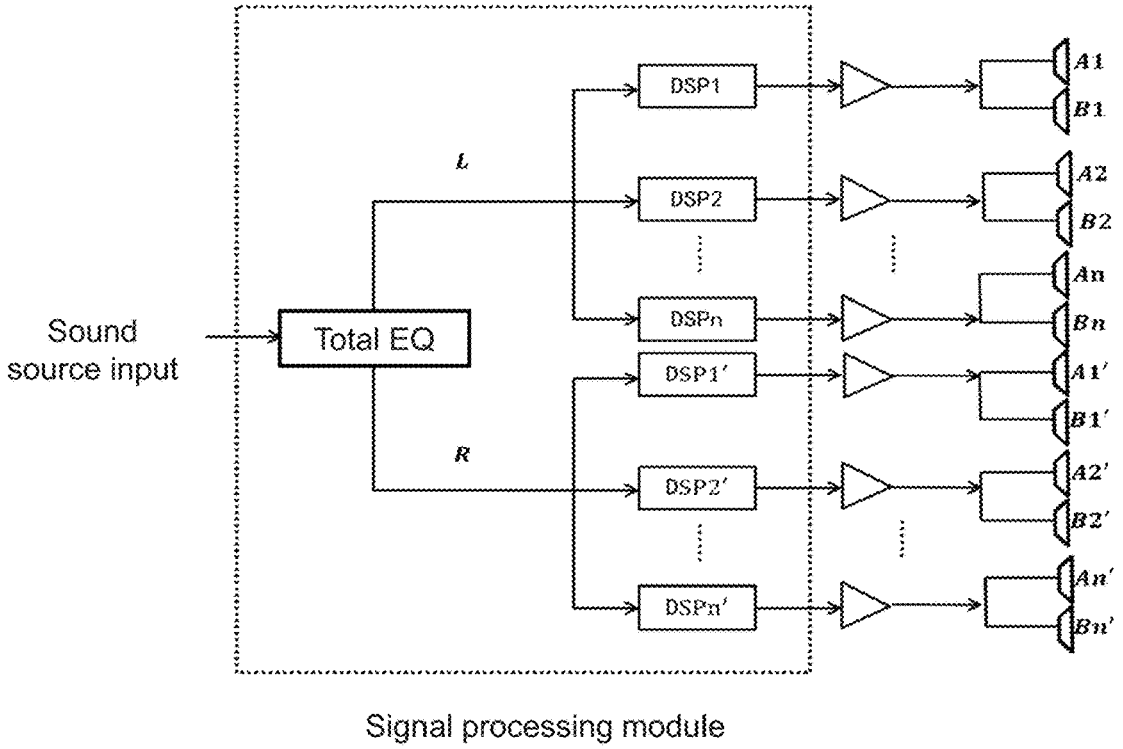
FIG. 20A is a schematic diagram illustrating an speaker according to some embodiments of the present disclosure.
Figure 20B:
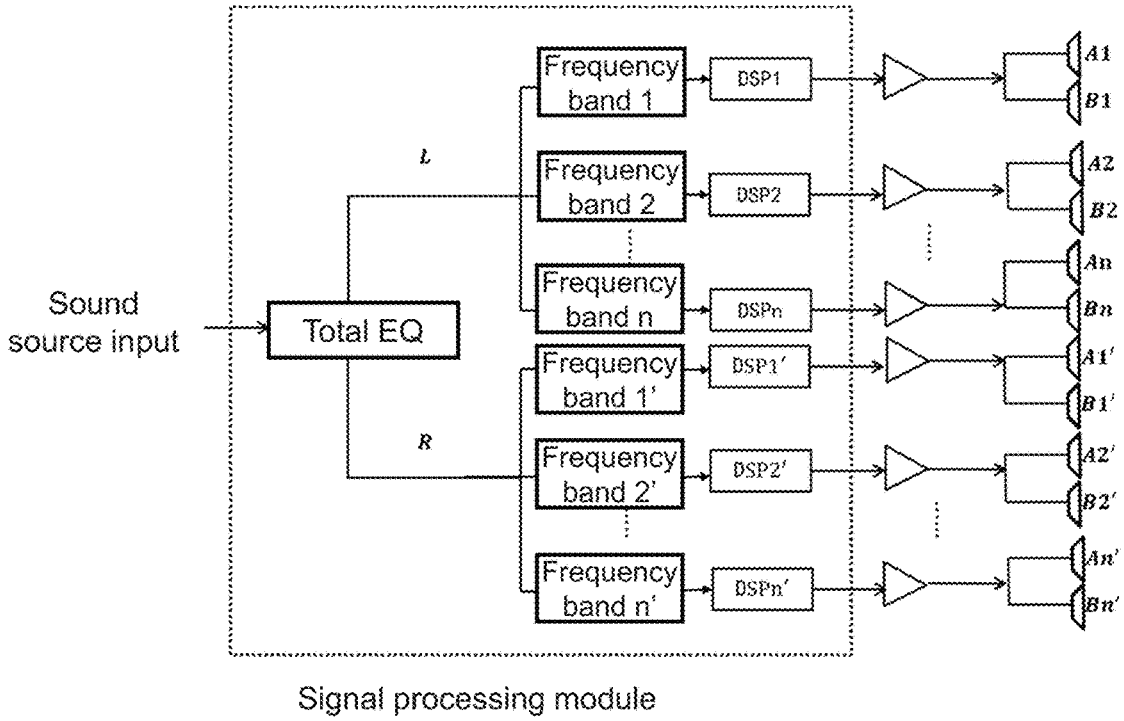
FIG. 20B is a schematic diagram illustrating another speaker according to some embodiments of the present disclosure.

FIG. 20A is a schematic diagram illustrating a speaker according to some embodiments of the present disclosure. FIG. 20B is a schematic diagram illustrating another speaker according to some embodiments of the present disclosure.

In some embodiments, acoustic drivers (e.g., acoustic drivers 1640 or 1650) may include multiple groups of narrow-band speakers. As shown in FIG. 20A, the speaker may include a plurality of groups of narrow-band speaker units and a signal processing module. On the left or right side of the user, the speaker may include n groups, respectively, with a total number of 2n narrow-band speaker units. Each group of narrow-band speaker units may have different frequency response curves, and the frequency response of each group may be complementary and may collectively cover the audible sound frequency band. The narrow-band speaker herein may be an acoustic driver with a narrower frequency response range than the low-frequency acoustic driver and high-frequency acoustic driver. Taking the speaker unit located on the left side of the user shown in FIG. 20A as an example: $A_1 \sim A_n$ and $B_1 \neq B_n$ form n groups of two-point sound sources, respectively. When the same electrical signal is an input, each two-point sound sources may generate sound with different frequency ranges. By setting the distance $d_n$ of each group of two-point sound sources, the near-field and far-field sound of each frequency band may be adjusted. For example, in order to enhance the volume of near-field sound and reduce the volume of far-field leakage, the distance between the higher-frequency group of two-point sound sources may be less than the distance of the lower-frequency group of two-point sound sources.

In some embodiments, the signal processing module may include an Equalizer (EQ) processing module, and a Digital Signal Processor (DSP) processing module. The signal processing module may be used to implement signal equalization and other general digital signal processing algorithms (such as amplitude modulation and equal modulation). The processed signal may output sound by being connected to a corresponding acoustic driver (for example, a narrow-band speaker) structure. Preferably, the narrow-band speaker may be a dynamic moving coil speaker or a moving iron speaker. In some embodiments, the narrow-band speaker may be a balanced armature speaker. Two-point sound sources may be constructed using two balanced armature speakers, and the sound output from the two speakers may be in opposite phases.

In some embodiments, the acoustic drivers (such as acoustic drivers 1640 or 1650) may include multiple groups of full-band speakers. As shown in FIG. 20B, the speaker may include a plurality of sets of full-band speaker units and a signal processing module. On the left or right side of the user, the speaker may include n groups, respectively, with a total number of 2×n full-band speaker units. Each full-band speaker unit may have the same or similar frequency response curve, and may cover a wide frequency range.

Taking the speaker unit located on the left side of the user as shown in FIG. 203 as an example: $A_1 \sim A_n$ and $B_1 \sim B_n$ form n groups of two-point sound sources, respectively. The difference from FIG. 20A may be that the signal processing module in FIG. 20B may include at least one set of filters for frequency division of the sound source signal, and the electric signals corresponding to different frequency ranges may be input into each group of full-band speakers. In this way, each group of speaker units (similar to the two-point sound sources) may produce sounds with different frequency ranges separately.

Figure 21:
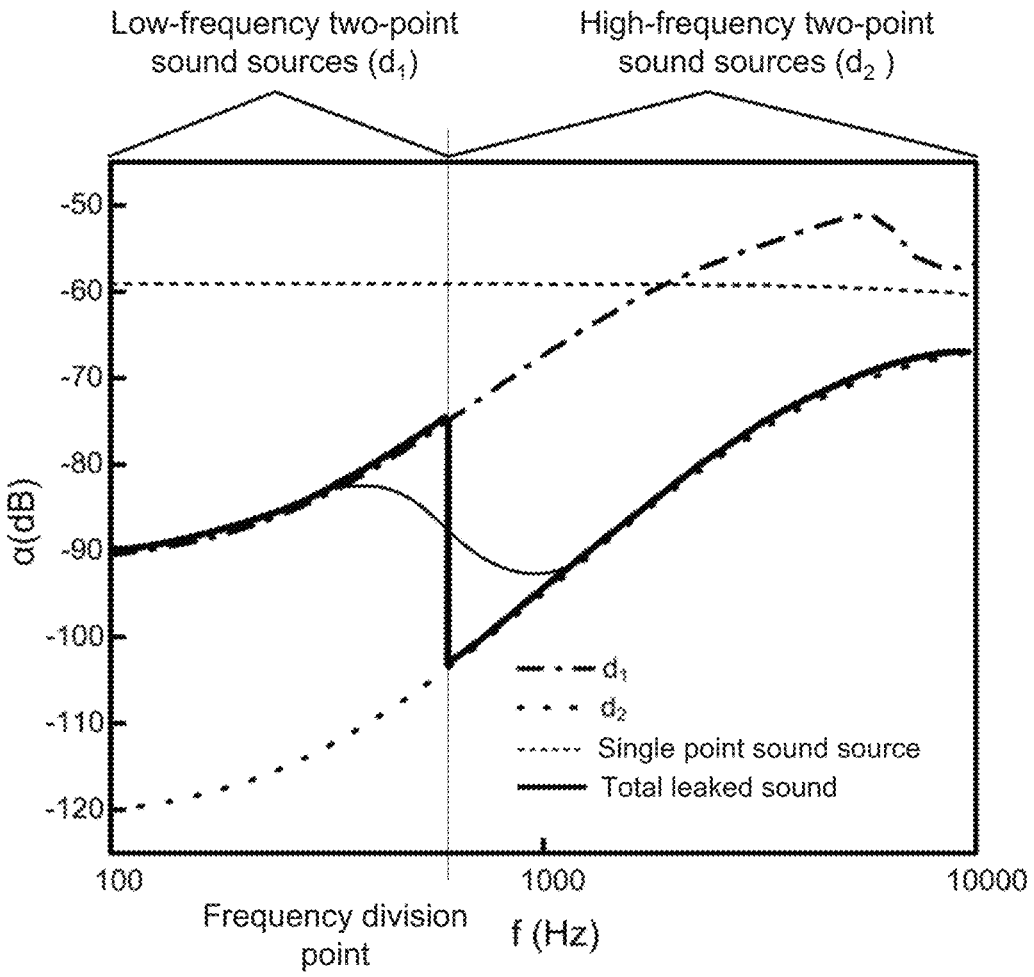
FIG. 21 is an exemplary graph illustrating the sound leakage under a combined action of two sets of two-point sound sources according to some embodiments of the present disclosure.

FIG. 21 is an exemplary graph illustrating the sound leakage under a combined action of two sets of two-point sound sources according to some embodiments of the present disclosure.

FIG. 21 shows a curve of the sound leakage of a speaker (for example, the speaker 1600) under the combined action of two sets of two-point sound sources (a group of two-point sound sources with high-frequency and a group of two-point sound sources with low-frequency). The frequency division points of the two sets of two-point sound sources may be around 700 Hz.

The normalization parameter a may be used to evaluate the volume of the leaked sound (for calculation of $\alpha$, see Equation (4)). As shown in FIG. 21, compared with the case of a single point sound source, the two-point sound sources may have a stronger ability to reduce sound leakage. In addition, compared with the speaker provided with only one set of two-point sound sources, the two sets of two-point sound sources may output high-frequency sounds and low-frequency sounds, separately. The distance between the low-frequency two-point sound sources may be greater than that of the high-frequency two-point sound sources. In the low-frequency range, by setting a larger two-point sound sources distance ($d_1$), the increase in the volume of the near-field sound may be greater than the increase in the volume of the far-field leakage, and may achieve a higher volume of the near-field sound output in the low-frequency band. At the same time, in the low-frequency range, the sound leakage of the two-point sound sources may originally be very small. After the distance between the two point sound sources is increased, the slightly increased sound leakage may still maintain a low level. In the high-frequency range, by setting a small distance ($d_2$) of the two-point sound sources, the problems of the cutoff frequency of high-frequency sound leakage reduction being too low and the audio band of the sound leakage reduction being too narrow may be overcome. Therefore, by setting the distance $d_1$ of the two-point sound sources in the low-frequency band and the distance $d_2$ of the two-point sound sources in the high-frequency band, the speaker provided in the embodiments of the present disclosure may obtain a stronger sound leakage suppressing capability than a single point sound source and a set of two-point sound sources.

In some embodiments, affected by factors such as the filter characteristics of the actual circuit, the frequency characteristics of the transducer, and the frequency characteristics of the acoustic channel, the actual low-frequency and high-frequency sounds of the speaker may differ from those shown in FIG. 21. In addition, low-frequency and high-frequency sounds may have a certain crossover (aliasing) in the frequency band near the frequency division point, causing the total sound leakage reduction of the speaker not to have a mutation at the frequency division point as shown in FIG. 21. Instead, there may be gradients and transitions in the frequency band near the frequency division point, as shown in the thin solid line in FIG. 21. It may be understood that these differences may not affect the overall leakage reduction effect of the speaker provided by the embodiment of the present disclosure.

Figure 22:
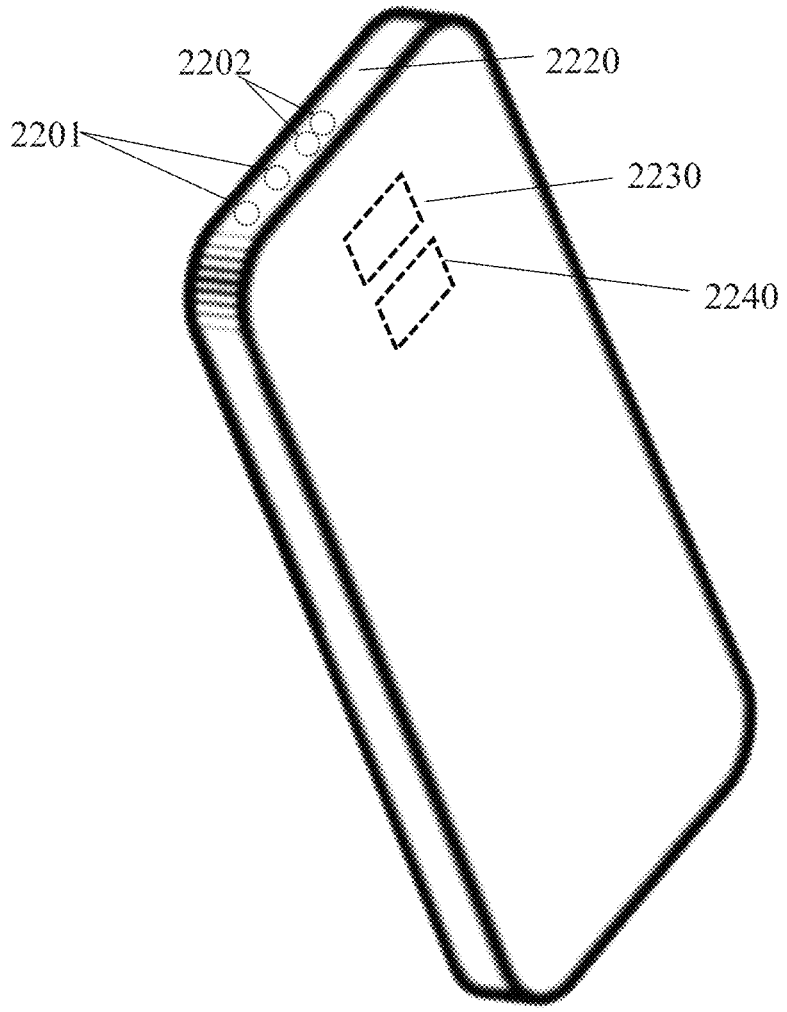
FIG. 22 is a schematic diagram illustrating a mobile phone with a plurality of sound guiding holes according to some embodiments of the present disclosure.

It needs to be known that the description of the present disclosure does not limit the actual use scenario of the speaker. The speaker may be any device or a part thereof that needs to output sound to a user. For example, the speaker may be applied on a mobile phone. FIG. 22 is a schematic diagram illustrating a mobile phone with a plurality of sound guiding holes according to some embodiments of the present disclosure. As shown in the figure, the top 1120 of the mobile phone 2200 (i.e., "vertical" to the upper-end face of the mobile phone display) is provided with a plurality of sound guiding holes as described elsewhere in the present disclosure. Merely by way of example, sound guiding holes 2201 may constitute a group of two-point sound sources (or point sound source arrays) for outputting the low-frequency sounds. Two sound guiding holes 2202 may form another group of two-point sound sources (or point source arrays) for outputting high-frequency sounds. The distance of the sound guiding holes 2201 may be longer than the distance of the sound guiding holes 2202. A low-frequency acoustic driver 2230 and a high-frequency acoustic driver 2240 are provided inside the casing of the mobile phone 2200. The low-frequency sound generated by the low-frequency acoustic driver 2230 may be transmitted outward through the sound guiding holes 2201, and the high-frequency sound generated by the high-frequency acoustic driver 2240 may be transmitted outward through the sound guiding holes 2202. According to other embodiments described in the present disclosure, when the user places the sound guiding holes 2201 and 2202 near the ear to answer the voice information, the sound guiding holes 2201 and 2202 may emit a strong near-field sound to the user, and at the same time may reduce leakage to the surrounding environment. Moreover, by setting up the sound guiding hole on the top of the phone, instead of the upper part of the display of the mobile phone, the space required to set up the sound guiding hole on the front of the phone may be saved, then the area of the mobile phone display may be further increased, the appearance of the phone more may also be concise and beautiful.

The above description of setting the sound guiding hole on the mobile phone is just for the purposes of illustration. Without departing from the principle, those skilled in the art may make adjustments to the structure, and the adjusted structure may still be within the protection scope of the present disclosure. For example, all or part of the sound guiding holes 2201 or 2202 may also be set on other positions of the mobile phone 2200. For example, the upper part of the back shell, the upper part of the side shell, etc., and these settings may still ensure that the user hears a large volume when receiving the sound information, and also prevents the sound information from leaking to the surrounding environment. As another example, low-frequency acoustic driver 2230 and/or high-frequency acoustic driver 2240 may not be necessary, and may also divide the sound output by the mobile phone 2200 through other methods described in the present disclosure, which will not be repeated here.

Beneficial effects of the present disclosure may include but not limited to: (1) a high-frequency two-point sound sources and a low-frequency two-point sound sources may be provided to output sound in different frequency bands, thereby achieving better acoustic output effect; (2) two-point sound sources with different distances may be provided, such that the speaker may have a stronger capability to reduce sound leakage in higher frequency bands, which may meet requirements for an open binaural speaker. It should be noted that different embodiments may have different beneficial effects. In various embodiments, the speaker may have any one or a combination of the benefits exemplified above, and any other beneficial effects that can be obtained.

It's noticeable that above statements are preferable embodiments and technical principles thereof. A person having ordinary skill in the art is easy to understand that this disclosure is not limited to the specific embodiments stated, and a person having ordinary skill in the art can make various obvious variations, adjustments, and substitutes within the protected scope of this disclosure. Therefore, although above embodiments state this disclosure in detail, this disclosure is not limited to the embodiments, and there can be many other equivalent embodiments within the scope of the present disclosure, and the protected scope of this disclosure is determined by following claims.

What is claimed is:

1. A speaker, comprising:

a housing;

at least one acoustic driver residing inside the housing and configured to generate vibrations, the vibrations producing a sound wave inside the housing and causing a leaked sound wave spreading outside the housing from a portion of the housing; and at least one sound guiding hole located on the housing and configured to guide the sound wave inside the housing through the at least one sound guiding hole to an outside of the housing, the guided sound wave having a phase different from a phase of the leaked sound wave, the guided sound wave interfering with the leaked sound wave in a target region, and the interference reducing a sound pressure level of the leaked sound wave in the target region, wherein the at least one acoustic driver includes:

at least one low-frequency acoustic driver that outputs sound in a first frequency range from at least two first sound guiding holes; and at least one high-frequency acoustic driver that outputs sound in a second frequency range from at least two second sound guiding holes, wherein the second frequency range includes frequencies higher than the first frequency range.

2. The speaker of claim 1, wherein there is a first distance of the two first sound guiding holes, there is a second distance of the two second sound guiding holes, and the first distance is greater than the second distance.

3. The speaker of claim 2, wherein the first distance is at least two times greater than the second distance.

4. The speaker of claim 1, wherein the first frequency range includes frequencies below 650 Hz, and the second frequency range includes frequencies above 1000 Hz.

5. The speaker of claim 1, further comprising:

an electronic frequency division module configured to divide a frequency of a sound source signal to generate a low-frequency signal corresponding to the first frequency range and a high-frequency signal corresponding to the second frequency range; wherein the low-frequency signal drives the at least one low-frequency acoustic driver to generate sound; and the high-frequency signal drives the at least one high-frequency acoustic driver to generate sound.

6. The speaker of claim 1, wherein the at least one low-frequency acoustic driver includes a first transducer, and the at least one high-frequency acoustic driver includes a second transducer; wherein the first transducer and the second transducer have different frequency response characteristics.

7. The speaker of claim 1, wherein a first acoustic route is formed between the at least one low-frequency acoustic driver and the at least two first sound guiding holes; a second acoustic route is formed between the at least one high-frequency acoustic driver and the at least two second sound guiding holes, and the first acoustic route and the second acoustic route have different frequency selection characteristics.

8. The speaker of claim 1, wherein the housing comprises:

a supporting structure configured to carry the at least one high-frequency acoustic driver and the at least one low-frequency acoustic driver, so that the at least two first sound guiding holes and the at least two second sound guiding holes are positioned away from a user's ear.

9. The speaker of claim 8, wherein the at least two second sound guiding holes are located closer to the user's ear than the at least two first sound guiding holes.

10. The speaker of claim 8, wherein the at least two first sound guiding holes and the at least two second sound guiding holes are located on the supporting structure.

11. The speaker of claim 1; wherein sounds output from the at least two first sound guiding holes are in opposite phases.

12. The speaker of claim 1, wherein sounds output from the at least two second sound guiding holes are in opposite phases.

13. The speaker of claim 1, wherein:

the housing includes a bottom or a sidewall; and the at least one sound guiding hole is located on the bottom or the sidewall of the housing.

14. The speaker of claim 1, wherein the at least one sound guiding hole includes a damping layer, the damping layer being configured to adjust the phase of the guided sound wave in the target region.

15. The speaker of claim 14, wherein the damping layer includes at least one of a tuning paper, a tuning cotton, a nonwoven fabric, a silk, a cotton, a sponge, or a rubber.

16. The speaker of claim 1, wherein the guided sound wave includes at least two sound waves having different phases.

17. The speaker of claim 16, wherein the at least one sound guiding hole includes two sound guiding holes located on the housing.

18. The speaker of claim 17, wherein the two sound guiding holes are arranged to generate the at least two sound waves having different phases to reduce the sound pressure level of the leaked sound wave having different wavelengths.

19. The speaker of claim 1, wherein:

the housing includes a bottom or a sidewall; and the at least one sound guiding hole is located on the bottom or the sidewall of the housing.

20. The speaker of claim 1, wherein a location of the at least one sound guiding hole is determined based on at least one of: a vibration frequency of a transducer of the at least one acoustic driver, a shape of the at least one sound guiding hole, the target region, or a frequency range within which the sound pressure level of the leaked sound wave is to be reduced.

* * * * *